US005983601A

United States Patent [19]

Blanch et al.

[11] Patent Number: 5,983,601

[45] Date of Patent: Nov. 16, 1999

[54] MACHINE FOR THE AUTOMATED PACKAGING OF NEEDLES AND ATTACHED SUTURES

[75] Inventors: John F. Blanch, Tinton Falls; David D. Demarest, Parsippany; Robert A. Daniele, Flemington; Anthony Esteves, Somerville; William F. Smith, Ringoes; Michael G. Hodulik, Dunellen; Teresa M. Shaw, Lawrenceville, all of N.J.; George Horst Reinemuth, Glen Mills; Richard Paul Branco, Collegeville, both of Pa.; Matthew Cafone, Edgewater Park, N.J.

[73] Assignee: Ethicon, Inc., Somerville, N.J.

[21] Appl. No.: 09/020,084

[22] Filed: Feb. 6, 1998

[51] Int. Cl.[6] ..... B65B 63/04

[52] U.S. Cl. ..... 53/430; 53/118; 53/235; 53/281; 53/297; 53/471; 53/473; 53/485

[58] Field of Search ..... 53/411, 415, 430, 53/467, 471, 473, 485, 53, 494, 505, 67, 118, 131.3, 235, 247, 255, 267, 281, 297, 285, 287, 290, 329, 367, 250, 252

[56] References Cited

U.S. PATENT DOCUMENTS

| | | |
|---|---|---|
| 2,620,028 | 12/1952 | Kohut . |
| 2,746,118 | 5/1956 | Drummond et al. . |
| 2,928,395 | 3/1960 | Forbes et al. . |
| 3,167,895 | 2/1965 | Egler et al. . |
| 3,611,551 | 10/1971 | Shave et al. . |
| 3,618,282 | 11/1971 | Hagel et al. . |
| 3,811,244 | 5/1974 | Killen et al. . |
| 3,816,889 | 6/1974 | Crotti . |
| 3,875,946 | 4/1975 | Duncan . |
| 3,980,177 | 9/1976 | McGregor . |
| 4,011,155 | 3/1977 | Feuerstein et al. . |
| 4,072,041 | 2/1978 | Hoffman et al. . |
| 4,255,917 | 3/1981 | Stone . |
| 4,424,898 | 1/1984 | Thyen et al. . |
| 4,651,879 | 3/1987 | Harris et al. . |
| 4,672,871 | 6/1987 | Gudmestad . |
| 4,722,384 | 2/1988 | Matsutani . |
| 4,744,035 | 5/1988 | Hashim . |
| 4,806,737 | 2/1989 | Coates . |
| 4,832,025 | 5/1989 | Coates . |
| 4,922,904 | 5/1990 | Uetake et al. . |
| 5,056,658 | 10/1991 | Sobel et al. . |
| 5,065,237 | 11/1991 | Tsikos et al. . |
| 5,150,307 | 9/1992 | McCourt et al. . |
| 5,226,336 | 7/1993 | Coates . |
| 5,230,424 | 7/1993 | Alpern et al. . |

(List continued on next page.)

FOREIGN PATENT DOCUMENTS

| | | |
|---|---|---|
| 428253 | 5/1991 | European Pat. Off. . |
| 581699 | 2/1994 | European Pat. Off. . |
| 2632850 | 12/1989 | France . |
| 89 04 145 | 7/1989 | Germany . |
| 63-212027 | 9/1988 | Japan . |
| 63-299834 | 12/1988 | Japan . |
| 3-82458 | 4/1991 | Japan . |
| 3-106530 | 5/1991 | Japan . |

*Primary Examiner*—Joseph J. Hail, III
*Assistant Examiner*—Ed Tolan

[57] ABSTRACT

A machine and a method for the automated packaging of armed sutures or; in effect, surgical needles having sutures attached thereto and, more particularly, an automated machine for the high-speed individualized packaging of single or individual surgical needles each having an attached suture into a tray and detachable cover providing a suture package utilized for the packaging of the individual or single needles and attached sutures. Additionally, the automated packaging machine incorporates operative mechanism adapted to wind the sutures into a peripheral channel of the tray and facilitating the attachment of the cover to the tray which contains the single needle and attached wound suture, and which cover concurrently constitutes a product-identifying label as a component of the tray, and upon removal of the cover enables a user to gain access to the contents of the tray; in essence, the armed suture.

70 Claims, 34 Drawing Sheets

U.S. PATENT DOCUMENTS 5,253,765 10/1993 Moorehead et al. . ..... Rattan .
5,438,746 8/1995 Demarest et al. .
5,452,636 9/1995
5,469,689 11/1995 Demarest et al. .
5,473,810 12/1995 Demarest et al. .
5,473,854 12/1995 Demarest et al. .
5,477,609 12/1995 Demarest et al. .
5,485,668 1/1996 Demarest et al. .
5,487,212 1/1996 Demarest et al. .
5,487,216 1/1996 Demarest et al. .
5,500,991 3/1996 Demarest et al. .
5,511,670 4/1996 Demarest et al. .
5,664,404 9/1997 Ivanov et al. ..... 53/118
5,666,782 9/1997 Prospero et al. ..... 53/118

MACHINE FOR THE AUTOMATED PACKAGING OF NEEDLES AND ATTACHED SUTURES

BACKGROUND OF THE INVENTION

1. Field of the Invention

The present invention relates to a machine for the automated packaging of armed sutures or; in effect, surgical needles having sutures attached thereto and, more particularly, pertains to an automated machine for the high-speed individualized packaging of single or individual surgical needles each having an attached suture into a tray and detachable cover providing a suture package utilized for the packaging of the individual or single needles and attached sutures. Additionally, the automated packaging machine incorporates operative mechanism adapted to wind the sutures into a peripheral channel of the tray and facilitating the attachment of the cover to the tray which contains the single needle and attached wound suture, and which cover concurrently constitutes a product-identifying label as a component of the tray. The cover being shaped such that removal of the cover is not necessary to enable a user to gain access to the contents of the tray; in essence, the armed suture.

Pursuant to a further aspect of the invention, there is also disclosed a method for the automated packaging of individual surgical needles and attached sutures into suture packages through the utilization of the inventive automated packaging machine.

The automated packaging machine also provides for a rotary turret or dial-like turntable for the high-speed loading thereof with empty trays; the sequential loading of successive forwardly indexed trays each with a needle and attached suture; the indexed advance of the empty tray to the suture-winding stations of the machine to be loaded with the needle and attached suture; the conveyance of the trays each containing the needle and attached wound suture to a cover-applying station of the machine to provide the completed suture packages, and the further advance of the suture packages for subsequent automated removal of the completed suture packages from the machine. The automated packaging machine is resultingly adapted to provide for the continuous and repetitive production of suture packages in a single high-speed production cycle without necessitating any manual manipulation thereof.

In order to facilitate the production of the suture packages as described herein, the present invention provides for a plurality of sequential operating stations, in which a first station includes carousel structure having stacked package trays sequentially conveyed to a rotary plate element which slices off the bottommost package tray from a buffer stack of trays, and includes operative structure for transferring the separated package tray to a tool nest mounted on a rotary dial for transfer to subsequent processing stations, where the package tray is provided with an armed suture, the suture wound into the package tray, a cover applied thereto to produce the completed product-containing package and which is then removed from the packaging machine and transported for additional processing and/or storage.

Currently, in the medical, surgical and health-related technology, the high-speed and efficient packaging of either single or multiple sutures which are each suitably attached to surgical needles, such as by being swaged or similarly fastened thereto, and in which such combined sets of needles and sutures are generally referred to as armed sutures, is imparted an increasing degree of importance in view of the rising demand of users for such combined surgical needles and attached sutures, and various diverse types of inexpensively manufactured suture packages for the containment of needles and attached sutures have been developed and are presently widely employed.

In specific instances, suture packages may be covered tray-shaped containers designed to receive and fixedly retain therein one or more needles and therewith attached sutures, in which the suture packages, upon opening of the covers, must enable the uncomplicated and simple withdrawal of a respective individual needle and its attached suture in a smooth unobstructed manner. In essence, when the needle which is to be removed from the suture package is engaged by a surgeon or health professional, for example, by being gripped through the intermediary of a forceps and then pulled out of the suture tray, it is essential that the needle easily disengage from its restraint in the package while the suture which is attached to the needle should also be readily able to slip out of the tray in the absence of any binding or snagging, and in the instance of the tray housing a plurality of armed sutures also without becoming entangled with other sutures still remaining in the suture tray or package. Thus, pursuant to a specific needle and suture package construction which, for example, may comprise an injection-molded plastic tray, the needles are generally engaged by clamping structure located in the tray so as to be "parked" or retained in predetermined position or array in a central region of the tray. The sutures extending from the needles to which they are attached are then conducted into and deposited in a peripheral channel formed within the suture tray so as to extend along the peripheral length of the channel. This positioning of the needles, and particularly that of the sutures within the peripheral channel of the tray is intended to eliminate tight bends or curves normally imposed on the sutures so as to facilitate their easy withdrawal from the suture package.

2. Discussion of the Prior Art

Until relatively recently, the introduction of needles with attached sutures into suture packages or molded plastic trays was being implemented in a substantially manual manner. In that instance, the needles were manually placed into the tray so as to be clampingly engaged by means of suitable needle-gripping structure, and thereafter the attached sutures wound or positioned within the confines of the tray. Subsequently, a suitable cover was superimposed upon and fastened to the filled tray, and the resultant armed suture package conveyed to a suitable arrangement for possible sterilizing or further over wrapping.

The foregoing essentially manual and relatively basic process for winding the sutures into the tray, and especially the locating thereof into the peripheral channel of the tray during manipulation of the tray, was quite time-consuming, and in conjunction with the manual application of the cover into the tray in a basically individual or piece-by-piece mode, represented a serious hindrance to a large volume or mass produced manufacturing output, and adversely affected the economics in attempting to provide such large quantities of suture packages containing either single or multiple surgical needles and attached sutures.

As an improvement over the foregoing, there was then developed a generally semi-automated winder machine for packaging surgical needles and attached sutures in a tray-like suture package, and wherein at least some of the previously manually implemented packaging steps were to some extent automated in order to be able to increase the output of needle and suture-containing packages while simultaneously reducing the number of manual procedures in effectuating the packaging of those particular items.

To that effect, the semi-automated winder machine, although necessitating the manual orientation of the trays for implementing the filling thereof with needles and attached sutures, included a winding station which to a considerable degree automated the winding process for the sutures so as to place the latter into a peripheral channel extending about the circumference of the tray. Also provided was a further therewith operatively associated device which enabled covers to be manually placed on the needle and suture-filled trays to be fastened thereto by means of a pressing die forming latchingly engaging interconnections between each of the covers and the trays, while concurrently producing from a portion of the cover a product-identifying label which remains permanently attached to the tray upon subsequent detachment of the cover. Although providing a considerable advance over the state-of-the-art in the packaging of needles and sutures, the semi-automated winder machine nevertheless necessitated the implementation of a considerable number of manual and labor-intensive handling steps in effectuating the filling of the trays with surgical needles and attached sutures, attaching the cover and, generally, producing complete suture packages.

As a further technological advance over the foregoing semi-automated needle and suture package-forming concept, there was then developed a substantially fully automated packaging machine which is adapted, in a highly efficient and extremely rapid mode, to continually fill successive trays of the type described hereinabove with pluralities of surgical needles and attached sutures, and subsequently causing the sutures to be wound into the confines of the tray, such as into a peripheral channel extending about the tray. Thereafter, the packaging machine was designed to implement the automated positioning and fastening of covers to the needle and suture-filled trays to produce completed suture packages of the type described hereinabove, which were then adapted to be transported to a suitable locale for selective further processing, such as sterilizing, and/or over wrapping, as is required by this technology.

In particular, the automated packaging machine was designed to provide the packages with each housing a plurality of needles and attached sutures. For example, the packaging machine for accomplishing the foregoing, which is commonly assigned to the assignee of the present application, is described in U.S. Pat. Nos. 5,487,212; 5,473,854; 5,469,689; 5,473,810; 5,511,670; 5,452,636; 5,438,746; 5,500,991; 5,477,609; 5,485,668; and 5,487,216.

The flat, tray-shaped suture package produced by the packaging machine set forth in the above-mentioned patents provides for the storage therein of multiple surgical needles and attached sutures, while concurrently recognizing the need to facilitate the smooth and unobstructed withdrawal of individual needles and attached sutures from the suture package. For instance, such a suture package is disclosed in applicants' U.S. Pat. No. 5,230,424, which is commonly assigned to the assignee of the present application; and wherein the suture package is referred to as an RSO package (Reduced Size Organizer).

In the specific design of the flat tray-shaped plastic container having a peripheral channel as disclosed in the above-mentioned patent, the suture package is basically constituted of a rectangular round-cornered and flat-bottomed injection-molded plastic tray having a flat central surface area including a raised needle clamping structure formed thereon for engaging and "parking" a plurality of needles in a predetermined spaced array. Sutures each have one end thereof attached to each of the respective needles so as to form so-called "armed sutures". The sutures extend from each of the needles into a channel extending about the perimeter or periphery of the suture tray and are conducted into the channel so as to be essentially wound within the circumferential confines of the suture tray. The plurality of sutures which are positioned within the suture tray channel are protected against inadvertent outward displacement therefrom through the presence of a multiplicity of contiguously positioned resilient fingers which are integrally molded with the suture tray, and which project outwardly above the confines of the channel along a major portion of the length of the channel and, collectively, form a so-called "zipper structure" in which the inherently resilient nature of the fingers facilitates their temporary raising up to enable the introduction of the sutures into the suture tray channel by means of a suitable suture winding apparatus.

Although the rotary dial or turntable apparatus of the packaging machine pursuant to the foregoing U.S. patents provide for the packaging of armed sutures; in effect, needles with attached sutures, in a rapid and fully automated manner, such as by supplying the tray-shaped packages; thereafter parking the plurality of armed sutures in the packages, applying covers and removing the completed suture packages from the machine in a sequential station-to-station procedure, the machine was designed to primarily produce suture packages each containing a plurality of armed sutures.

SUMMARY OF THE INVENTION

Pursuant to the present inventive concept, the above-mentioned automated packaging machine is further improved upon in a novel and unique manner in that the machine is adapted to produce suture packages each containing a single armed suture, such packages being frequently in demand rather than packages containing a plurality of needles and sutures. Thus, in order to provide for high production rates which are essentially compatible with those employed in the manufacture of suture packages each containing a plurality of armed sutures, the present invention contemplates the provision of a fully automated packaging machine with a considerably increased rate of operating speed and production capability so as to render the packaging machines economically viable in comparison with the previously described automated packaging machine, while maintaining structural and functional reliability and ease of construction and maintenance.

In order to attain the essentially automated packaging of singly-packaged or individual surgical needles with attached sutures, the automated packaging machine pursuant to the invention sets forth the provision of a rotary turret or dial-like turntable having a plurality of tool nests each possessing a suture tray supporting surface, with each tool next being circumferentially spaced about the turntable so as to be uniformly distributed about the periphery thereof. The rotary turret is rotated to cause the tool nests supporting packaging trays to be indexed forwardly so as to advance through a plurality of successive work stations which are adapted to, respectively, effectuate the supplying of each of the trays located on the tool nests or support surfaces with a single or individual surgical needle and attached suture, winding the suture into the confines of each needle and suture-containing tray, forming a latching engagement between a tray cover and the tray; and thereafter conveying each completed suture package to a station for removal from the machine and transfer to stacking bins or the like.

Operatively communicating in synchronism with the indexing rotation of the rotary turret is a carousel device housing stacks of trays, which is adapted to supply empty trays sliced or separated from the bottom of a respective stack of the trays to a rotatable platform, and includes operative robotic pivot arm structure to successively remove the trays from the rotatable platform and mount the empty trays on successive tool nests so as to be oriented in a vertical plane facing radially outwardly of the rotary turret. Thereafter, each tray is indexed sequentially forwardly by the rotary turret to a workstation which will impart movement to a portion of the tool nest having the tray supported thereon, whereby the tray remains oriented essentially vertically it is rotated angularly relative to the horizontal plane of rotation of the rotary turret. This movement enables a transfer device with a needle and suture swaging mechanism to cause needle grippers to insert and position a surgical needle with its attached suture into a therewith aligned tray for retentive engagement with needle-engaging structure formed in the tray so as to grip and park the needle therein, with the suture extending from the needle and depending downwardly therefrom outwardly of the tray. The needle and suture-containing tray is then advanced forwardly on its respective tool nest to successive workstations responsive to indexed advance of the rotary turret wherein, at a first suture winding station, structure operatively cooperating with the tray and the tool nest supporting the tray imparts an initial rotational movement to the tray about an axis perpendicular to the plane of the tray while maintaining the depending suture under tension, and at a second subsequent winding station imparts a rapid winding motion to the tray over multiple predetermined rotations so as to fully wind the downwardly depending suture into a peripheral tray channel extending within the perimeter of the tray.

Thereafter, the tool nest mounting the tray with the needle parked therein and the attached suture which has been wound into the peripheral channel of the tray is advanced to a further workstation responsive to indexed rotation of the rotary turret; at which workstation an operating mechanism causes a bottommost cover to be sliced or separated from a stack of covers and transferred to a rotatable platform. The cover is then engaged by a robotically-controlled pivot arm which, under the action of a vacuum, pivots the cover into a vertical orientation and applies the cover onto the tray while concurrently imparting pressure to the cover to cause cooperating latching structure to clampingly fasten the cover to the needle and suture-containing tray. Upon completion of the cover-attaching sequence, the resultingly completed suture package is indexed to a further workstation at which suitable grippers on a pivot arm mechanism engages the suture package, and the suture package is disengaged from the tool nest on which it is supported and transferred to and stacked in repository or receiving units to be readied for further processing, such as sterilizing, overwrapping or the like, as may be required.

The foregoing sequence of operative steps is continually repeated for each successive tool nest on the rotary turret or turntable sequentially receiving empty trays from the carousel, while preceding tool nests each mounting a tray are conveyed through the above-mentioned packaging cycle. Thus, a successive tray is always placed into a position of readiness at a following or subsequent workstation and processed in a similar manner as before described during the forward indexing motion of the rotary turret or turntable. This ensures a continuously repetitive packaging cycle for successive suture packages in a highly efficient and high-speed operation without the need for any manual intervention in the operation of the packaging machine.

Intermediate various of the workstations as set forth hereinbefore; there may be arranged other workstations incorporating sensors adapted to enable ascertaining the presence of empty trays at the initial workstation, for a verification of a needle having been inserted into the trays and for inspection of the trays subsequent to the winding of the sutures into the tray channels; checking for the application of the covers to the trays, and facilitating the possible ejection of incomplete trays or the removal from the machine of defective packages.

Accordingly, it is a basic object of the present invention to provide a novel automated packaging machine including operative structure for sequentially feeding individual package trays to successive tool nests on a rotary dial having a plurality of circumferentially spaced tool nests mounted thereon, so as to facilitate the trays to be subsequently supplied with armed sutures and tray covers or labels and thereafter transported in a rapid sequence from the machine.

Another object of the present invention is to provide an automated packaging machine for the packaging of single surgical needles and attached sutures into individual suture packages which includes operative structure for mounting package trays in rapid sequence on successive tool nests located on a rotary dial of the machine.

Yet another object of the inventive resides in the provision of an automated packaging machine of the type described wherein single surgical needles and attached sutures are packaged into suture packages in successive packaging steps at a plurality of successive workstations.

A further object of the present invention is to provide a novel method of packaging single surgical needles and attached sutures into suture packages in a high-speed production sequence.

A still further object of the present invention is to provide for the rapid packaging of single surgical needles and attached sutures into individual suture packages through the packaging method employing the automated packaging machine as described herein.

BRIEF DESCRIPTION OF THE DRAWINGS

Reference may now be had to the following detailed description of a preferred embodiment of the inventive automated packaging machine for the packaging of surgical needles and attached sutures, taken in conjunction with the accompanying drawings; in which.

DETAILED DESCRIPTION OF THE PREFERRED EMBODIMENT

Figure 1:
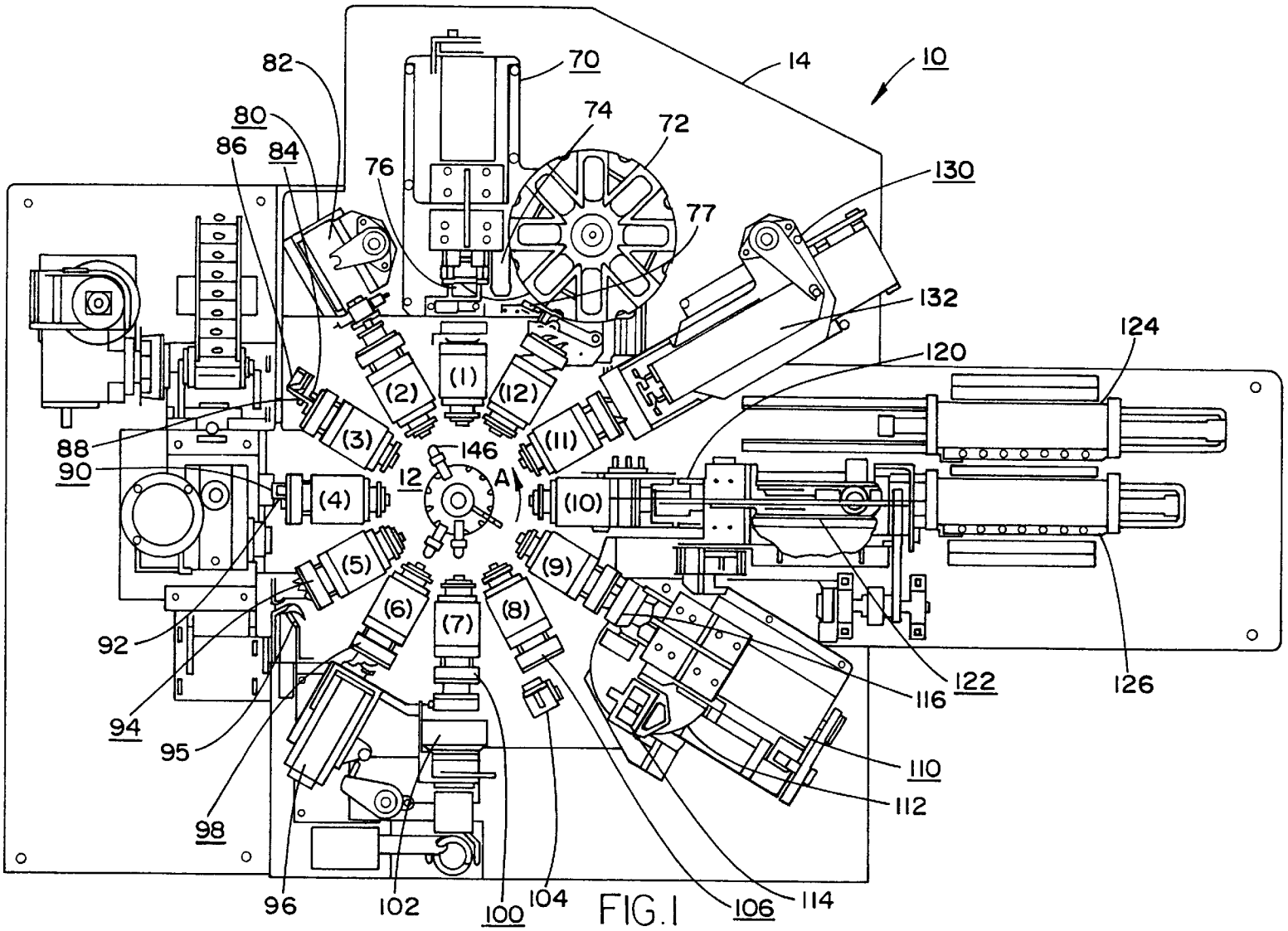
FIG. 1 illustrates generally diagrammatically, a plan view of the machine for the automated packaging of individual surgical needles and attached sutures, pursuant to the present invention.
Figure 2:
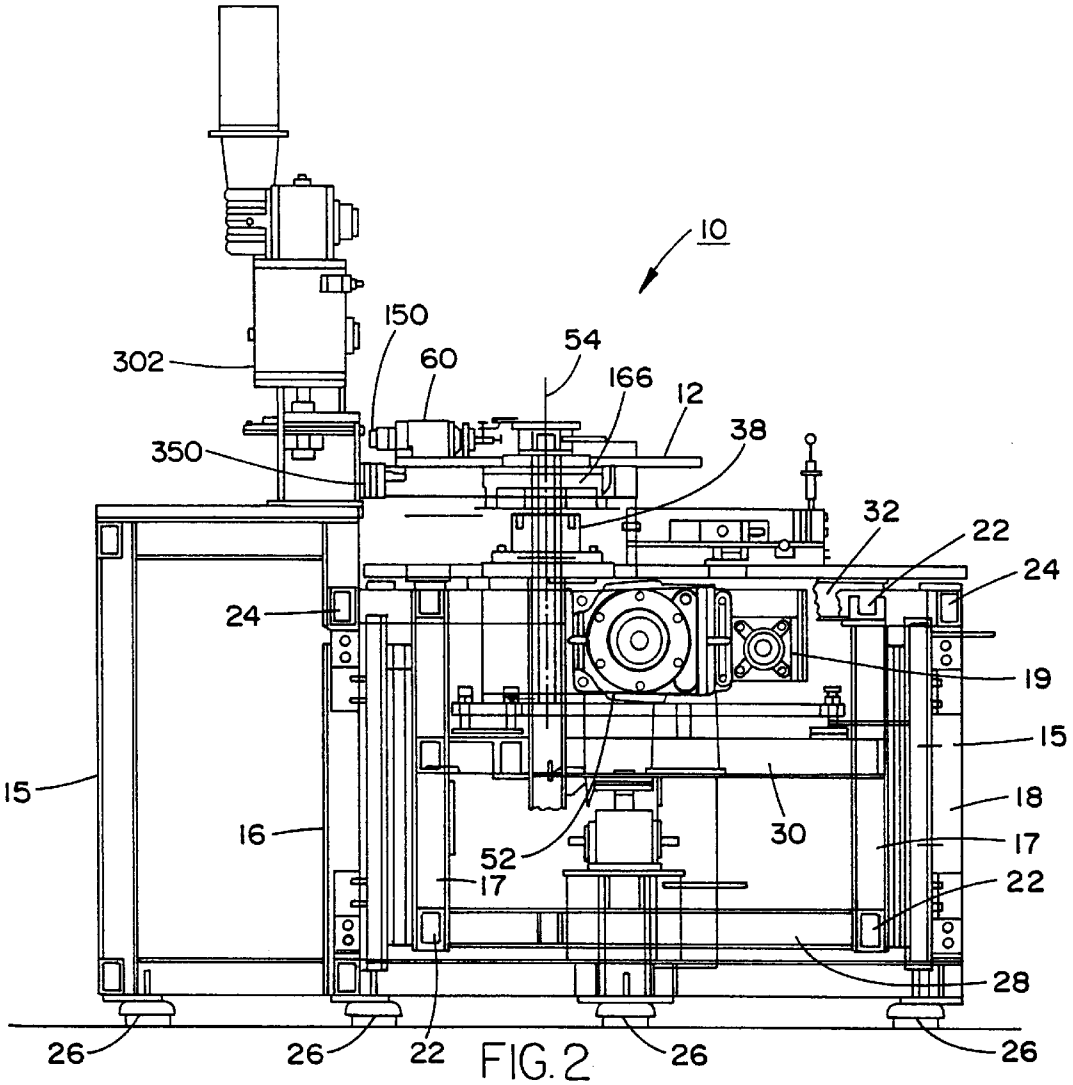
FIG. 2 illustrates a side elevational view of the machine frame of FIG. 1.
Figure 3:
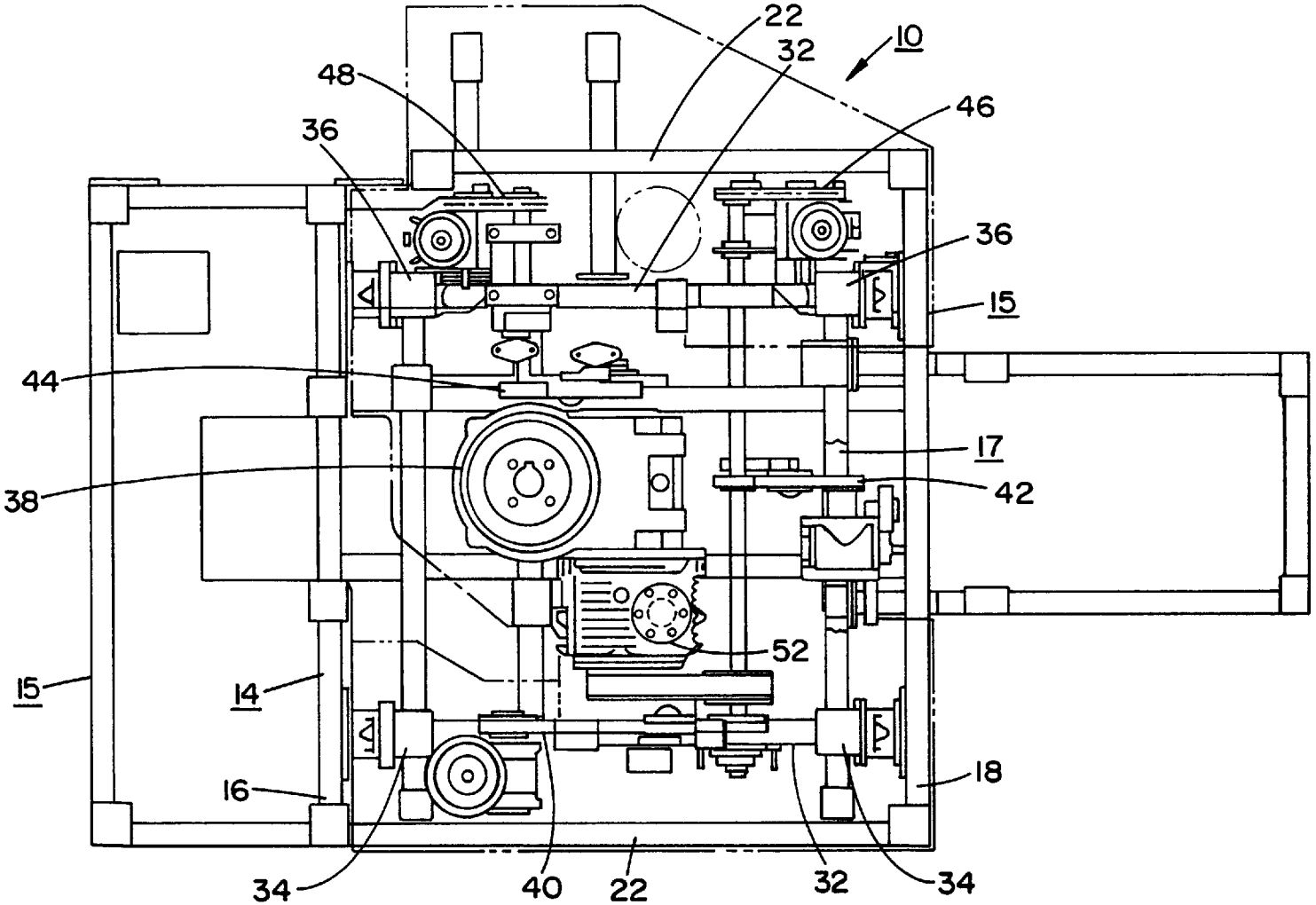
FIG. 3 illustrates a top plan view of the machine frame of FIG. 2.

Referring now in more specific detail to the drawings, FIGS. 1 to 3 illustrate, in a generally diagrammatic plan view, the automated needle and suture packaging machine 10 pursuant to the invention. The machine 10 comprises a rotary turret or turntable 12 which is essentially a packaging dial supported on an essentially stationary machine frame structure 14.

The rigid frame structure 14, as illustrated in FIGS. 2 and 3, basically includes structural uprights 16 and 18, which are interconnected by horizontal beams 20, 22, 24, with the entire frame structure 14 adapted to be supported on a floor through the intermediary of adjustable leveling footings 26. The frame structure 14 comprises an outer stationary frame arrangement 15, and an inner vertically adjustable frame arrangement 17 comprising horizontal beams 28, 30 and 32, and vertical beams 34, 36 interconnected therewith supporting the turntable 12 for vertical adjustment relative to the stationary machine frame components. The vertical adjustment of the frame arrangement 17 is provided for by a central servo motor actuated jack screw 38, which also concurrently effectuates the vertical adjustment of all of the operative packaging devices at the various workstations of the machine so as to accommodate the packaging of a wide range of differently sized surgical needles without the necessity for modifying any machine components. Arranged within the frame structure are the various belt drives 40, 42, 44, 46 and 48 and operating drive components 52 for the machine, and the vacuum-generating systems (not shown) employed in the packaging cycles for the suture packages, as described hereinbelow. The turntable 12 is oriented in a horizontal plane, and through the intermediary of a program-controlled drive installation, is rotatable in an indexing or incrementally angular advance about a central vertical axis 54. In this instance, during operation of the machine, the turntable 12 is rotated in a counter-clockwise direction when viewed from above, as represented by arrow A, so as to be advanced in 30° increments.

The rotary turret or turntable 12 is essentially constituted of a circular disk-shaped member or packaging dial which has a plurality of tool nests 60 mounted thereon. The tool nests 60 are mounted in a circumferentially uniformly spaced array on the upper surface of the package dial or rotary turret 12, and with each tool nest 60 having an outer end projecting radially outwardly of the peripheral edge of the turret or dial 12, as described hereinbelow.

In this particular construction of the packaging machine 10, by way of example, twelve (12) tool nests 60 are arranged at uniformly distributed annular spacings of 30° from each other about the circumference of the dial or rotary turret 12.

In essence, as mentioned hereinbelow, the rotary turret or turntable 12 of the packaging machine 10 is adapted to be indexed forwardly in an angularly incremental or indexed rotational advance, each such incremental advance comprising one-twelfth of the 360° circumferential rotation of the turntable, or basically 30°, along the direction of rotation identified by arrow A in FIG. 1, such that the tool nests 60 which are each adapted to mount a suture tray or package are designed to be advanced in sequence to a number of successive workstations; designated herein as workstations (1) through (12), which are stationarily evenly spaced about the periphery of the rotary turret 12, as illustrated in FIG. 1 of the drawings.

The successive workstations which collectively constitute the automated machine 10 for the packaging of surgical needles and attached sutures are essentially briefly described as follows; viewed in the direction of rotation of arrow A:

(1) A first workstation 70 relates to the operative aspect of empty suture package trays being successively separated from the bottom of stacks of trays contained in a rotary carousel 72 to be transferred onto a rotationally indexed plate 74 under the action of a vacuum and gravity, and thereafter picked up and transferred by a cam-controlled robotic pivot arm structure 76 to successive tool nests 60 so as to be retained thereon while being conveyed by the rotary turret or dial 12 to subsequent workstations, as set forth hereinbelow.

(2) At this workstation 80, to which the respective tool nest 60 supporting the empty tray thereon has been advanced by the rotational advance of the turntable 12 mounting the tool nest; in effect, indexed 30° forwardly; operative pneumatic pivot structure 82 engages a plate element on the outer end of the tool nest 60 which supports the empty tray under a vacuum, and rotates the plate element and tray counter-clockwise within the vertical plane thereof about a horizontal radial axis of the tool nest 60 through an angle of approximately sixteen and one-half (16.5°) degrees so as to be in appropriate angular orientation relative to a horizontal axis for facilitating the subsequent insertion and retention of a surgical needle and attached suture into the tray.

(3) This workstation 84 provides for a sensor 86 which is mounted stationarily on a bracket arrangement 88 and faces the tool nest 60 so as to be able to check for the presence of an empty tray on the tool nest. The sensor 86 is suitably aimed at a black spot present on the packaging tooling nest, and in the absence of a tray being positioned thereon, enables deactivating the forward advance of the turntable 12 and concurrently may emit a signal to alert personnel regarding the missing tray.

(4) The next workstation 90 along the rotational path of motion of the turntable in the direction of arrow A, provides gripper mechanism 92 for inserting a single surgical needle and a therewith attached suture into the suture tray which has been indexed forwardly by the rotary turret 12 so as to be located in operative alignment with the needle-feed mechanism. The needles are conveyed by a mechanism so as to be mounted on suitable clamping or needle "park" structure constituting an integral portion of the tray. Vacuum-controlled suture capture and tensioning devices which are located below each tool nest 60, become operative at this workstation to capture and tension the suture portions depending outwardly and downwardly of the tray mounting the surgical needle.

(5) At this workstation 94, a stationary sensor 95 located radially outwardly of the turntable 12 may be utilized to ascertain the presence of a surgical needle and attached suture having been properly introduced into the tray at the previous workstation 90.

(6) A first tray winding mechanism 96 at this workstation 98 engages the plate element on the tool nest supporting the tray, while the suture capture and tensioning device ensures that the suture portion depending outwardly and downwardly from the tray is maintained under tension by a vacuum-operated tensioning device and a spring loaded tensioning bar associated therewith, with the tray being rotated counterclockwise within its vertical plane through approximately 163.5°, to assume a horizontal orientation which is 180° inverse to its original orientation on the tool nest 60 at workstation (1), and with the remaining length of the suture being tensioned by the vacuum device externally of the tray.

(7) At a subsequent workstation 100, a further winding mechanism 102 engages the tool nest 60 and the tray mounted thereon, captures the tensioned suture strand, and imparts rapid rotation to the tray so as to enable tray structure engaging portions of the mechanism to introduce and completely wind the entire remaining length of the suture into a peripheral groove extending about the confines of the tray.

(8) A stationary sensor 104 at this workstation 106 is located radially outwardly of the turntable 12, and is adapted to ascertain the positioning of the surgical needle in the tray.

(9) This workstation 110 provides apparatus for the application and attachment of a cover or label to the tray containing the surgical needle and attached suture to produce or complete suture to produce a complete suture package. A rotatably indexed disc-like plate 112 includes a plurality of equidistantly circumferentially spaced cover-receiving areas, these being rotated below a vertical stack 114 of covers or labels such that, under the action of a vacuum, the bottommost covers of the stack are sequentially sliced off or separated and deposited into a respective area of the plate under the influence of the vacuum present therebeneath, and thereafter rotated into radial alignment with a tool nest 60 mounting the tray containing the surgical needle and attached wound suture. A cam-controlled robotic pivot arm structure 116 lifts the cover from the plate, while a subsequent area receives a further cover from the stack for transfer onto a following tray, and pivots upwardly and extends horizontally forwardly so as to position the cover into latching engagement with the tray, thereby forming the completed suture package.

(10) A robotic pivotable gripper arm 120 removes the completed package from the tool nest 60 at this subsequent workstation 122, and swings downwardly so as to deposit the completed suture package into receiving bins or compartments within elongated tray members 124 whereby upon a certain amount of trays being deposited to fill the tray member the latter is indexed to align a further empty compartment of a tray member with the tool nests. The tray member having the various filled compartments is then conveyed to a storage unit 126 and replaced automatically by another empty tray member.

(11) In the event of a suture package being defective, such as having a cover lacking or misplaced, and the resultant package has accordingly not been removed at the preceding package unloading workstation 122; at this workstation 130 a reciprocating arm structure 132 has a gripper head which engages and removes the rejected packages from the tool nests, and deposits them onto a conveyor belt 134 for conveyance to a suitable waste disposal site.

(12) A sensor 77 at the final workstation on the packaging machine 10 checks for the presence of a package that may not have been removed at stations (10) and (11). This is a further safegard built into the packaging machine to ensure that the tool nest at station (1) is empty and ready to accept an empty package tray.

Figure 4:
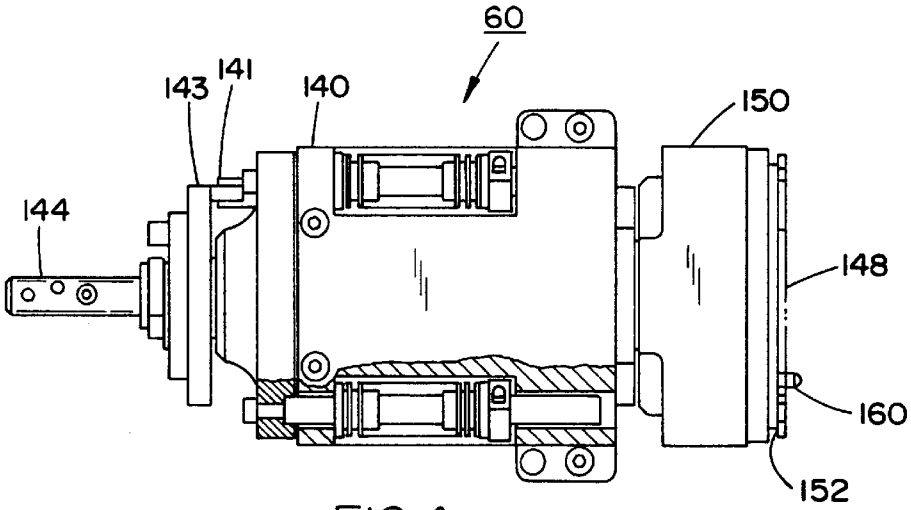
FIGS. 4, 5 and 6 illustrate, respectively, partially-sectional side and top plan views and a front end view of a tool nest utilized in the machine of FIG. 1.
Figure 5:
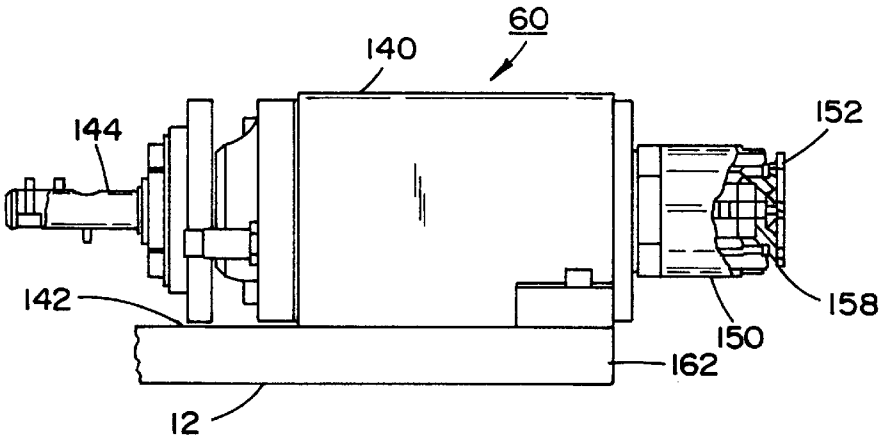
Figure 6:
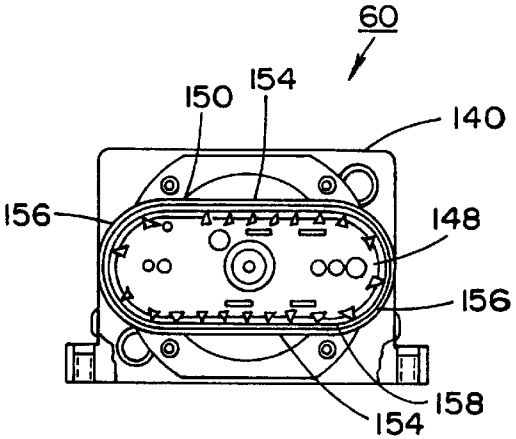

As shown in FIGS. 4 through 6, each tool nest 60 includes a housing 140 which is fixedly mounted on the upper surface 142 of the rotary turret 12. Each housing 142 includes a horizontal radially extending central through bore having a shaft 144 rotatably journaled therein. The shaft 144 is normally secured against rotation within housing 140; however, at predetermined workstations of the machine, the shaft 144 may be released by means of a locating pin 141 so as to be axially radially inwardly movable within housing 140 against stationary cam structure 143 mounted centrally on the rotary turret or dial 12 for regulating the rotational displacement which may be imparted to the shaft 144, as discussed hereinbelow in more specific detail.

The radially outwardly facing structure 148 of a plate element 150, which is fixedly secured to the radially outer end of shaft 144, is adapted for supporting suture package components, and particularly the package trays which are utilized in the production of surgical needle and attached suture-containing packages.

In essence, the radially outer structure of the tool nest housing 140 for mounting suture trays includes the plate element 150 which comprises an elongate vertically oriented plate member 152 having generally parallel opposite sides 154 and convexly rounded opposite ends 156 so as to be generally in conformance with the peripheral shape of a package tray. An external planar surface on the plate member 152 includes protruding perimeter or rim structure 158 for seating engagement therein of a suture tray, with the plate member 152 being fixedly secured to the radially outer end of the shaft 144 so as to be adapted for rotation therewith. Extending forwardly from the external planar surface of the rotatable plate member 152 of the tool nest 60 are protuberances or guide pins 160 which are intended to align the package tray thereon for appropriate positioning on the plate member 152, with the tray adapted to be retained thereon through the application of a vacuum to the exterior plate member surface through passageways communicating with a vacuum source connected thereto through the tool nest housing 140.

Figure 7:
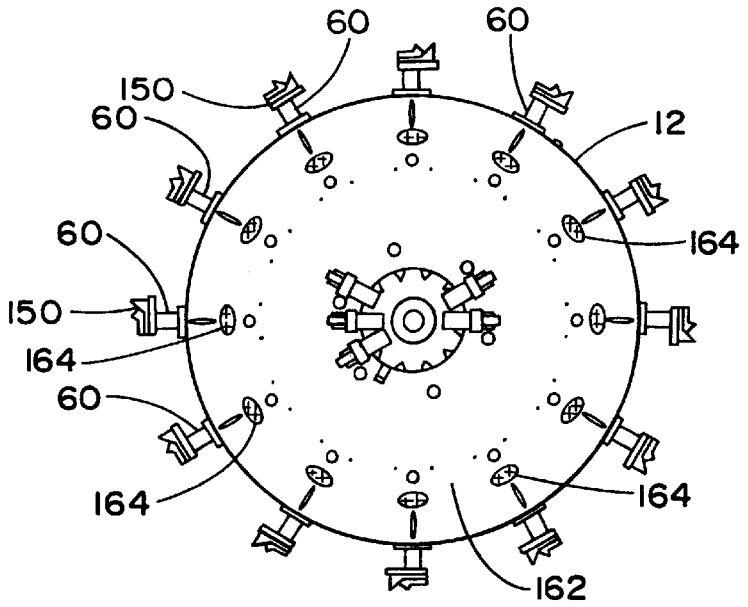
FIG. 7 illustrates a bottom view of the dial or turntable mounting the tool nests, showing vacuum ports for communicating the tool nests with vacuum-generating source means.
Figure 8:
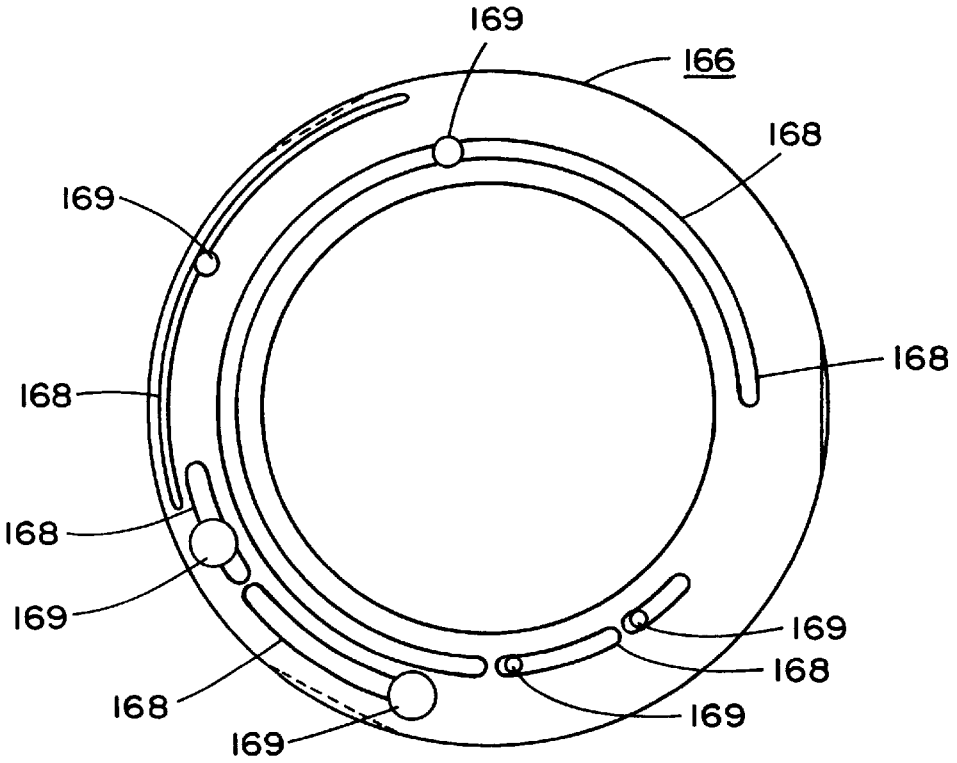
FIG. 8 illustrates a vacuum plenum for supplying the tool nests with controlled vacuum conditions.

The vacuum passageways extend through the lower surface 162 of the dial or turntable 12, as shown in FIG. 7, which includes a plurality of apertures 164 each communicating with, respectively, passageways leading to an associated tool nest 60. The vacuum is supplied to the apertures 164 in a selective controlled mode through the intermediary of a stationary vacuum plenum 166 arranged below the dial 12, as shown in FIG. 2 of the drawings. The plenum 166, as shown in FIG. 8, includes outlet slots 168 and ports 169 for applying or closing a vacuum to respective tool nests 60 in accordance with the rotational positions of the dial 12 with the aperture or ports 164 in the lower surface 162 being in communication with the vacuum plenum outlet slots or ports.

Reverting now to the aspect of the invention which is particularly concerned with the package tray feeding installation, in essence, at workstation 70 (1), wherein empty suture package trays or bases are applied onto the tool nests 60 of the automated packaging machine 10, reference may be specifically had to FIGS. 9 through 14 of the drawings.

Figure 9:
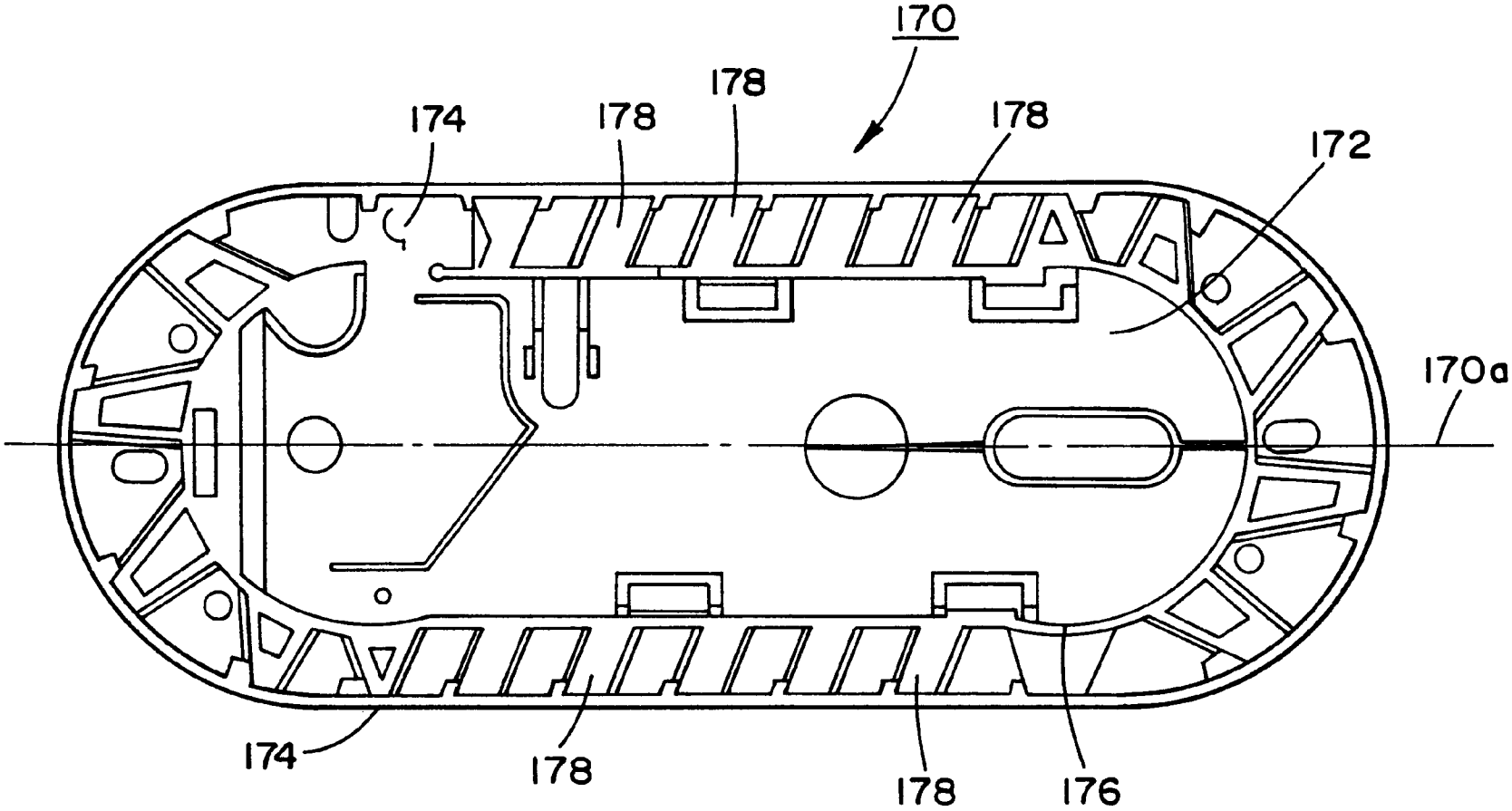
FIG. 9 illustrates a packaging tray for the packaging of an individual surgical needle and attached suture.

The suture package tray 170, as shown in FIG. 9 of the drawings, is essentially constituted of molded plastic material, and includes a planar base 172 with parallel sides and semi-circular rounded ends. A vertical wall 174 extends about the perimeter of the tray, while inwardly spaced thereof is a second vertical wall 176 having radially outwardly extending fingers 178 which are flexible at the upper edge reaching close to the outer wall 174 so as to define a hollow channel structure. Apertures and surgical needle engaging structure is molded into the tray, as more specifically disclosed in copending U.S. patent application Ser. No. 08/521,978; filed Aug. 31, 1995, the disclosure of which is incorporated herein by reference, and which is commonly assigned to the assignee of this application.

Figure 14:
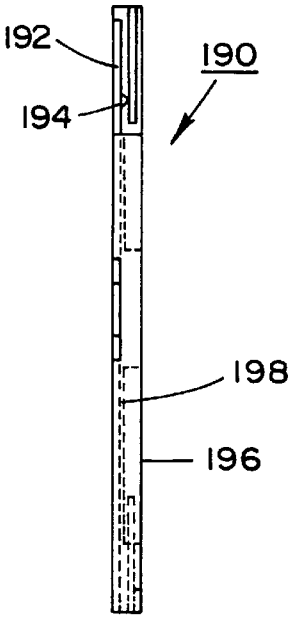
FIGS. 13 and 14 illustrate, respectively, plan and side views, shown partly in section, of the rotatable plate member for separating trays from the carousel of FIG. 12.
Figure 13:
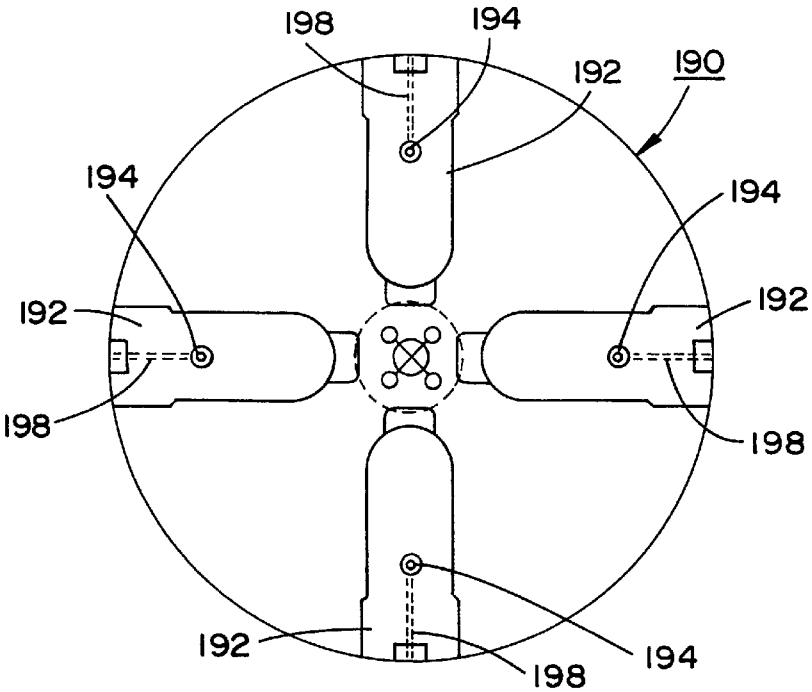

In essence, arranged adjacent the rotary dial or turntable 12, the latter of which is supported on the vertically adjustable frame arrangement 17, as shown in FIGS. 2 and 3, and which dial 12 mounts twelve tool nests 60 in uniform circumferentially spaced relationship, so as to enable the rapid provision of successive tool nests 60 with trays 170 having a shape as shown in FIG. 9; is the tray-loading installation 180. The installation, which is also supported on the adjustable frame structure 17, includes the rotatable carousel 72 which has eight (8) vertical chutes 182 arranged in an adjoining spoke-like annular array about a vertical control shaft 184. Each chute 182 is adapted to hold a vertical stack of superimposed empty package trays 170, as shown in the drawings. The carousel 72 is adapted to be rotatably indexed about shaft 184 through the intermediary of a suitable drive mechanism 186 whereby one of the chutes at any one time, which is filled with a stack of the trays 170, is adapted to have the open bottom end thereof located in close proximity above-the upper surface 188 of a circular or disc-like plate 190. The plate 190 is arranged beneath the lower end of the carousel 72 with a surface portion thereof extending below the bottom end of the chute 182 of the carousel which is most closely adjacent thereto. The circular rotary plate 190, as shown in FIGS. 13 and 14 has four radially extending depressions or recesses 192, each being of a depth essentially corresponding to the height of the vertical wall 174 and peripheral shape of the package tray 170, and with each recess 192 being at a 90° angular spacing relative to an adjacent recess. Each recess 192 has an aperture 194 in its bottom surface 196 communicating with a passageway 198 leading to a controllable vacuum generating arrangement within the packaging machine 10.

Between the chute 182 and the disc-like plate 190 is a single multi-tray buffer area 193*a*. After a chute 182 is empty, the buffer area 193*a* allows time for the next chute 182 of the rotatable carousel 72 to be indexed into position without stopping the machine. Therefore, trays 170 can be continuously fed into the disc-like plate 190 without interrupting the packaging process from the tray 170 stack in the buffer area 193*a*.

When one of the recesses 192 of the rotary plate 190 is in alignment with the bottom of a superimposed tray-containing chute 182 of the carousel 72, a bottommost tray 170 in the buffer area is sliced off or separated from the remaining buffer stack of trays and deposited in the recess 194 located therebeneath under the effect of a vacuum which is applied to the bottom surface 196 of the recess 194.

Figure 10:
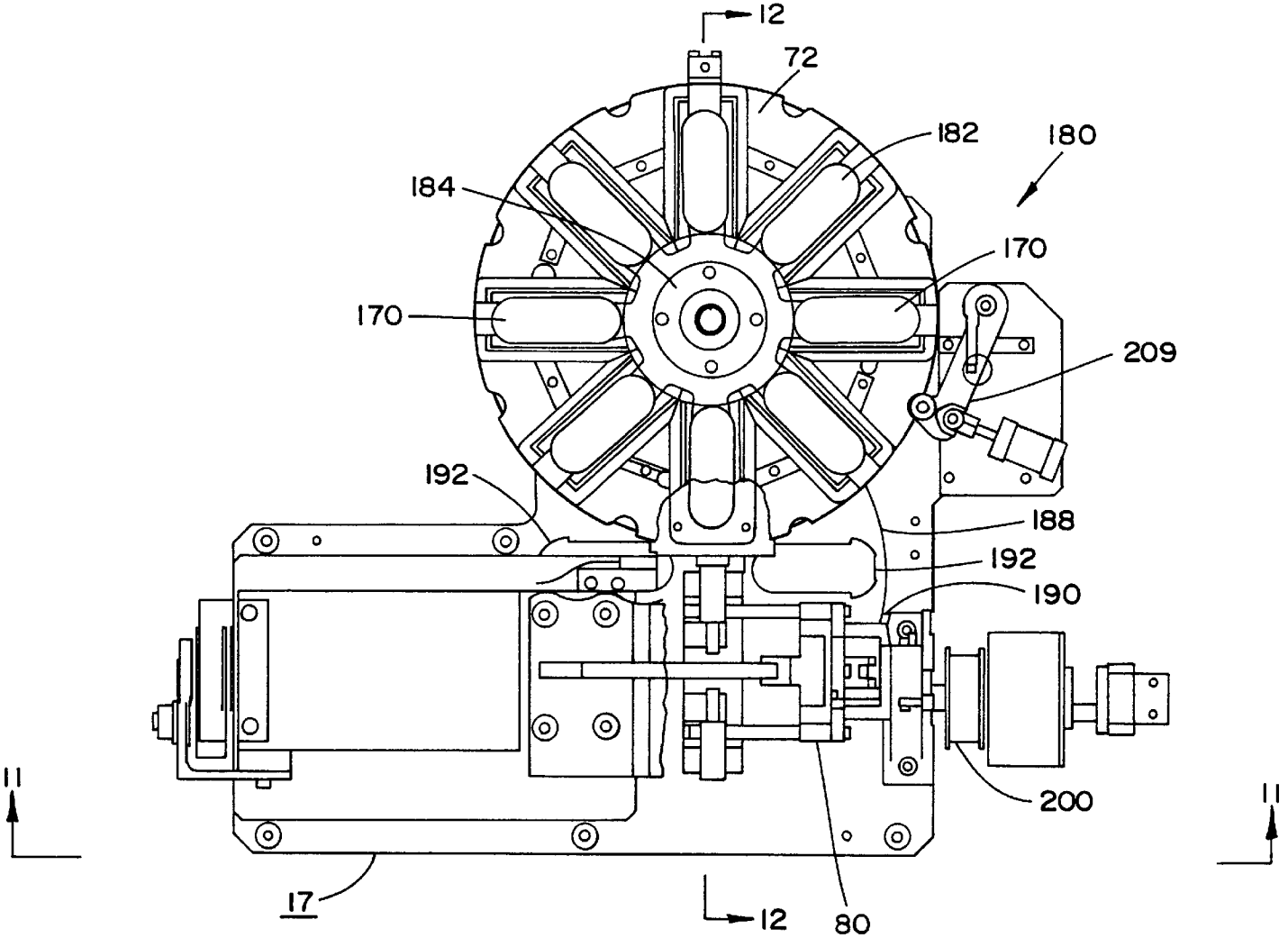
FIG. 10 illustrates a top plan view of the carousel and robotic pivot-arm arrangement of the tray loading and feeding workstation of the packaging machine.
Figure 11:
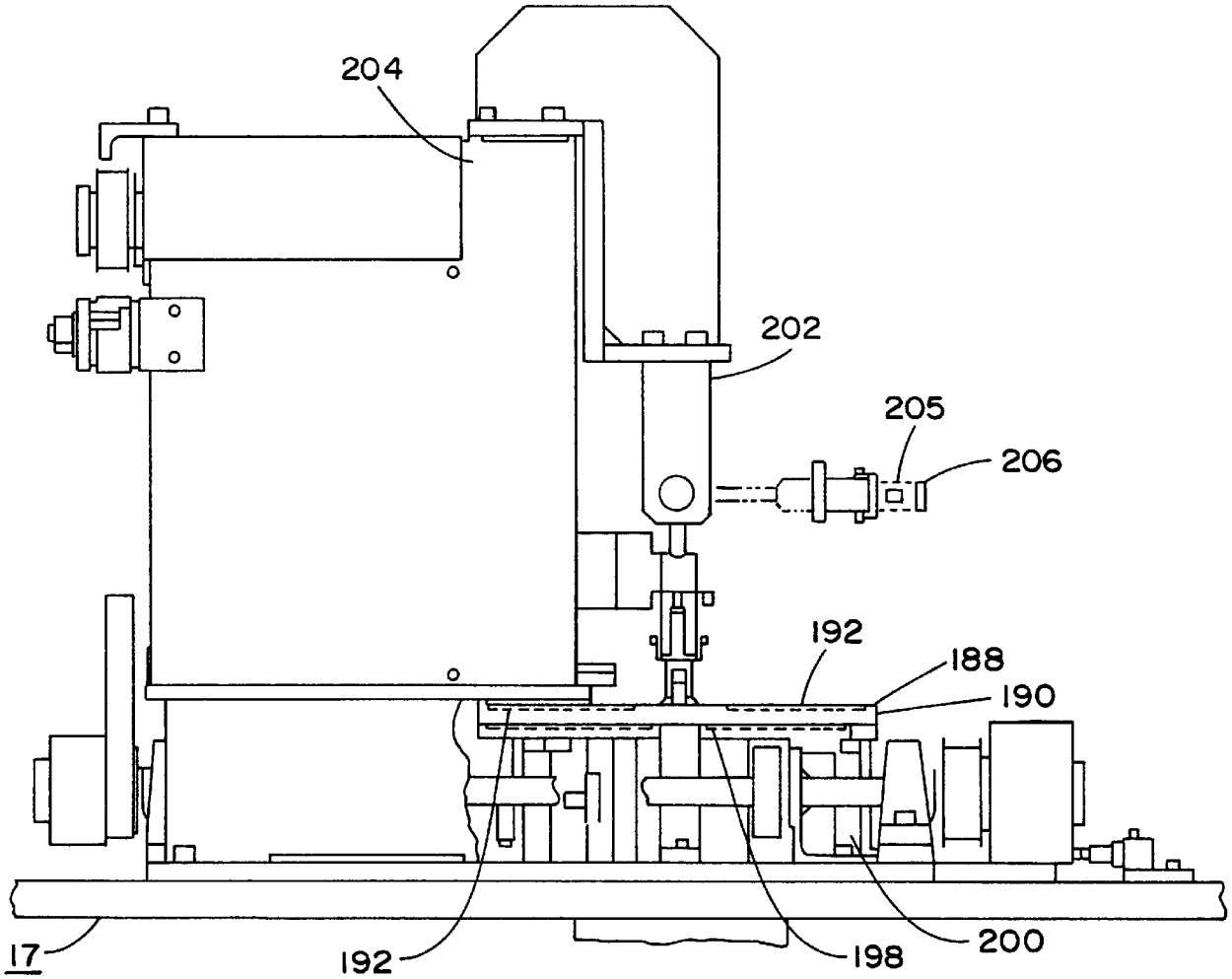
FIG. 11 illustrates an elevational side view taken along line 11—11 in FIG. 10.
Figure 12:
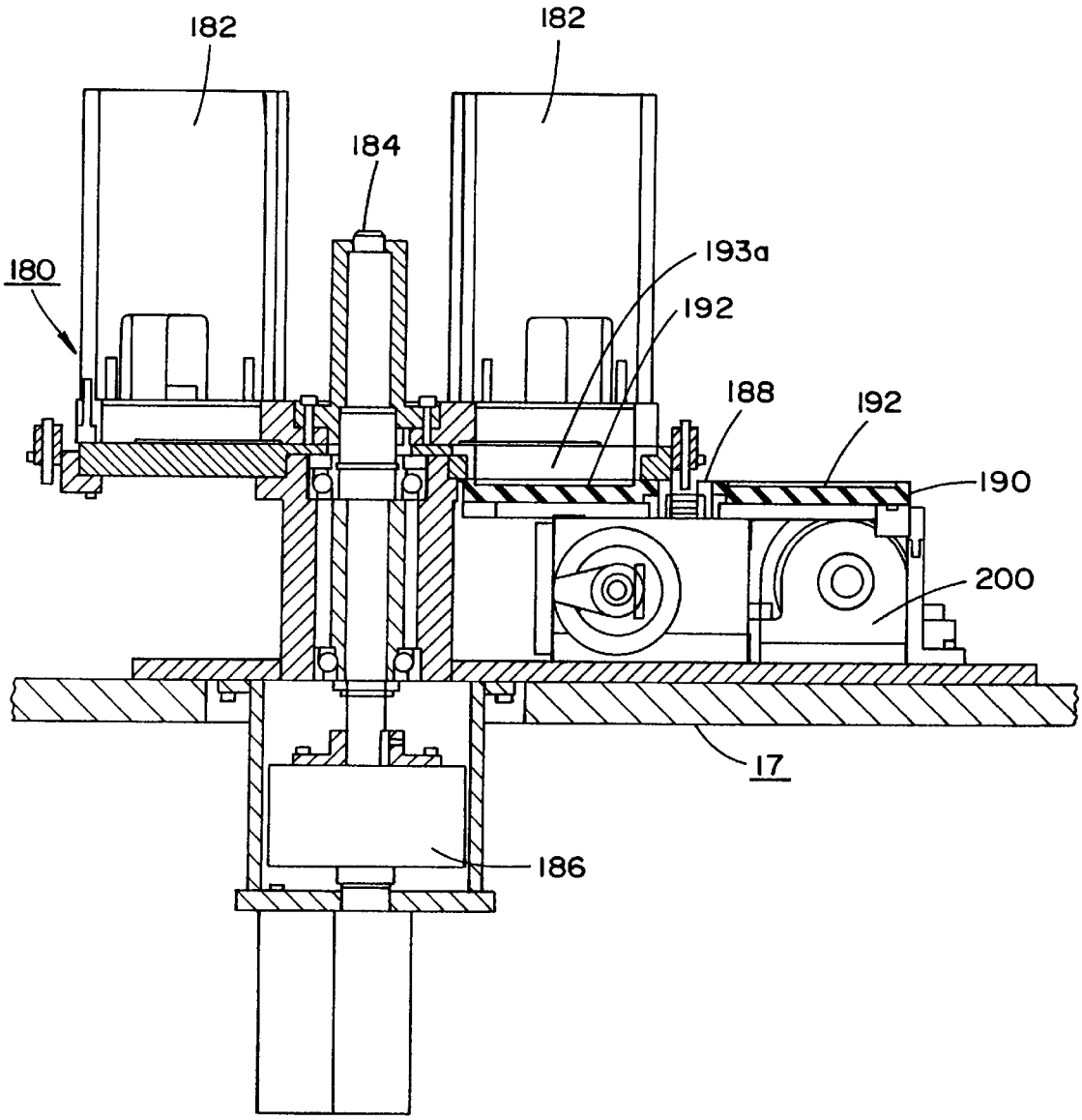
FIG. 12 illustrates, on an enlarged scale, a sectional view taken along line 12—12 in FIG. 10.
Figure 18:
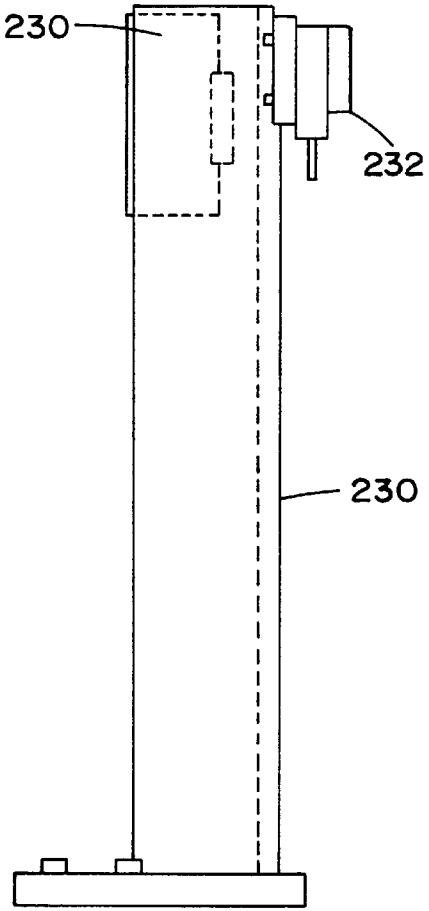
FIG. 18 illustrates sensor-mounting structure for detecting and verifying the presence of a tray on a tool nest.

As the plate 190 is rotatably indexed forwardly by means of a drive unit 200, each successive recess 192 has a successive bottommost tray 170 deposited therein from the buffer stack of trays 170 in the buffer area 193*a*. As the plate 190 continues its indexed rotation, a robotic or cam-controlled pivot arm 202 mounted in housing structure 204, as shown in FIGS. 10 and 11, has gripper elements 204 located at a forward end 206 depending downwardly so as to contact the tray 170 located in recess 192 on plate 190. The vacuum is released in the recess 192, and the gripper elements 204 are actuated to grasp the tray 170. The pivot arm 202 is then pivoted upwardly into a horizontal orientation, as shown in FIG. 11, and then extended forwardly along arrow C to cause the bottom surface of the tray 170 carried thereon to come into contact with the tray-receiving surface on the vertical plate element 150 of a therewith aligned tool nest 60 on the rotary turntable 12.

Thereupon, the pivot arm 202 has the vacuum released from elements 204, while a vacuum is applied to plate element 150 to resultingly cause the tray 170 to be assumed and retained thereon. The pivot arm 202 is then retracted and pivoted downwardly, as shown in FIG. 11, so as to engage a successive tray 170 positioned in the next recess 192 in the plate 190, and thereafter, in synchronism with the forwardly indexed rotation of the turntable 12 in a direction of arrow A, repeat the foregoing cycle of positioning trays 170 on the plate elements 150 of successive tool nests 60 coming into operative alignment with the robotic pivot arm structure 202.

As the chute 182 of the carousel 72 which is located above plate 190 empties of trays 170, upon the last remaining tray 170 of the stack of trays in that chute 182 being transferred to the rotary plate 190, the carousel 72 is rotatably indexed forwardly by an indexing mechanism 210 to the next or adjacent tray-filled chute 182, so as to now have that tray-filled chute 182 arranged in superposed alignment with the rotary plate 190 and to enable the uninterrupted continuing supplying of empty trays 170 to the recesses 192 in rotary plate 190, and thereafter through the intermediary of the repetitive cycles of operation of robotic pivot arm member 202 to the tool nests 60 on the turntable 12 of the automated packaging machine 10. The empty chutes 182 on the carousel 72 may be manually refilled with new stacks of package trays 170, as required.

Thereafter, the tool nest 60 with the tray 170 retained under a vacuum on the radially outwardly facing surface the plate element 150, which is at a generally horizontal orientation of the longitudinal axis 170*a* of the tray 170 defined by the walls 174, with the vacuum being generated installation through vacuum plenum 166 communicating with plate element 150 through the dial 12 and housing 140, is then advanced to workstation 80 at (2) through the indexed advance of the turntable 12 (a rotation of 30° in the direction of arrow A).

Figure 15:
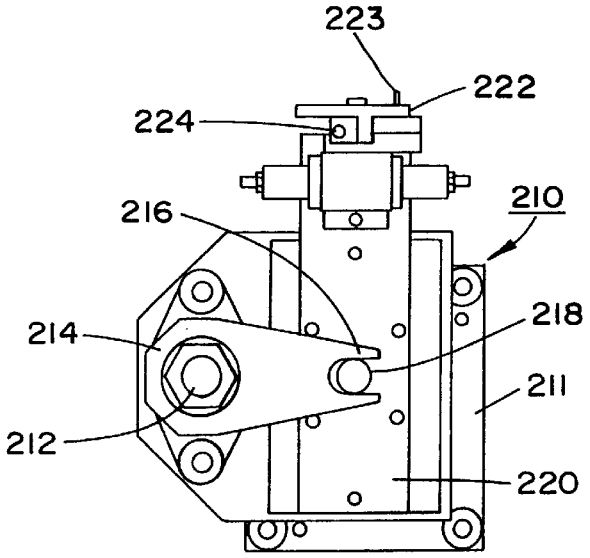
FIGS. 15, 16 and 17 illustrate, respectively, plan, end and side views of an apparatus for imparting an angular displacement or tilted orientation to trays supported on the tool nests.
Figure 17:
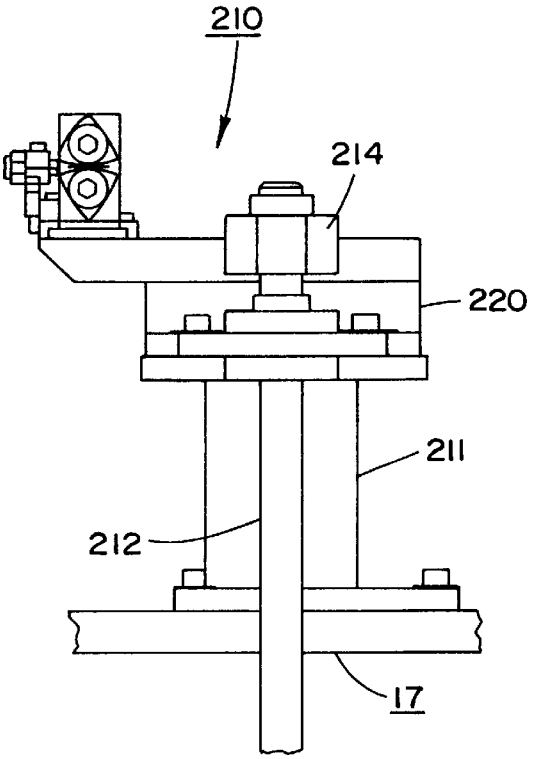
Figure 16:
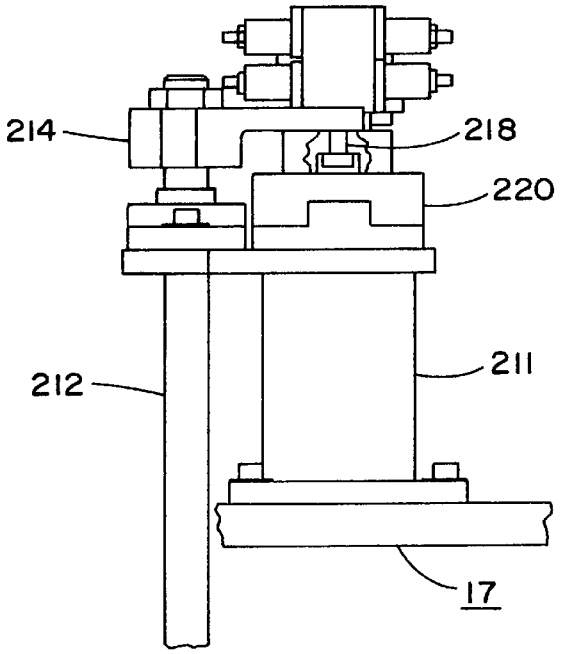

An apparatus 210 at this workstation (2), as shown in FIGS. 15 through 17, which is intended to impart a tilt to the tray 170 about its axis 170*a*, includes bracket structure 212 mounted on the frame 17 of machine 10. A vertical pivot shaft 212 has the lower end thereof connected to a device for oscillating the shaft about its vertical axis. The upper end of shaft 212 connects to a lever arm 214 having a bifurcated distal end 216 which engages a trunnion or pin 218 fixed mounted on a reciprocably slidable element 220 supported on the bracket 212. The forward end 222 of element 220 which is located proximate to a therewith aligned tool nest 60 which has a tray 170 positioned on plate element 150, includes protruding structure 222 for engagingly contacting the tray 170 and plate element 150 when the element 220 is advanced towards the tool nest 60.

A cooperating arm elements 224 is adapted to be activated so as to impart a counterclockwise rotation to the tray 170 and plate element 150 within the vertical plane thereof about the axis of the shaft 144 in the tool nest mounting the plate element 150. The tray 170 is angled or tilted counterclockwise (facing the front thereof) relative to the initially horizontally oriented longitudinal axis 170*a* through an angle of about 16.5°, so as to be in a ready position for the insertion therein of an armed suture; i.e. a surgical needle and attached suture at a subsequent workstation.

In order to be able to effectuate the rotational movement or tilted displacement of the tray 170, an air-operated motor in housing 140 is activated so as to cause shaft 144 to retract radially into contact with a cam 230 of a stationary cam structure 146 on dial or turntable 12. This releases shaft 144 for rotation by disengaging latching pins 282 at the radially inward end of housing 140 until the plate element 150 and tray 170 are tilted by shaft 144 as required, i.e. 16.5° relative to the horizontal. The air motor 116 then deactivates and causes the shaft 144 to slide axially forwardly, allowing the pins 232 to engage, and locking the plate element 150 and tray 170 into the tilted position.

Thereafter, upon the tool nest 60 having the element 150 with the tilted tray 170 therein being advanced forwardly through the indexed rotation of the turntable 12, to workstation 84 at (3), an upright support stationary structure 230 includes at its upper end a bracket 230 supporting a sensor 232 for detecting and verifying the presence of a tray 170 on the plate element 150 of the tool nest 60; for instance, by scanning a spot which may be formed at a specific location on the surface of tray 170. The tray 170 is now in readiness to have a needle and attached suture inserted therein at subsequent workstation 90 (4); as described in detail in copending application Ser. No. 09/020,081; filed Feb. 6, 1998.

Figure 23:
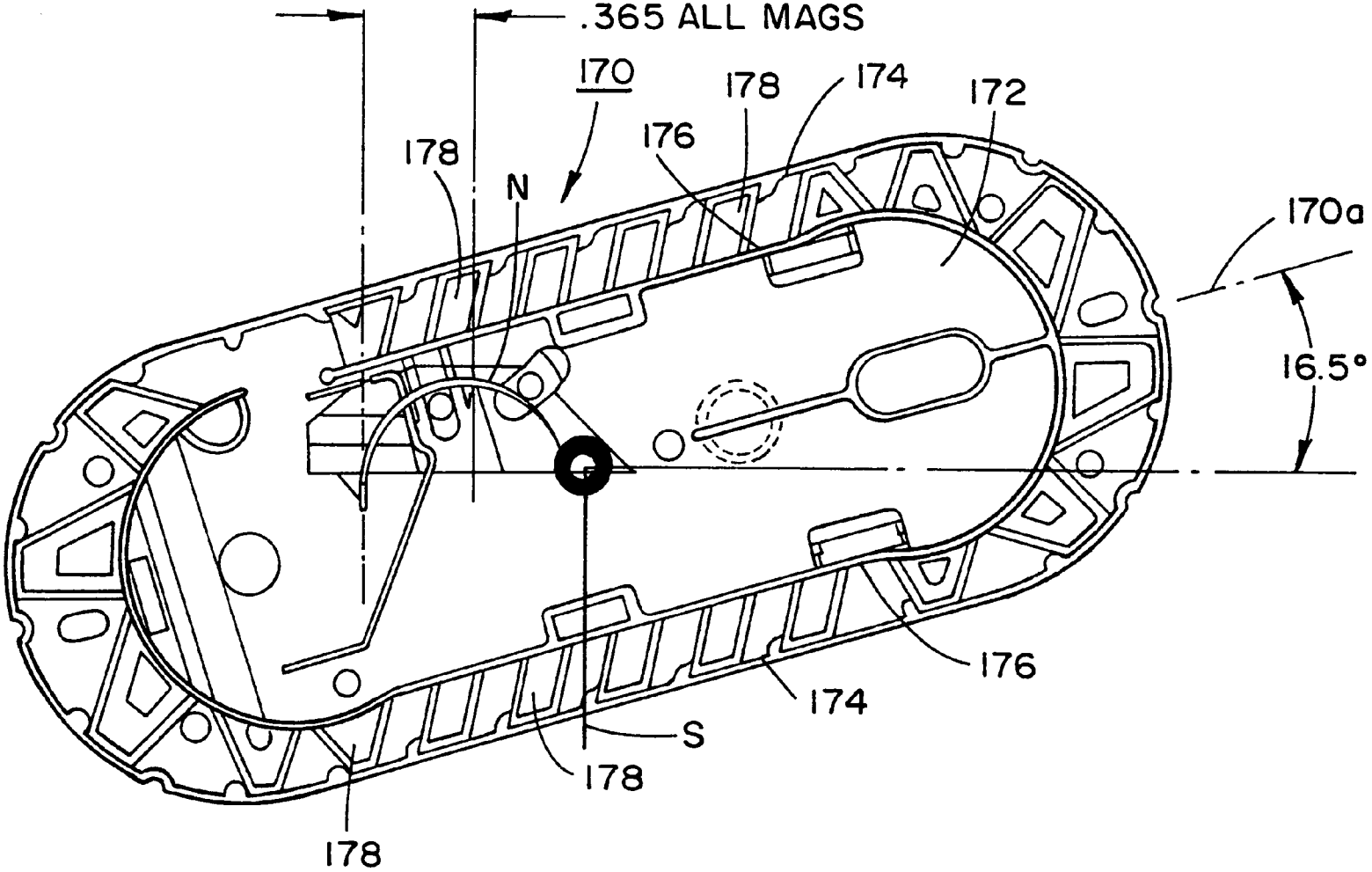
FIG. 23 illustrates a front view of the packaging tray of FIG. 9 with the needle end attached suture being introduced thereby by the needle gripper structure.

With respect to the particular inventive aspect which is directed to the insertion or transferring of a single surgical needle and attached suture into a respective individual packaging tray 170 at workstation 90 (4), in this particular instance, the packaging tray is illustrated in FIG. 23 of the drawings.

The packaging tray 170 has been previously pivoted so as to be oriented at an angle of about 16.5° counterclockwise relative to a horizontal axis for the tray. As the tilted tray 170 is supported on plate member 150 of tool nest 60 at workstation 90, a needle transfer arrangement 300, illustrated generally diagrammatically in FIGS. 19 through 25*f* of the drawings, transfers the surgical needle, as shown, into the tray 170 so as to be "parked" or clamped therein through needle-engaging structure in predetermined position as represented in the drawing.

Figure 19:
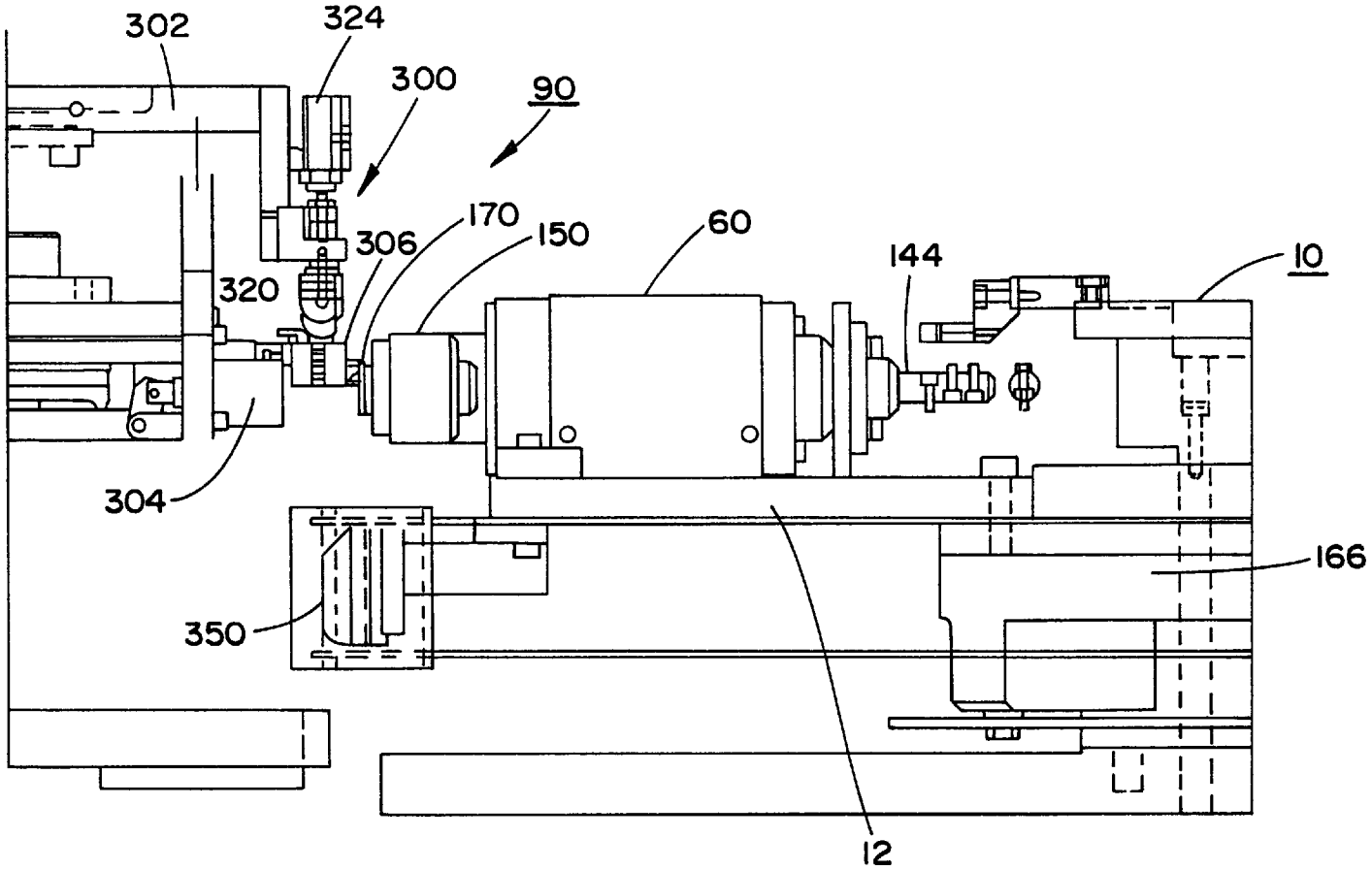
FIG. 19 illustrates a partial side view of the turntable with a tool nest located proximate the needle transferring mechanism pursuant to the invention.

As shown in FIG. 19, at this workstation 90, the tool nest 60 with the initially empty but tilted packaging tray 170 is indexed opposite needle transfer arrangement 300. The needle transfer arrangement 300 may be a constituent of a swage dial device 302 which includes a rotary member 304 having needle gripper structure 306 formed at the radially outer end thereof. The needle gripper structure 306 is adapted to receive a surgical needle "N" and attached suture "S" from a swaging mechanism (not shown) which attaches or swages one end of a suture to a surgical needle. A swaging apparatus of that type may be readily ascertained from the disclosure of copending patent application Ser. No. 09/020,085; filed Feb. 6, 1998, the disclosure of which is incorporated herein by reference.

The needle gripper structure 306 may be a multi-axis gripper having fixed and movable pivot points 308 and 310 arranged in gripper housing 312. As shown in FIG. 21, the surgical needle "N" is clampingly engaged by pivot points 308 and 310 and also against bearing surface 314 while being transferred into a packaging tray 170, as shown by the left position in FIG. 20.

Figure 20:
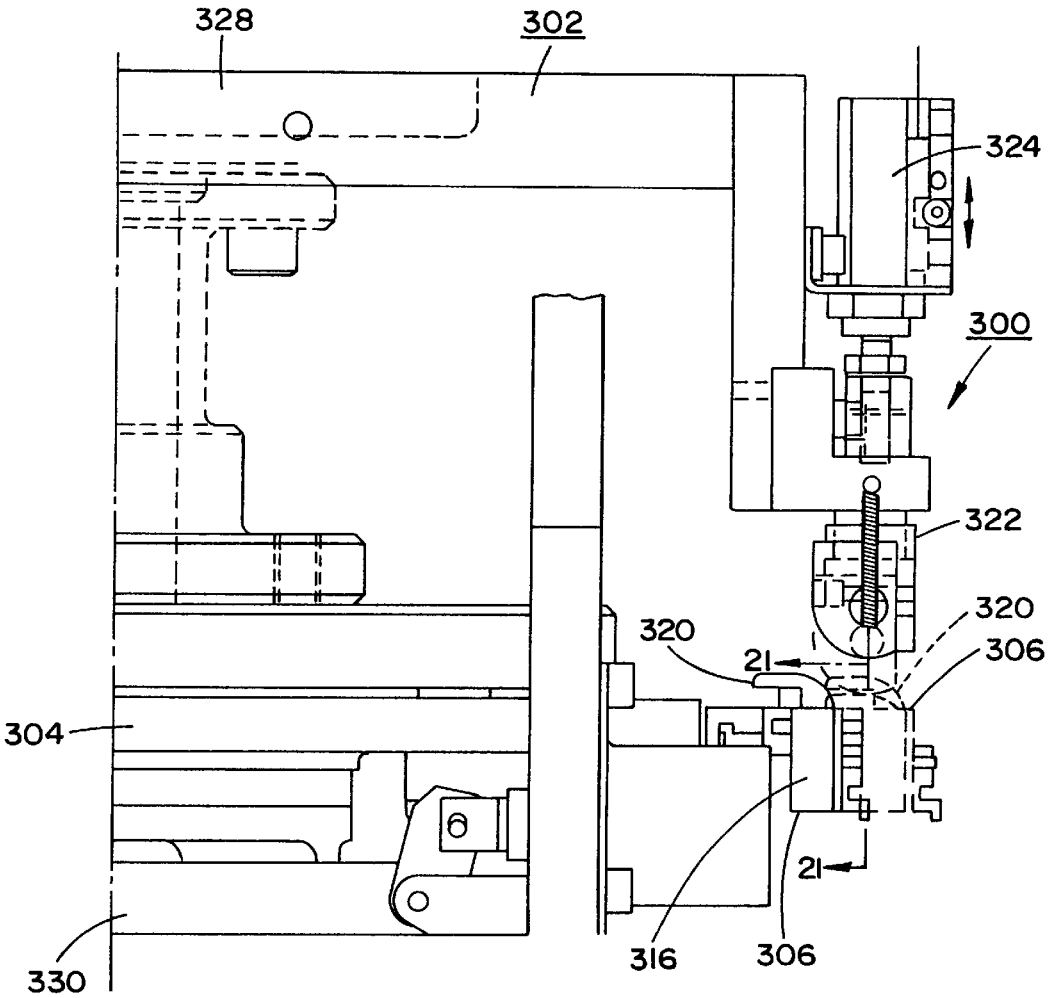
FIG. 20 illustrates the needle transfer mechanism portion of FIG. 19, shown diagrammatically on an enlarged scale.
Figure 22:
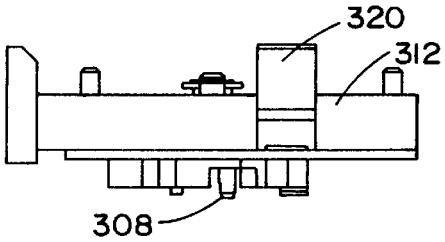
FIG. 22 illustrates a top plan view of the needle gripper structure.
Figure 21:
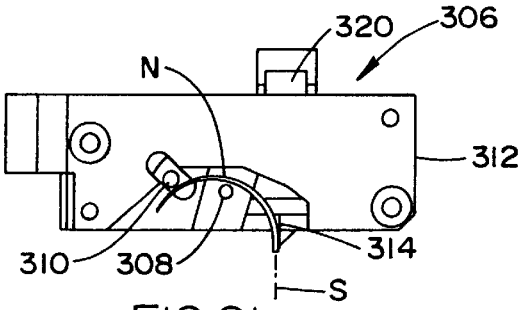
FIG. 21 illustrates a front view of the needle gripper structure, shown along line 21—21 in FIG. 20.

In order for the surgical needle "N" to be transferred into packaging tray 170, as shown in FIG. 23, the needle gripper structure 306 by means of offset slide device 316 is extended towards the right, as shown in phantom-lines representation in FIG. 20. This causes the surgical needle to engage clamping or "parking" structure formed in packaging tray 170. Release of the needle gripper structure 306 while in the right phantom-illustrated location is effected by a plunger 320 shifting the pivot point locations relative to each other. This sequence is carried out by a ram element 322 which is pushed downwardly by a hydraulic piston 324 so as to depress the plunger 320. The needle gripper structure 306, having resultingly released the surgical needle, is then retracted away from the packaging tray, and the pressure of hydraulic piston now relieved so as to cause a tension spring 326 to pull the ram element 322 upward. The entire arrangement may be fastened to frame elements 328, 330 of the swage dial device 302. Thereafter, the swage dial is rotated to bring a successive gripper structure 306 and surgical needle "N" with attached suture "S" into position opposite a following tool nest 60 mounting an empty packaging tray 170.

Figure 24C:
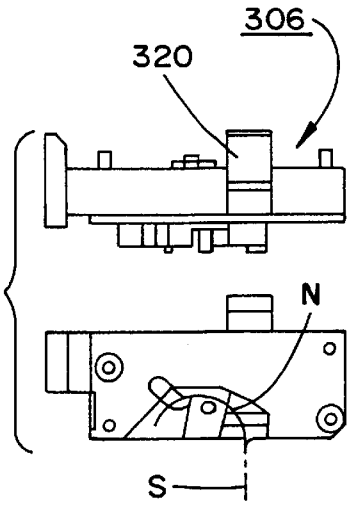
FIGS. 24*a* through 24*c* illustrate front views of differently configured needle grippers for transferring variously sized surgical needles.
Figure 24B:
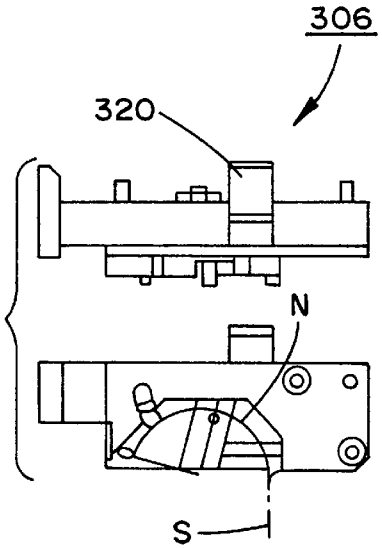
Figure 24A:
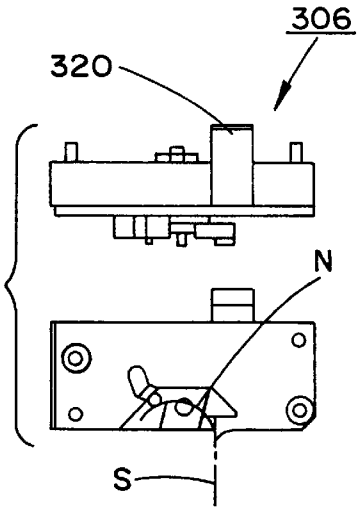
Figures 25A, 25B, 25C, 25D, 25E, 25F:
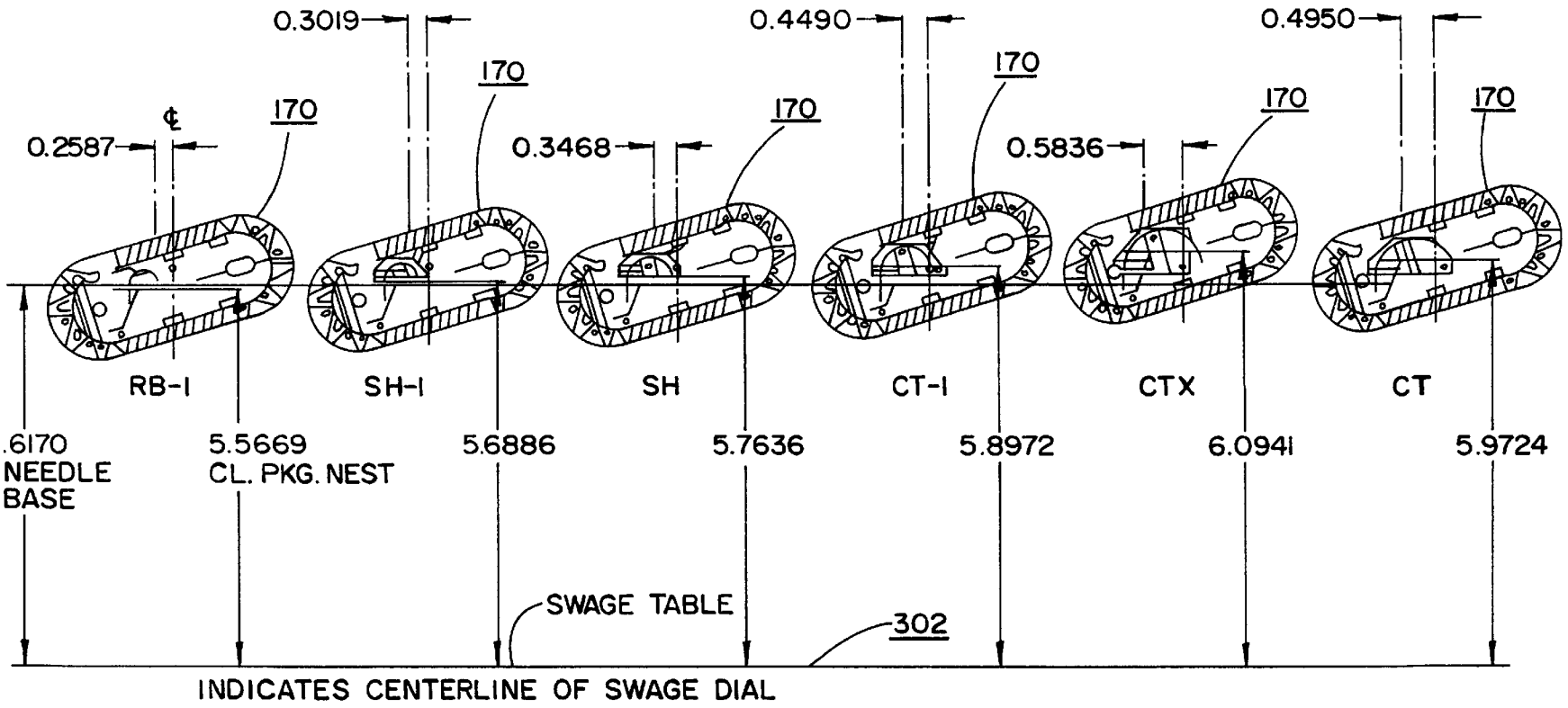
FIGS. 25*a* through 25*f* illustrate the positioning values in adjusting the packaging machine for differently sized surgical needles by the needle grippers of FIGS. 21 and 24*a* through 24*c;*

Referring to FIGS. 24*a*, 24*b* and 24*c* of the drawings, the needle gripper structure 306 of the needle transfer device or arrangement 300 may be simply interchanged with other similar structures which are modified with respect to the pivot points 308, 310 and related aspects so as to be able to accommodate differently sized and/or curved surgical needles, while the remaining structure is maintained.

As illustrated in the drawing FIGS. 25*a* through 25*f* differently sized surgical needles, identified by symbols RB-1, SH-1, SH, CT-1, CTX and CT by way of example, may be introduced into basically identical packaging trays 170, and which also indicates the different adjustments of the packaging machine 10 above a fixed reference line of the swage dial apparatus 302 and a swage table (not shown) from which the surgical needles and attached sutures are transferred by the gripper structure 306 to the tray 170 mounted on tool nest 60 of the packaging machine 10.

In order to adapt the packaging machine 10 to the differently sized surgical needles which are to be packaged in essentially identically-sized packaging trays 170, the latter of which may accommodate a wide range of needle sizes without having to have the suture package modified, the turntable 12 and the tool nests 60 which are mounted thereon, including the various workstation components, are adapted to be adjustable in elevation relative to the needle transfer devices or grippers 306 so as to compensate for changes in needle size, without having to modify the functioning of the packaging machine 10 or the need to replace any of the structural components of the machine at the various workstations.

As indicated in the drawing FIGS. 2 and 3, the machine frame 14 includes the stationary frame portion 15, which is essentially immovably supported on a suitable level support surface or floor. Arranged within the stationary support arrangement of the frame portion 15 for the machine 10 is the frame portion 17 which is movable relative to stationary frame portion 15, and is adapted to be vertically adjusted through the intermediary of the servo motor actuated jack screw unit 38 which is connected to turntable 12, and enables the height of the latter to be adjusted in correlation with the particular size of surgical needle which is to be transferred into the tray 170.

The elevational adjustability of the movable frame 17 and, resultingly, that of the turntable 12 and tool nests 60 may be preprogrammed or otherwise determined and controlled by the operating personnel for the machine 10. This ability to vertically adjust the movable frame 17, and thereby the operating height of the turntable 12 and tool nests 60 which are mounted thereon, imparts a versatility to the machine which renders it readily applicable to the packaging of a wide range of surgical needle sizes.

As may be ascertained from FIGS. 27 to 30 of the drawings, vacuum-controlled clamping structure 350, of which a separate one is mounted on the lower surface of the turntable 12 below each respective tool nest 60, clampingly engages and captures the portion of suture "S" depending outwardly and downwardly from the tray 170 in which there has been parked a surgical needle "N", as shown in FIG. 23, to which the suture is attached, and is able to maintain a predetermined controlled gripping action on the suture in cooperation with a suture tensioning arrangement, as described in more specific detail in copending application Ser. No. 09/019,674; filed Feb. 6, 1998, the disclosure of which is incorporated herein by reference.

With respect to the features of the packaging machine 10 which are directed to a provision of arrangements 360 for capturing and tensioning the portion of the suture "S" which depends outwardly of a packaging tray 170 during the cycle portion of machine operation in which the surgical needle and attached suture is transferred into and parked in a tray at needle feed or transfer workstation 90 (4) and until completion of the winding of the entire length of suture into the confines of the packaging tray, appropriate controlled tension must be maintained on the outwardly depending suture portion in order to avoid any snagging thereof which would inhibit or adversely affect the unobstructed winding of the suture into the channel structure formed in the tray 170 by spaced peripheral walls 174, 176.

As shown in FIG. 23 of the drawings, the packaging tray 170 has been pivoted counterclockwise on the tool nest 60 to be at an angle of 16.5° relative to the horizontal to facilitate insertion therein of the surgical needle "N", and remains at that angular orientation until the outwardly depending suture portion is begun to be wound into the packaging tray 170 at first winding workstation 98(6).

Figure 26:
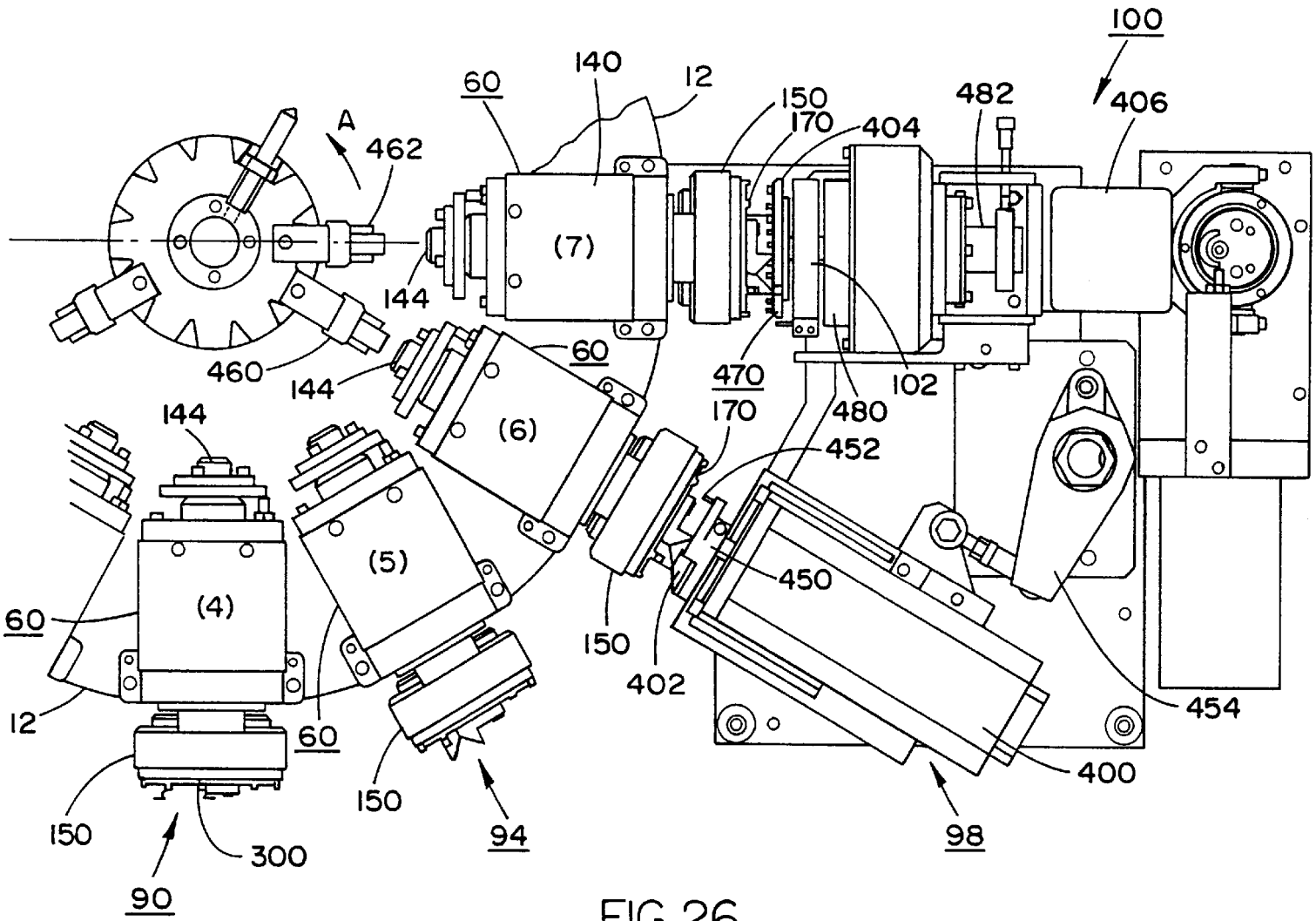
FIG. 26 illustrates a plan view of the workstations of the packaging machine at which the suture capturing and tensioning devices are in operative conditions.

Illustrated diagrammatically in FIG. 26 is a plan view of the workstations (4) through (7), between which there is effected the capture and tensioning of the suture portion extending outwardly from the packaging tray. At workstation (4), the surgical needle with attached suture has been transferred into the packaging tray 170 by the needle transfer apparatus 300 disclosed in copending application Ser. No. 09/020,081; filed Feb. 6, 1998, the disclosure of which is incorporated herein by reference.

As the turntable 12 and the packaging trays 170 on the tool nest plate members 150 are advanced in the direction of arrow A, so that the tray 170 is indexed past the sensor workstation 94 (5) at which it is inspected by a sensor 96 for the presence of a needle, and then indexed forwardly to winding stations (6) and (7), the suture capturing and tensioning system 360 is activated.

Figure 29:
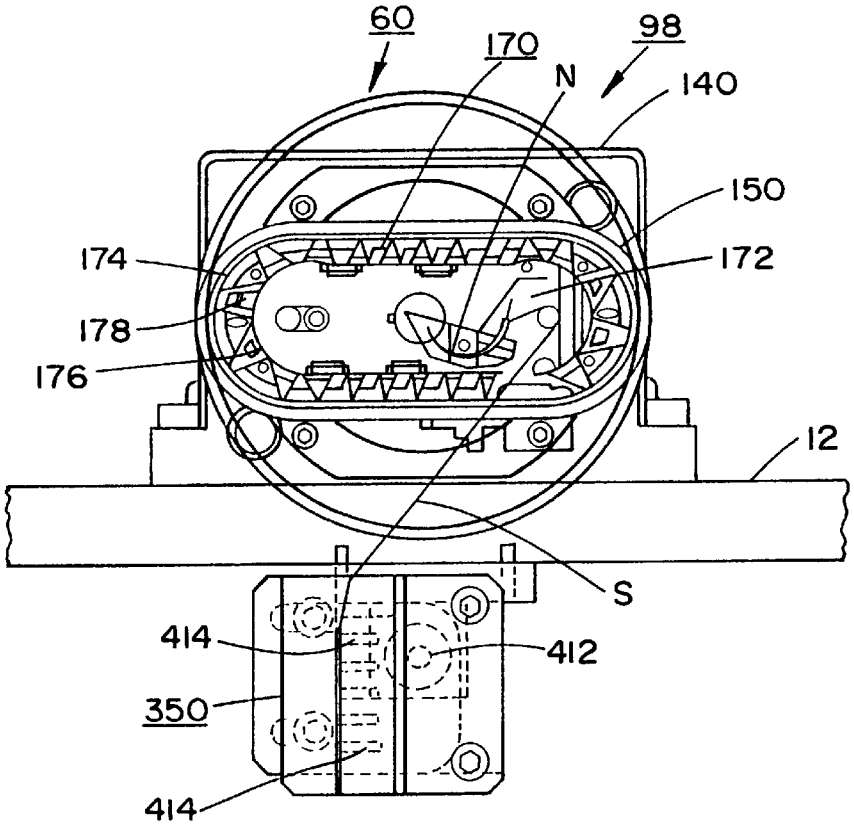
FIG. 29 illustrates a front view of a suture winding head of FIG. 27 with the suture clamp unit.

At the first winding workstation 98 (6) a slide element 400 of winding mechanism 96 is reciprocated so that a winding head 402 causes a pin to engage the plate member 150 on tool nest 60. A drive (not shown) then rotates the plate member 150 together with the packaging tray 170 thereon counterclockwise through 163.5° so as to assume an inverted horizontal orientation for the longitudinal tray axis, as shown in FIG. 29. Thereafter, at the second winding workstation 100 (7), a winding head 404 mounted on a rotatable winding unit 102 which is driven by a motor 406, causes the suture to be fully wound into the packaging tray 170. The winding stations (6) and (7) and the operative structures and detailed functions thereof are described in detail in copending application Ser. No. 09/020,191; filed Feb. 6, 1998 the disclosure of which is incorporated herein by reference.

Figure 30:
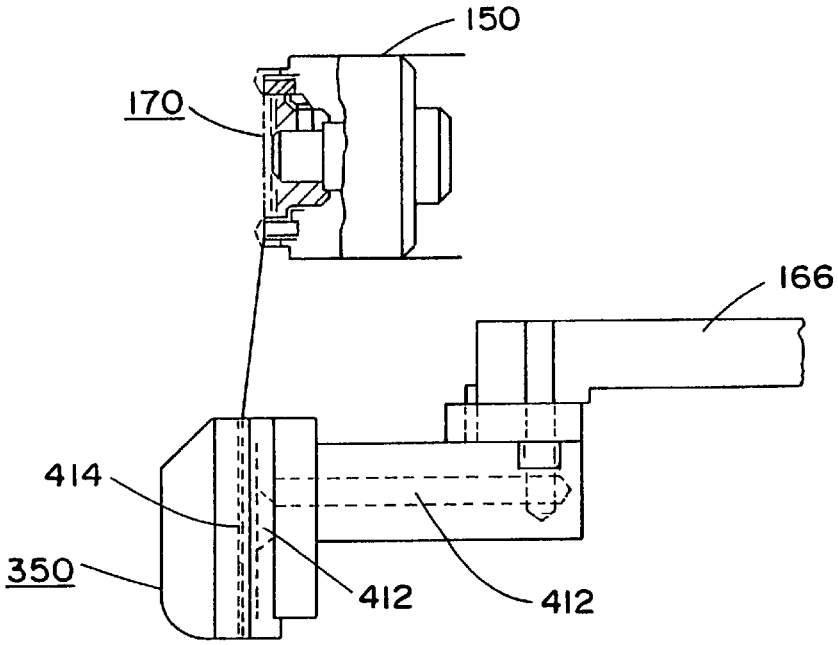
FIG. 30 illustrates a side view of the arrangement of FIG. 29.

Referring in particular to FIGS. 27 to 30 of the drawings, there is illustrated the vacuum-operated suture clamping unit 350, of which one each is mounted on the lower surface of turntable 12 beneath each respective tool nest 60 so as to extend below the plane of turntable 12. Each vacuum-operated suture clamping unit 350 is operatively connected through the vacuum plenum 166 with a vacuum-generating system 410 provided in the packaging machine 10 and may be supplied with a controlled vacuum through suitable vacuum ports 412 and passageways, as shown in FIG. 30 of the drawings, when a vacuum is intended to be supplied to sutures captured therein during predetermined operating intervals. In this instance, the clamping unit 350, which includes a plurality of vacuum nozzles or fingers 414 as illustrated in FIGS. 29 and 30, is rendered operative when a surgical needle is inserted into the packaging tray 170 at workstation (4), in effect, by the needle feed or transfer apparatus 300. The suture portion which extends outwardly and downwardly of the tray 170 from its end which is attached to the surgical needle which is parked in the tray, is captured by the vacuum-operated clamping unit 350 through the intermediary of vacuum nozzles 416 at a location which is below the therewith associated tool nest 60.

When the surgical needle has been inserted into the tray 170 and the suture portion depends outwardly and downwardly therefrom, as illustrated in FIG. 11 of the drawings, it extends through the clamping unit 350, as shown in FIG. 29, and extends downwardly through a further vacuum nozzle arrangement 418 for tensioning the suture portion, and into a further lower suture tensioning device (not shown) which is also vacuum-operated and tensions the trailing end of the suture portion. Upon the tool nest 60 and the tray 170 with the surgical needle and attached suture having been advanced to the winding station (6) for initially rotating the tray 170 at winding station (6), as shown in FIG. 29, and then advanced towards the second winding station 100 (7) for winding the entire remaining suture length into the confines of the tray 170, the vacuum in the nozzles 416 of clamping unit 350 is released, thereby permitting upward sliding movement therethrough of the outwardly extending suture portion towards the tray 170.

Figure 27:
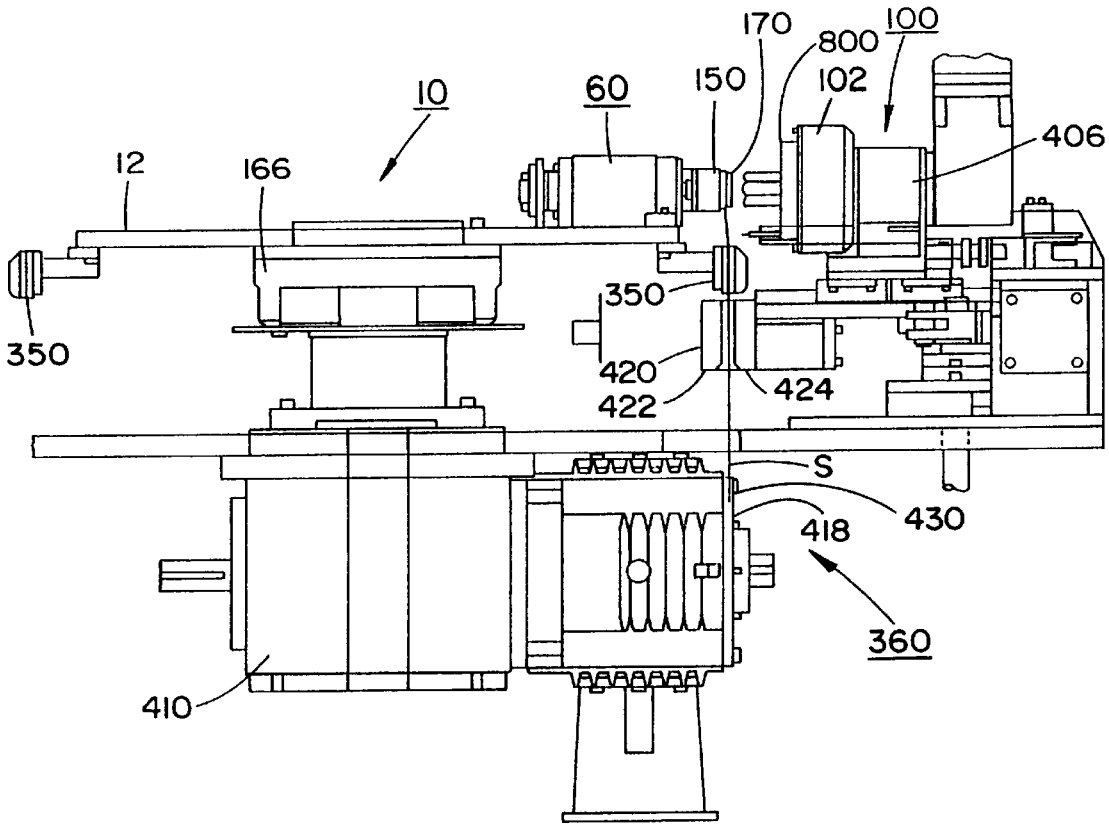
FIG. 27 illustrates a generally diagrammatic elevational view of the suture capturing and tensioning devices.
Figure 28:
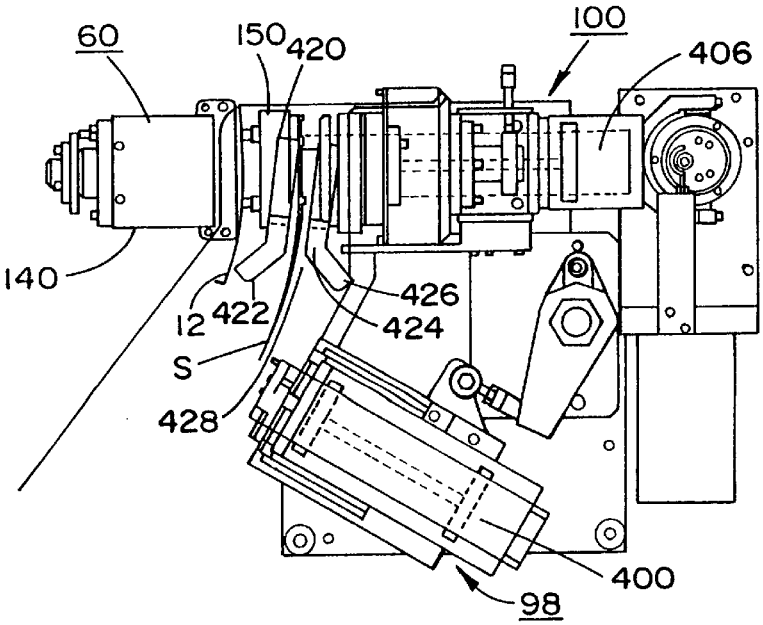
FIG. 28 illustrates a top plan view of suture winding arrangements.

Moreover, as shown in FIGS. 27 and 28, a guide arrangement 420 for the depending suture portion is provided at winding workstation 100 (7) below the clamping unit 350. The guide arrangement 420 may comprises a pair of plates 422, 424 having wing portions 426 forming a conveying passageway 428 through which the suture is guided towards the winding head.

However, the suture is maintained under tension in that the vacuum is applied by the plurality of vacuum nozzles or fingers 430 which are located below the vacuum clamping unit 350. Consequently, although tension is maintained on the suture through the application of a vacuum, the suture is still permitted to move relative to the workstation (4) at which the surgical needle has been inserted into the tray, and at the workstations (6) and (7) wherein the suture is adapted to be wound into the tray, as illustrated in copending application Ser. No. 09/020,191; filed Feb. 6, 1998, the disclosure of which is incorporated herein by reference.

From the foregoing, it becomes readily apparent that the utilization of the vacuum-operated units 350 for capturing and the vacuum nozzle or finger devices for tensioning the suture portion which depends outwardly of the tray 170 when the latter has the surgical needle and attached suture end portion positioned therein, clearly facilitates the winding of the suture at subsequent workstations into the package tray while maintaining vacuum-generated control and tension on the suture, thus avoiding any snagging of the suture while being advanced and then wound into the tray.

(5) At this workstation 94, a stationary sensor 95 located radially outwardly of the turntable may be utilized to ascertain the presence of the surgical needle and attached suture having been properly introduced into the tray 170.

At the first winding workstation 98 (6) in the direction of rotation of the turntable 12 along arrow A downstream of the needle transfer workstation 90 (4) where a surgical needle and attached suture were introduced into the package tray 170 by the needle transfer mechanism 300, operating structure 96 as detailed hereinbelow, imparts a pivoting displacement to the packaging tray 170. Concurrently, vacuum-operated clamping unit 350 capturing the suture and vacuum nozzles 430 for tensioning the portion or length of the suture depending outwardly of tray 170 maintain their function, as described in copending application Ser. No. 09/019,674; filed Feb. 6, 1998, the disclosure of which is incorporated herein by reference. In this connection, the vacuum-operated unit 350 engages the suture until the latter is to be fully wound into the package tray 170 while, concurrently, the plurality of vacuum nozzles 430 imparts tension to the suture so as to prevent the suture from snagging during the process of being wound into the package tray 170 at the second winding station 100(7).

At the first winding workstation 98 (6), a winder head 450 of the winding apparatus 96 includes pin structure 452 which upon advance of slide bracket or element 400 towards the tool nest 60, engages the support plate 150 on the tool nest 60 on which the packaging tray 170 is mounted, this advance being caused by a pivot arm element 454, and drive means (not shown) imparts rotation counterclockwise to the tray 170 through an angle of approximately 163.5°. This, in effect, inverts the longitudinal orientation of the package tray 170 about is axis 170*a* and of the needle "N" contained therein, while orienting the longitudinal tray axis horizontally as shown in FIG. 29, it previously having been imparted an angular counterclockwise tilt of about 16.5° at workstation (3) to facilitate the insertion into the tray 170 of the surgical needle and attached suture at the needle transfer workstation 90 (4). The apparatus for effecting the foregoing initial winding includes the rotatable winder head 450 which intermittently advances by means of slide bracket 400 which is activated by pivot arm element 454 through pin 452 into engagement with the tool nest 60 so as to be able to impart rotation to the tray 170, and then retracts after having rotated the tool nest plate member 150 and the package tray 170 mounted thereon through the above-mentioned angle of 163.5°. In this connection, the shaft 144 in the tool nest 60 has been released by the air motor in the tool nest housing 140 so as facilitate rotation thereof and axial movement into contact with a cam 460 mounted on turntable 12. This allows the plate member 150 to rotate with the winder head 450, and upon completion of rotation, the air motor in housing 140 of the tool nest 60 is deactivated so as to cause the shaft 144 to retract, and pins in the housing secure the plate member 150 in its rotated position.

Figure 31:
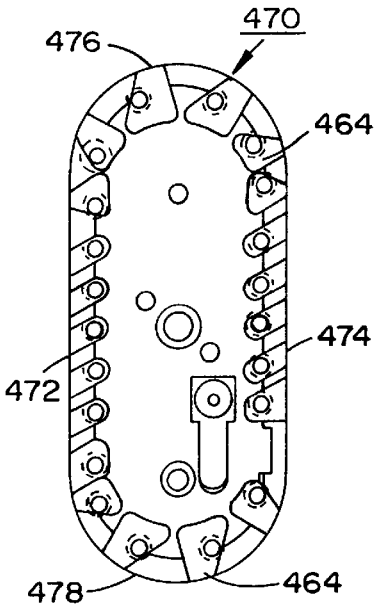
FIG. 31 illustrates a front view of a winding head for winding sutures into the packaging trays.
Figure 32:
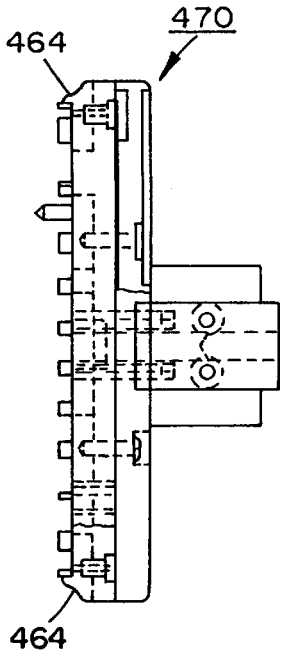
FIG. 32 illustrates a side view of the winding head of FIG. 31.
Figure 33:
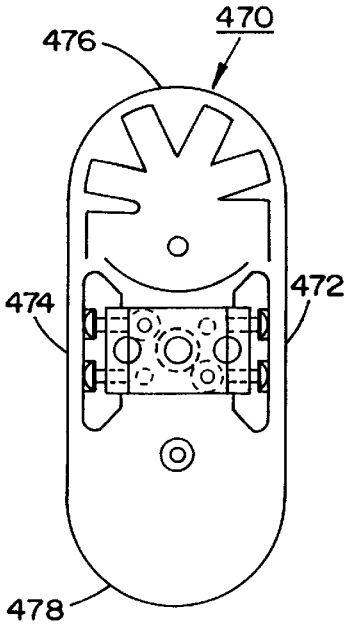
FIG. 33 illustrates a rear view of the winding head of FIG. 31.
Figure 34:
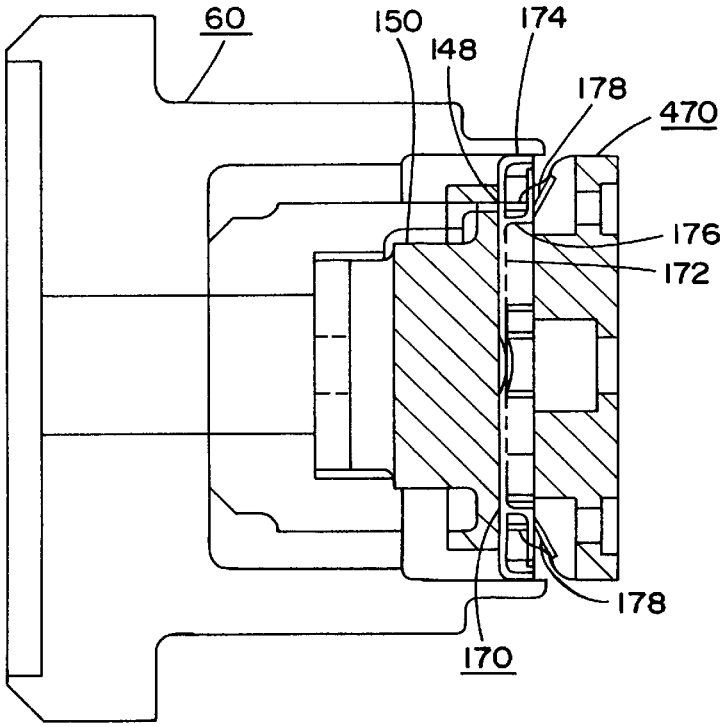
FIG. 34 illustrates, diagrammatically, the winding head of FIG. 31 in operative engagement with a packaging tray for winding a suture into the tray.

The invertedly oriented package tray 170, as shown in FIG. 29, is advanced by turntable 12 to the second winding station 100 (7), with a portion of the suture still depending downwardly and being engaged by the vacuum clamping unit 350 and tensioned by the vacuum nozzles or fingers 430, and is guided between vacuum guide plate elements 422, 424 below the clamping unit 350. The shaft 144 in tool nest housing 140 is released, as in the instance of the first winding workstation, and retracted to contact cam 462 on turntable or dial 12, as described above, to allow plate 150 to rotate with the tray 170. Lifting surfaces 464 on winder head 470, the latter of which, as shown in FIGS. 31 to 33, has a shape with longitudinal straight sides 472, 474 and convex ends 476, 478, and which is mounted on winder 480, is adapted to cooperatively engage tray finger structure 178 extending over the peripheral channel in the tray 170, as shown in FIG. 9. Accordingly, during rotation of the plate member 150 and tray 170 on the tool nest 60, the raised fingers 178 of the tray 170 will allow for guiding the suture into the peripheral tray channel. A so-called "zipper" winding mechanism of generally this type is described in copending application Ser. No. 08/521,978 the disclosure of which is incorporated herein by reference. This winding rotation of the winder 480 is imparted by means of a drive 482 which rotates the package tray 170 at a high rate of speed over a plurality of rotations commensurate with the length of the particular suture portion extending therefrom, so as to cause the entire length of suture to be wound in one or more circumferential windings into the peripheral channel formed in the package tray 170.

Figure 27A:
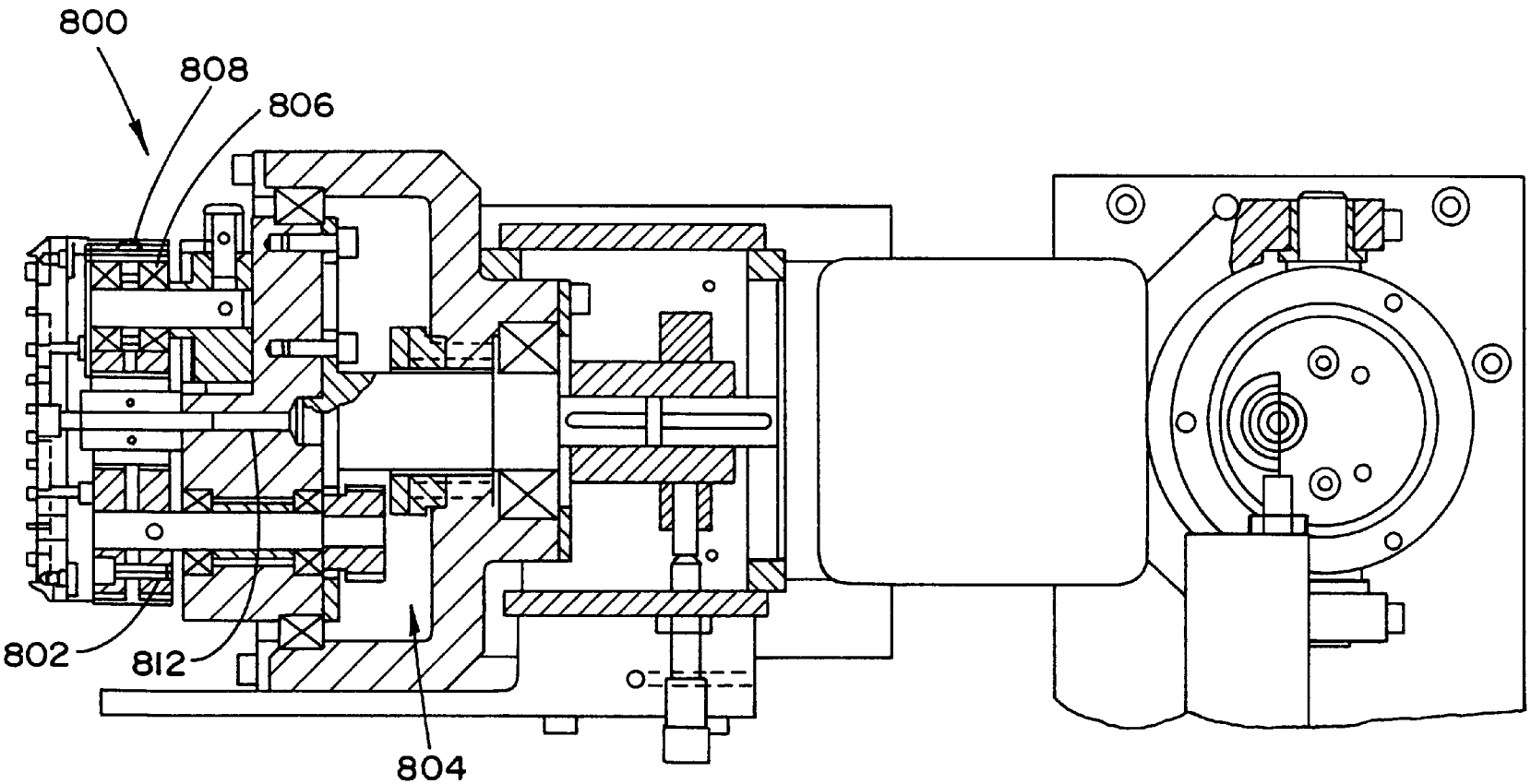
FIG. 27*a* illustrates a partial sectional view of the suture winding arrangement showing the planetary gearing system.
Figure 27B:
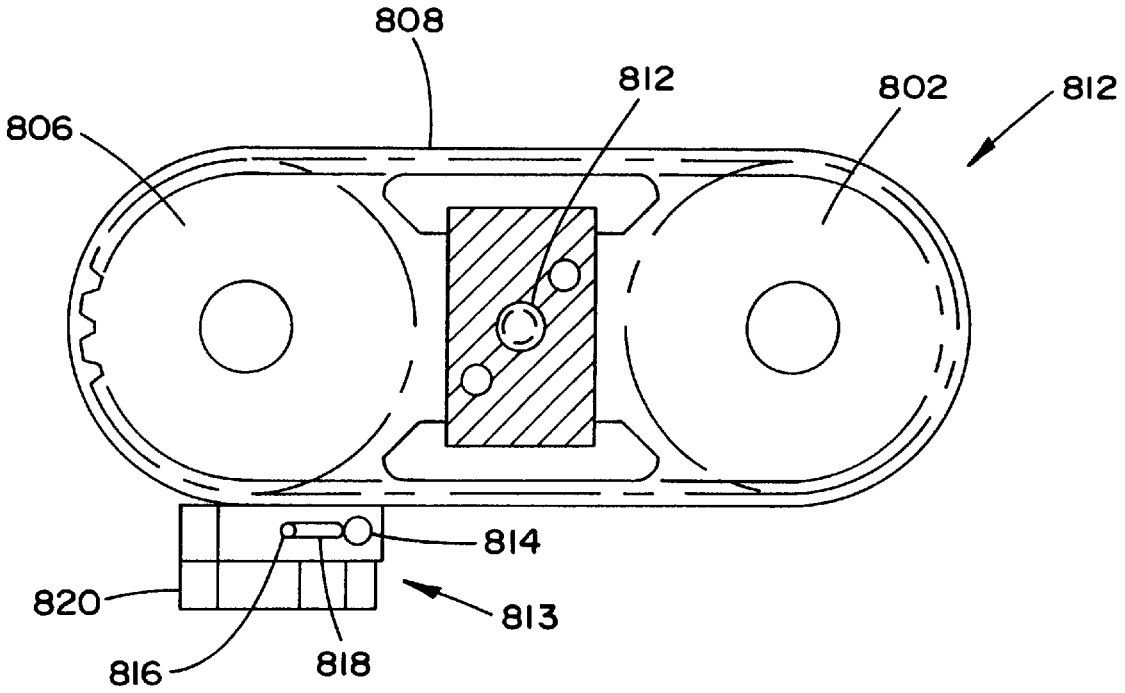
FIGS. 27*b* and 27*c* illustrate front and top views, respectively, of the planetary gear sub-assembly.
Figure 27C:
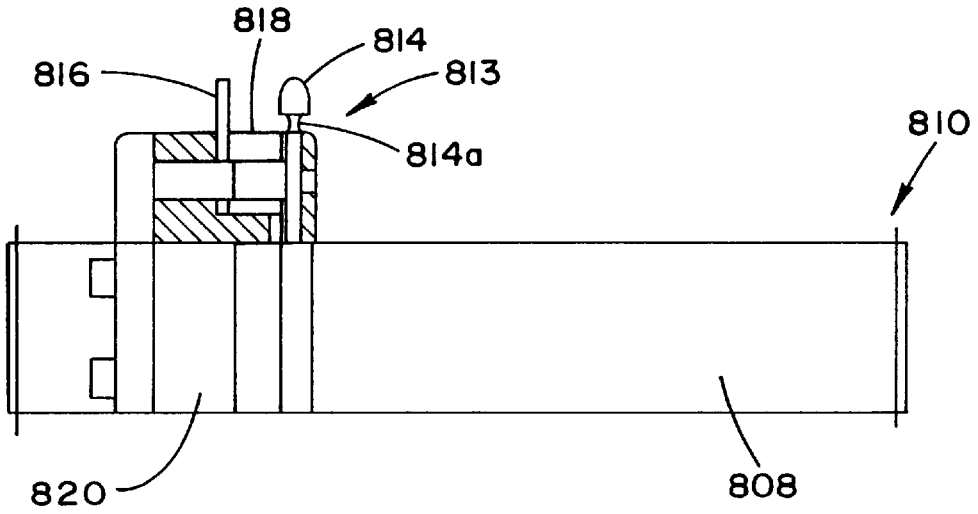

To maintain the suture's position while the winding head 470 is being rotated, a counter-rotating planetary gear system 800 is employed. Referring to FIGS. 27*a* through 27*c*, the planetary gear system 800 is shown in greater detail. The planetary gear system 800 comprises a driven gear 802 which is driven in an opposite direction to the winding head 470 through the winding head motor by a suitable gearing system 804. The driven gear 802 in turn drives idler gear 806 by way of pulley 808 meshably connected thereto. The driven gear 802, idler gear 806, and pulley form a sub-assembly 810 shown in FIGS. 27*b* and 27*c*, which freely rotates about a central shaft 812. Thus, the planetary gear sub-assembly 810 rotates in an opposite direction to the winding head 470 about the same central axis. Attached to the pulley 808 is a suture guide assembly 813 comprising a fixed pin 814 having a notch 814*a* for location of the suture, and a movable pin 816 which moves in a slot 818. The movable pin 816 moves into engagement with the stationary pin 814 to clamp the suture therebetween by the application of air pressure acting on a piston (not shown) connected thereto. Application of a vacuum to the same piston retracts the movable pin 816.

Before winding the suture, the suture is clamped by both the clamping unit 350 and the suture guide assembly 813 which defines the sutures path during winding. This defined path is maintained during rotation of the winding head 470 because the planetary gear system 800 maintains the suture guide assembly 813 at a fixed point by way of its counter rotation with respect to the winding head 470.

Thereafter, the winder head 470 is retracted from the tool nest 60, the shaft 144 is released from contact with the cam 462 by deactivating the air motor in housing 140, and the movable pin 816 of the suture guide assembly 813 is retracted, resultingly locking the plate element 150 in predetermined horizontally extending position.

Intermediate the rapid winding workstation 100 (7) and a subsequent cover-applying workstation (9), there may optionally be arranged workstation 106 (8) comprising a sensor 104 which is adapted to ascertain the presence of the wound suture and surgical needle in the package tray 170.

Figure 35:
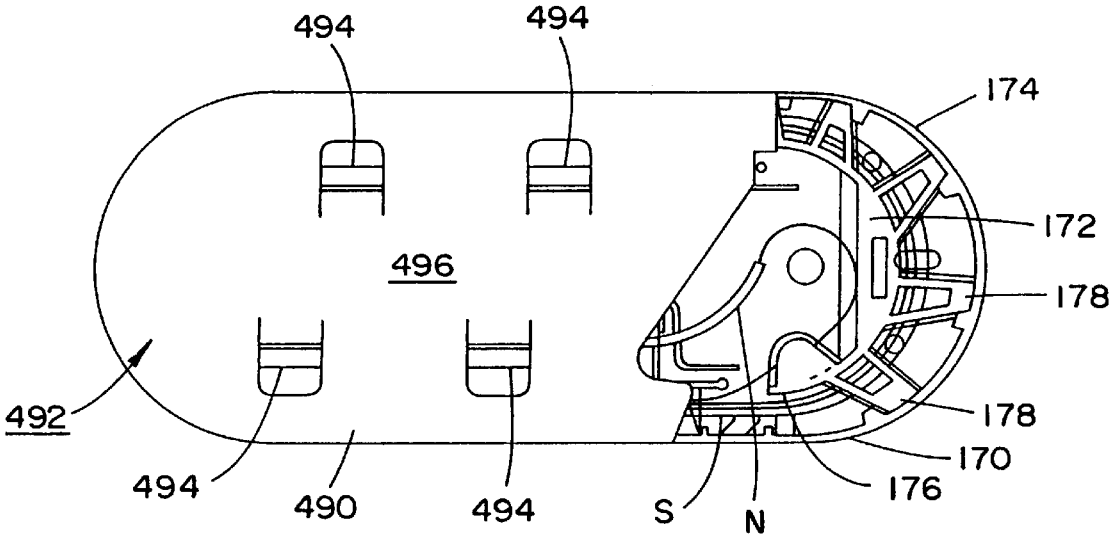
FIG. 35 illustrates a front view of a completed suture package containing a surgical needle and attached suture with a cover having been applied thereto by the cover-applying arrangement of the packaging machine.

The packaging tray 170 is shown in FIG. 35 with a cover 490 having been applied thereto so as to produce a complete suture package 492 having a single needle "N" and attached suture "S" arranged therein. The cover 490 extends over only a portion of the packaging tray surface area so as to afford visual inspection of the contents of the suture package 492 and removal of the needle without removal of the cover 490. Interengageable latching structure 494, such as cut-outs and flaps, formed on the cover 490 and package tray 170 ensure their latched engagement upon application of the cover 490 to the packaging tray 170. The external cover surface 496 may be provided with suitable printing whereby the cover, in essence, also constitutes a label for the suture package.

Figure 36:
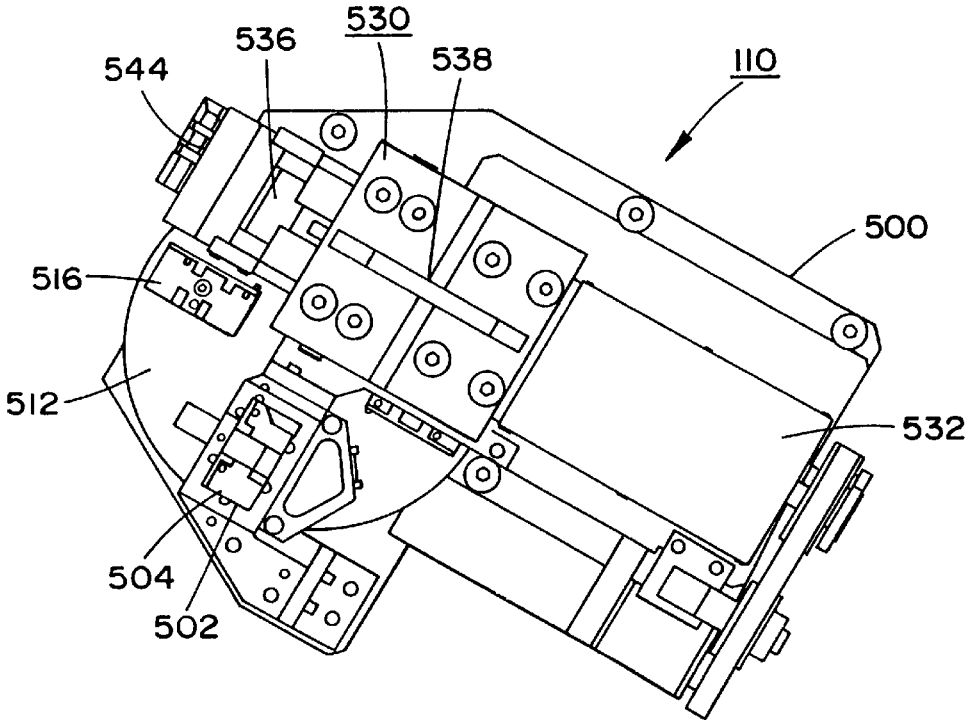
FIG. 36 illustrates a plan view of the cover-applying arrangement for the suture packaging machine.

Referring to the features of the invention which are more specifically directed to the workstation 110 (9) wherein the covers 490 are applied onto respective package trays 170 each containing a single surgical needle and attached suture to form a complete suture package 492 as shown in FIG. 35, there is disclosed a platform arrangement 500 on which there is mounted a stationary vertical structure 502, as shown in FIG. 36, comprising an open-bottomed chute 504 for the positioning therein of a stack of superimposed lay flat covers 490, such as are shown in FIG. 35, adapted to be mounted on trays 170.

Figure 43:
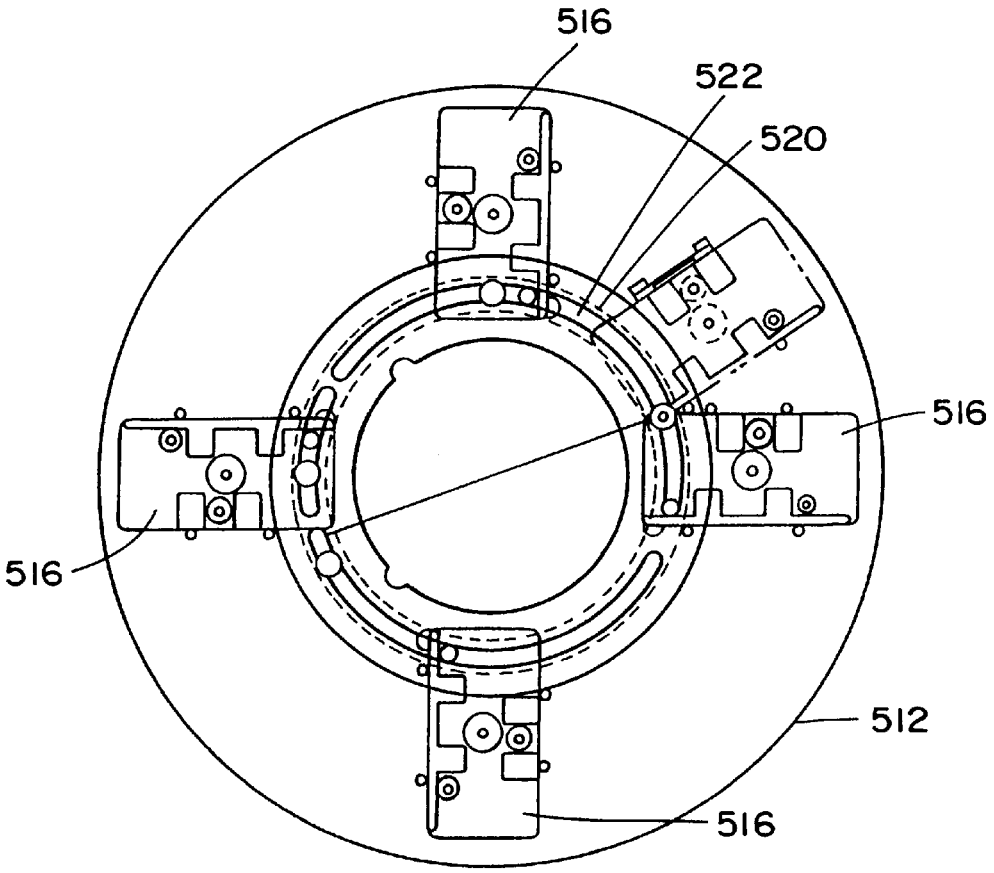
FIGS. 43 and 44 illustrate, respectively, bottom plan and sectional views of a rotary slice plate employed in the mechanism of FIGS. 36 through 38.
Figure 44:
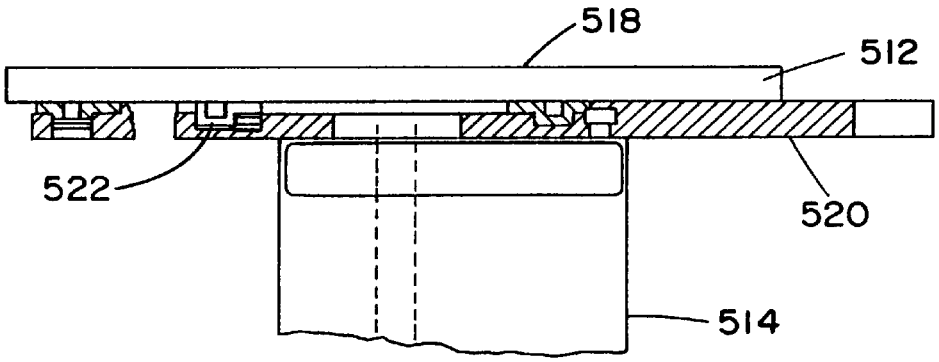

The lower end 506 of the chute 504 containing the stack of covers 490, and which consists of a spaced rod arrangement 508, with a weight 510 on the covers 490 to press them downwardly, is located in close proximity above a rotatable disc-like plate element 512. As shown in FIGS. 43 and 44, the rotatable plate element 512, which is adapted to be driven by a drive arrangement 514, includes plurality of defined surface areas 516; for example, four areas located at 90° annular spacings from each other, which each conform to respectively the shape of a cover 490.

Between the chute 504 and the rotatable disc-like plate element 512 is a single multi-cover buffer area 193*b* containing a stack of buffer trays 170. The buffer area 193*b* allows the chute 504 to be removed and reloaded with covers 490 without stopping the machine. Therefore, covers 490 can be continuously loaded into the disc-like plate element 512 from the tray 170 stack in the buffer area 193*b* while loading more covers into the chute 504 without interrupting the packaging process.

During the indexed rotational movement of the plate element 512, a bottommost cover 490 of the buffer stack in the buffer area 193*b* is sliced off or separated and deposited onto respectively a surface area 516 located therebelow on the upper surface 518 of the plate element 512 which is in alignment therewith. This transfer of successive covers 490 from the buffer area 193*b* is implemented through the intermediary of applying a vacuum by means of a vacuum plenum 520 to the applicable surface area 516 through a suitable channel 522 which is in communication with a source of vacuum. Accordingly, each time a surface area 516 on plate element 512 passes beneath the bottom 506 of the buffer area 193*b* containing the stack of covers 490, one cover 490 is sliced off or separated from the bottom of the buffer stack and deposited under a vacuum on the rotatable plate element 512.

At a point in time when a cover 490 on the surface area 516 is located opposite a program controlled robotic pivot arm structure 530 which is located 180° rotationally displaced from the chute 504 containing the stack of covers 490, as shown in FIGS. 37 through 42, one of the covers 490 is picked up from plate element 512 for transfer and placement on a packaging tray 170 located on a tool nest 60.

As shown in drawing FIGS. 37 through 42, the pivot arm structure 530 includes a housing 532 which is mounted on the platform arrangement 500, and with a surface portion 516 of plate element 512 rotating below the housing 532, as shown in FIG. 36. The housing 532 contains actuating and robotically-controlled driving devices (not shown) for operating a pivot arm mechanism 536 which is movably attached to housing portion 538.

Figure 38:
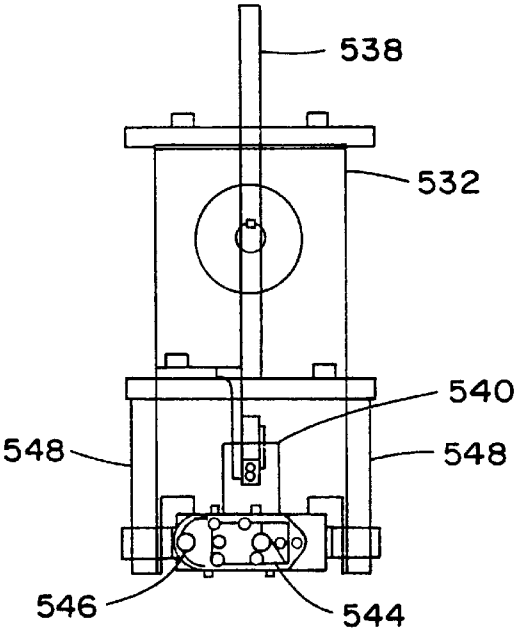
FIGS. 37 and 38 illustrate, respectively, side elevational and partial front views of the cover-applying pivot arm mechanism for producing the suture package of FIG. 35.
Figure 37:
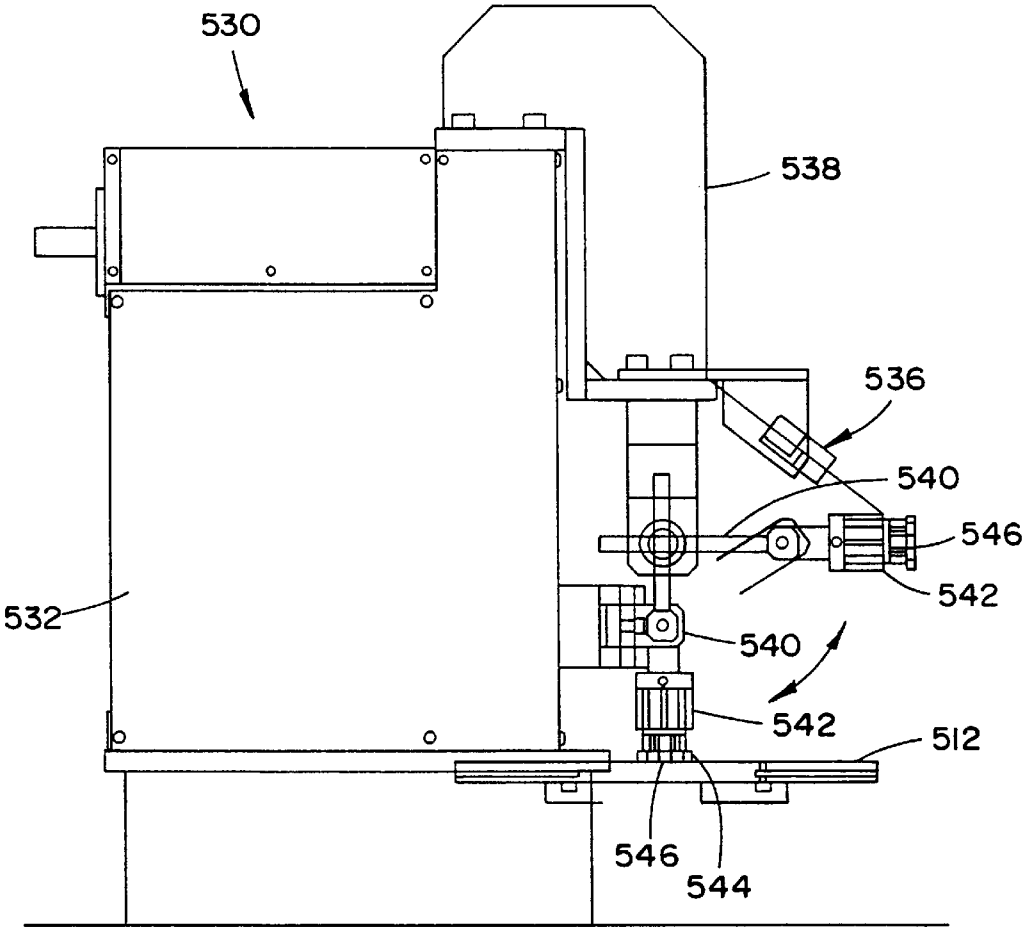
Figure 39:
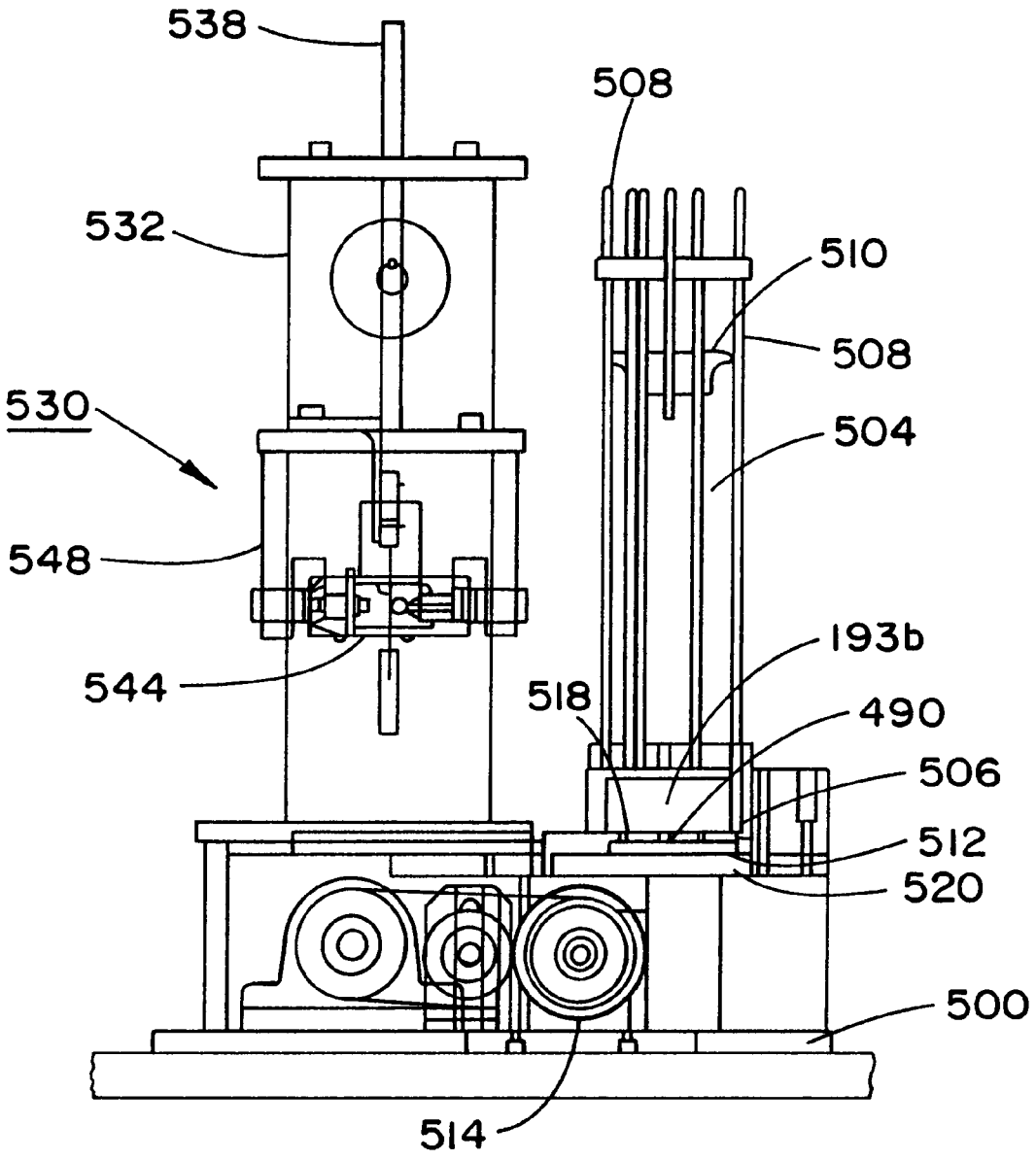
FIG. 39 illustrates, diagrammatically, an elevational view of the cover-applying arrangement of FIG. 36.
Figure 40:
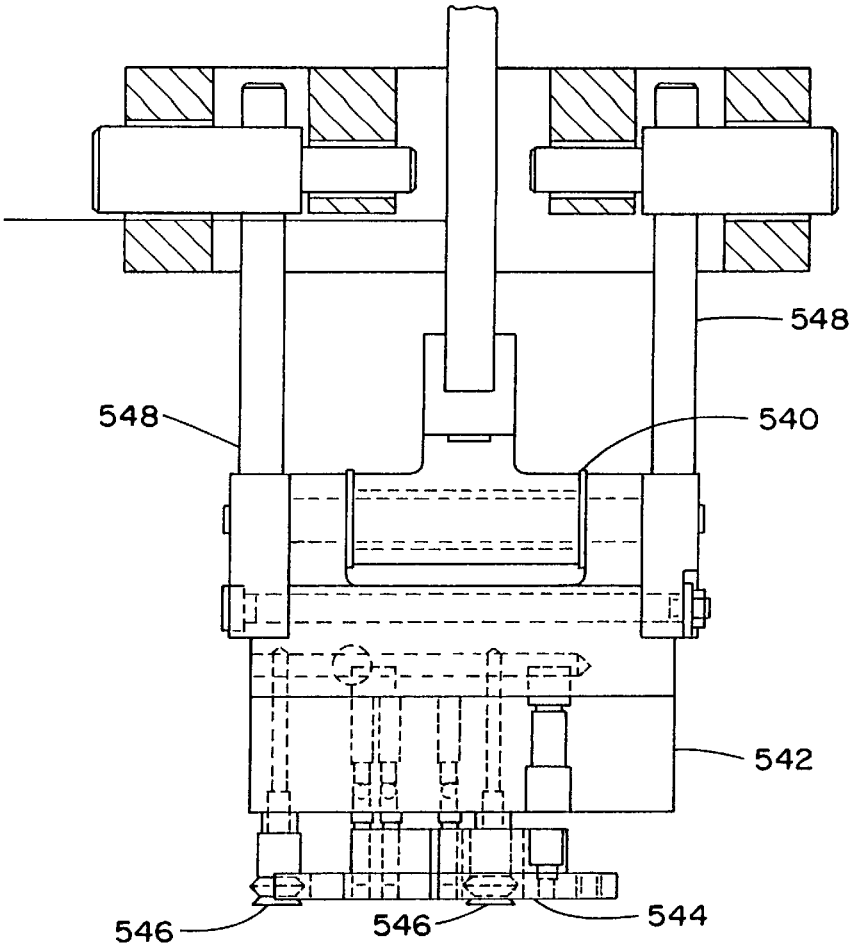
FIG. 40 illustrates, partly in section, a plan view of the pivot-arm structure of the mechanism of FIG. 38.
Figure 41:
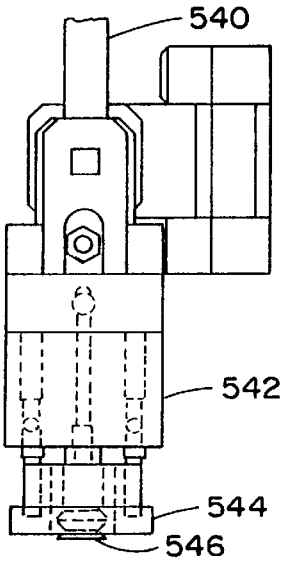
FIG. 41 illustrates a partial side view of the pivot-arm structure of FIG. 40.
Figure 42:
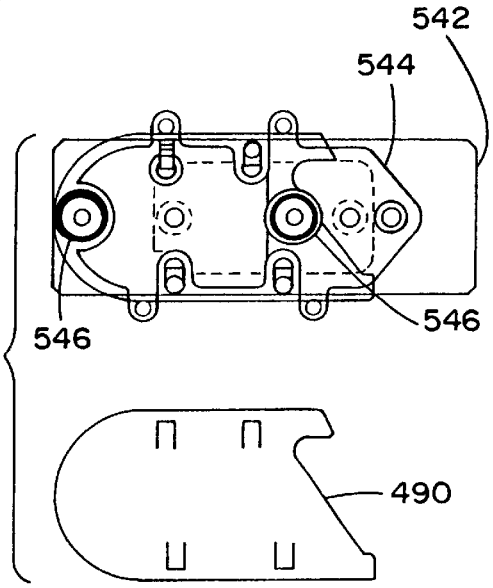
FIG. 42 illustrates an exploded front view of the pivot arm structure of FIG. 40 and a cover which is to be applied thereby on a package tray containing s surgical needle and attached suture so as to produce the suture package of FIG. 35.

Referring to FIGS. 37 and 38, wherein the former shows the pivot arm 540 in two operative positions, the free end 542 of the pivot arm 540 includes a gripper elements 544 which are adapted to pick up a cover 490 through the intermediary of air passages 546 communicating with an air source for actuation of said gripper elements 544. As illustrated in FIGS. 40 to 42, linkage elements 548 which are pivotably hinged to housing portion 538 facilitate the pivoting and also axially displaceable movement of pivot arm 540.

Referring to FIG. 37, in the downward position of pivot arm 540, while connected to a vacuum source, the arm 540 is pivoted downwardly to enable the pick-up of the cover 490 by the suction device 230 under the aspirating action of the vacuum, while a vacuum acting on the plate surface area 516 of plate element 512 at that location is released. This causes the cover 490 to adhere to the pivot arm suction device 544. Thereafter the pivot arm 540 is swung upwardly into the horizontal orientation shown in FIGS. 37 and 38 so as to align the cover 490 with a needle and suture-containing package tray 170 located on the plate element 150 of a tool nest 60 which is in operative alignment therewith. The pivot arm 540 with the cover 490 thereon is then advanced forwardly so as to cause the cover 490, to be pressed into latching engagement with the package tray 170, as shown in FIG. 35, thereby forming a complete suture package 492. At this time, the vacuum in the suction device 544 is released, and this completes the application of the cover 490 to the tray 170. This will then enable the robotic pivot arm 540 to be retracted and pivoted downwardly so as to be able to repeat the operative sequence described above with regard to a successive cover which has been rotated into position therebeneath on the plate element 512, while the tool nest 60 with the completed suture package is advanced forwardly to a package unloading workstation. A successive tool nest 60 having a package tray 170 with a surgical needle and wound suture arranged therein is concurrently indexed into position opposite the robotic pivot arm 540 by the indexed advance of turntable 12 so as to enable the foregoing cycle of applying a cover 490 onto a tray 170 to be repeated.

Reverting now more specifically to the description of the suture package unloading workstation 122 (10), reference may be had to drawing FIGS. 45 through 51. Basically, the components of the workstation 122 are supported on a stationary horizontal platform 600. The major components, as detailed hereinbelow, are a robotic pivot arm arrangement 602, and a series of elongate parallel movable racks comprising compartmented trays 604 each possessing a plurality of adjacent compartments 606, which are adapted to each receive and stack a predetermined quantity of completed suture packages 492 which have been removed in succession by means of the robotic arm arrangement 602 from the tool nests 60 on the turntable 12 of the packaging machine 10.

The compartmented trays 604 are each mounted so as to be slidable along parallel supports 608, 610 radially extending into proximity with and below the turntable 12 of the packaging machine.

Figure 45:
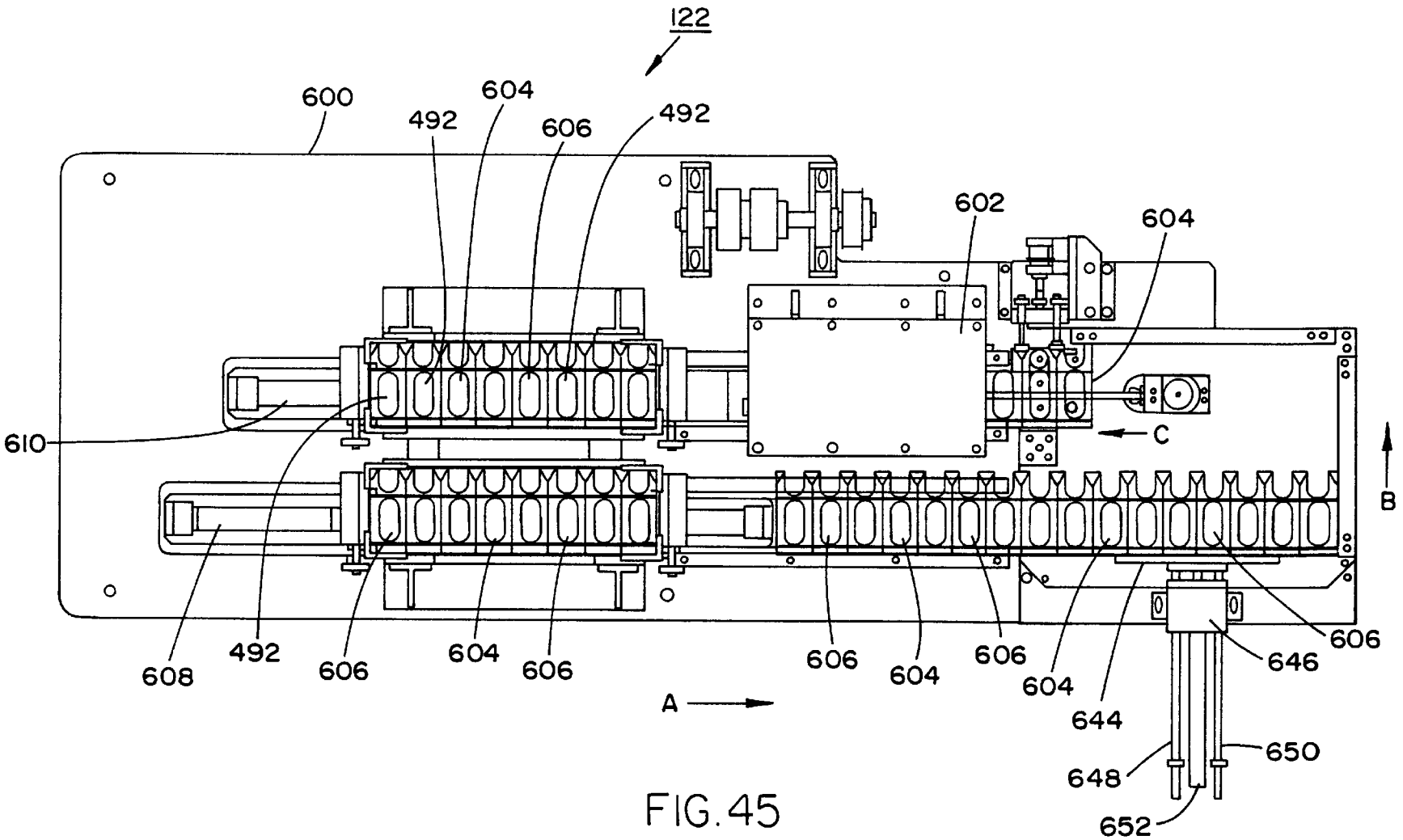
FIG. 45 illustrates, diagrammatically, a plan view of the suture package unloading arrangement of the packaging machine.
Figure 46:
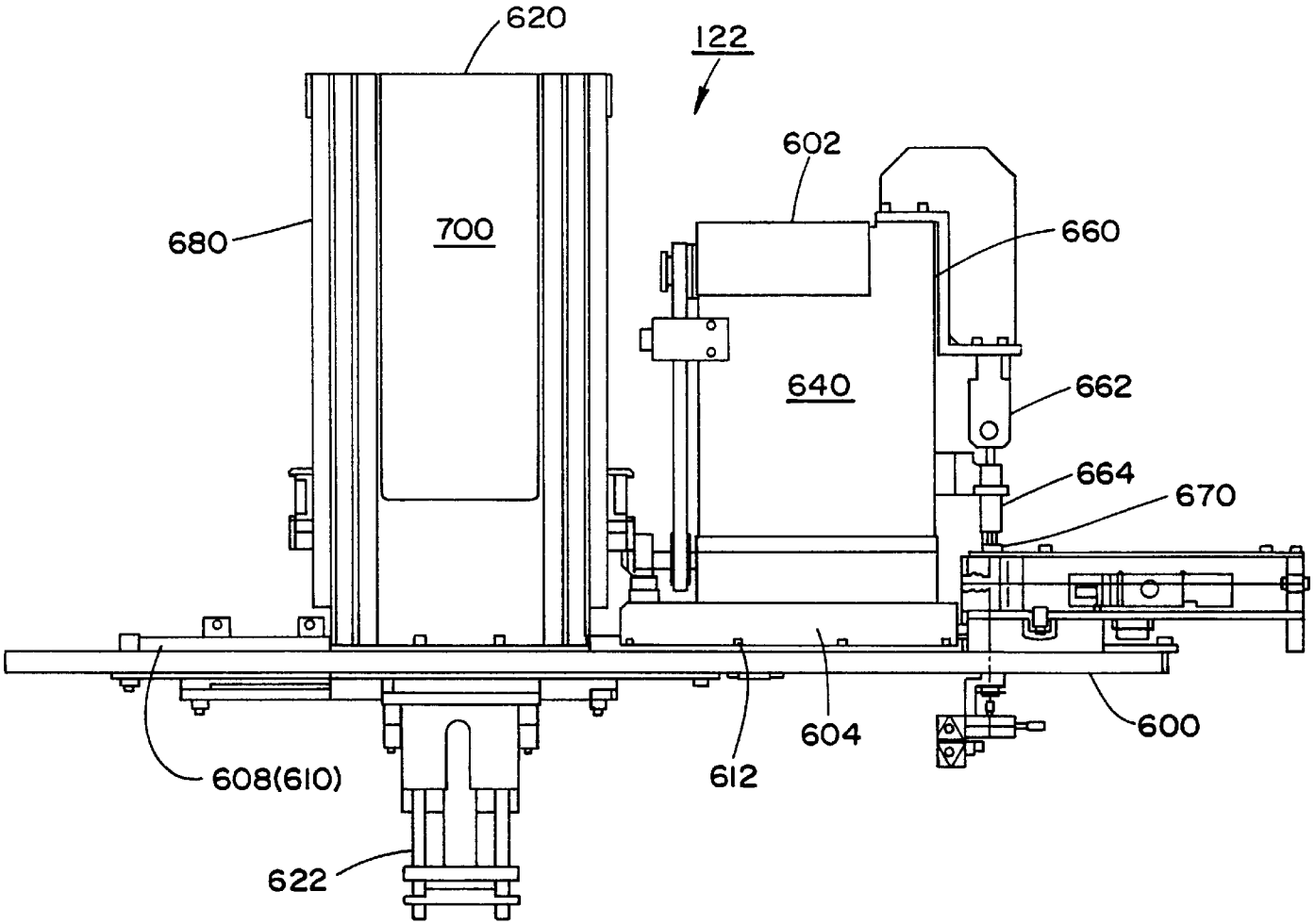
FIG. 46 illustrates a side elevational view of the arrangement of FIG. 45.

As can be ascertained from the drawing FIGS. 45 and 46, each compartmented tray 604 is movable along its longitudinal axis by means of tray-engaging elements 612 spaced along the bottom of each of the supports 608, 610. The slidable support 608 is adapted to convey empty of the compartmented trays 604 towards the turntable 12. The slidable support 610, conversely, is adapted to index compartmented trays beneath the robotic arm arrangement 602 for filling the compartments 606 with stacks of suture packages 492 and then conveying the suture package-filled compartmented trays 604 away from the turntable 12 for stacking in a storage 620 through the intermediary of an elevator mechanism 622. As shown in FIG. 45, the longitudinal or axial conveyance of slidable support 608 is implemented by a drive unit 630, whereas the indexing motion and conveyance of slidable support 610 is carried out through an indexing and drive unit 632 which is located below the platform 600.

Figure 48:
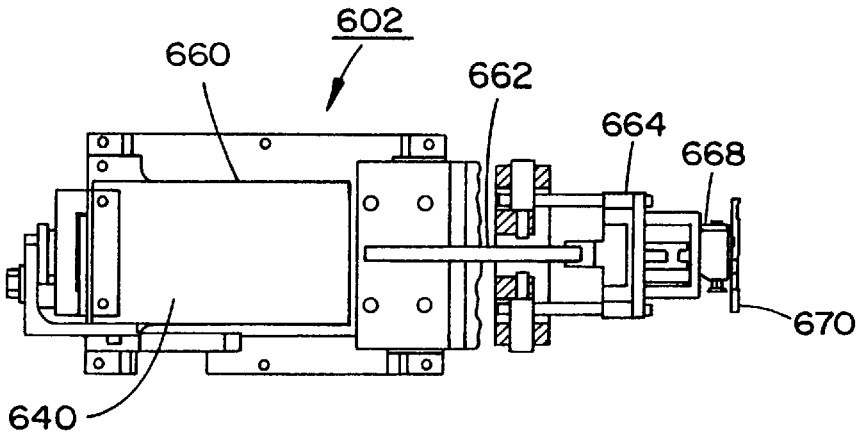
FIG. 48 illustrates a top plan view of the robotic pivot arm portion of FIG. 47, shown with pivot arm in the horizontally upward pivoted position.
Figure 47:
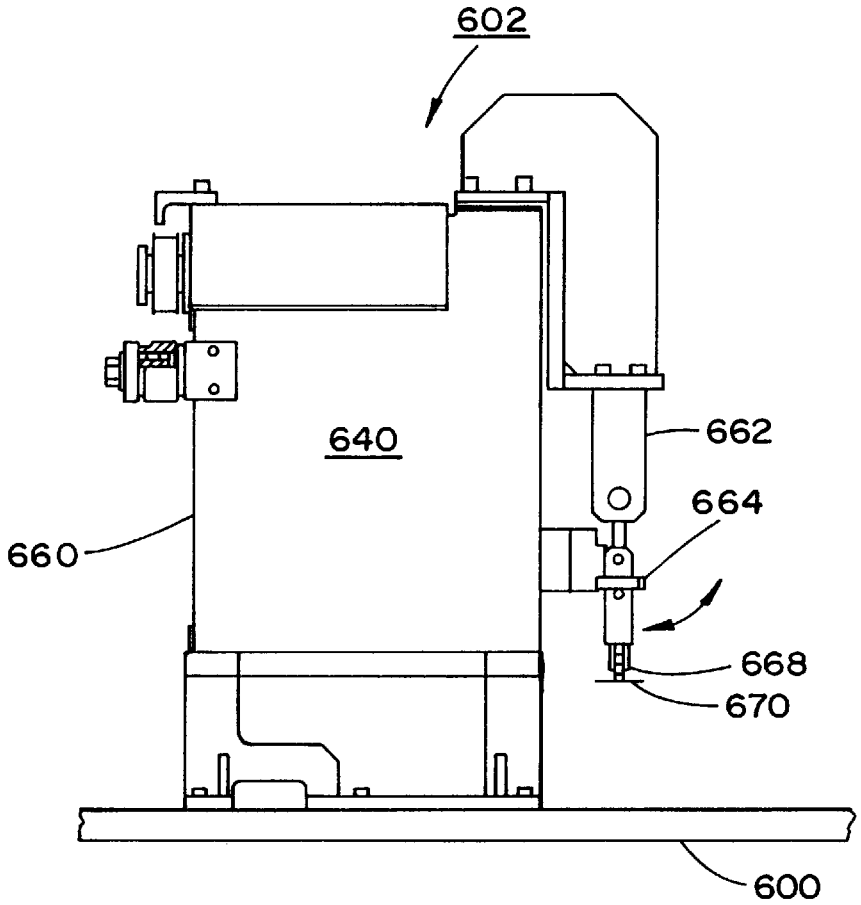
FIG. 47 illustrates a side elevational view of the robotic pivot arm portion of the arrangement of FIG. 46.
Figure 49:
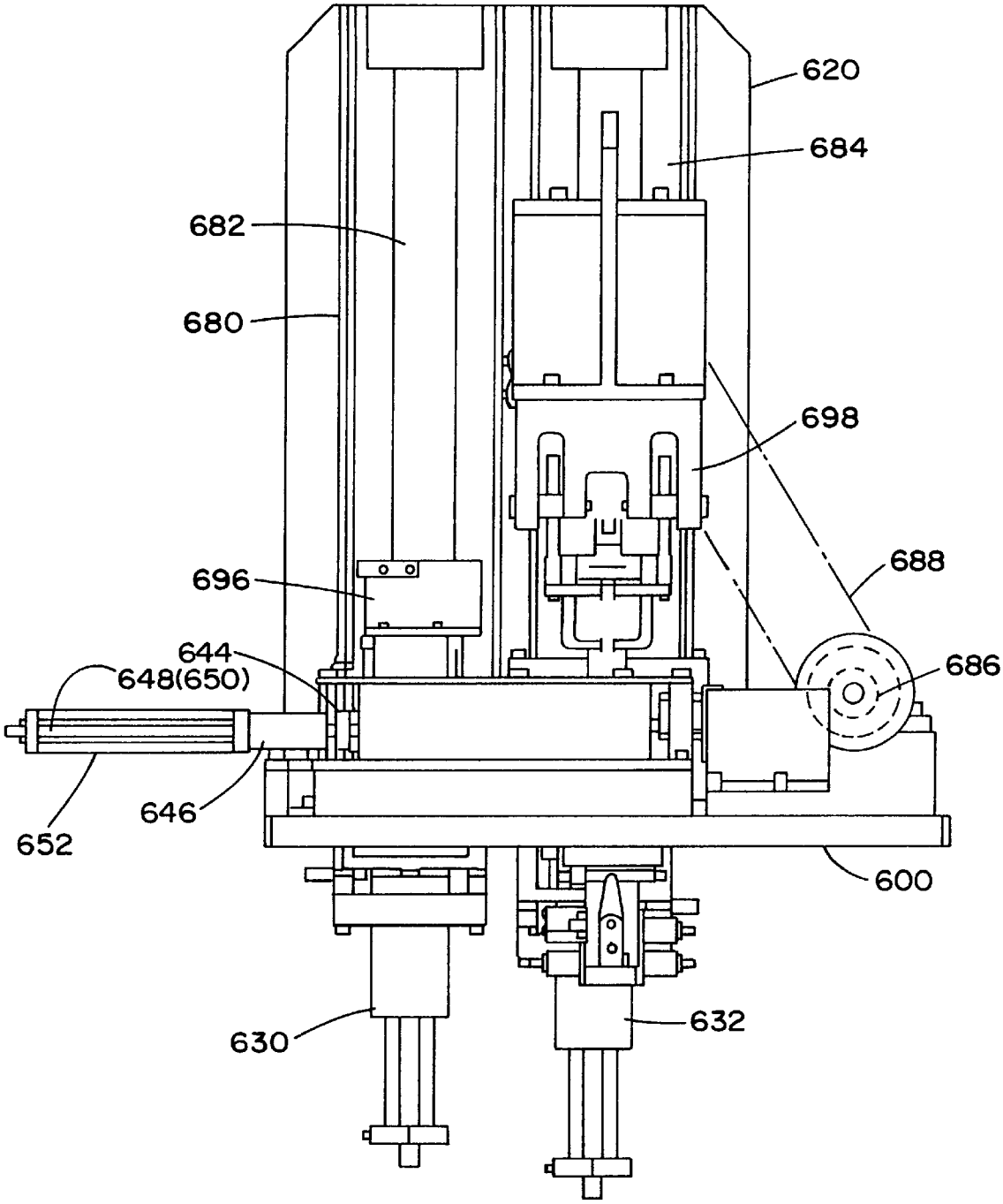
FIG. 49 illustrates a front end view of the arrangement of FIG. 46.
Figure 50:
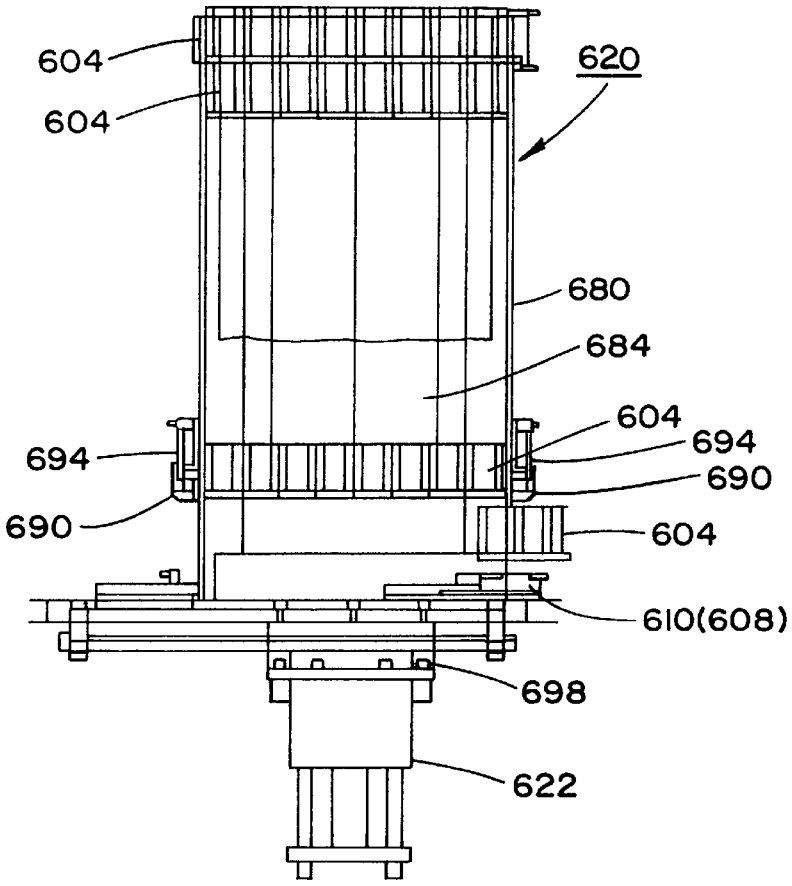
FIG. 50 illustrates, generally diagrammatically, a side elevational view of a storage housing portion of the arrangement of FIG. 46.
Figure 51:
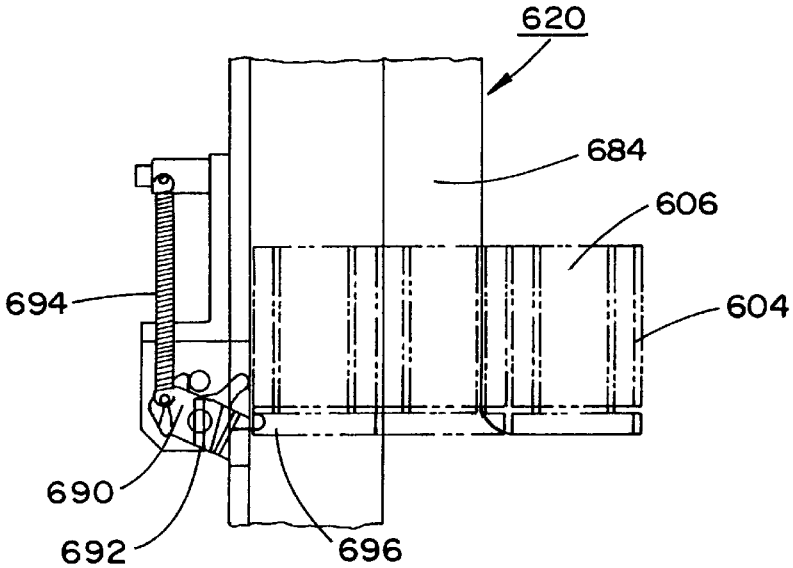
FIG. 51 illustrates, generally diagrammatically, a fragmentary segment of the storage housing portion of FIG. 50, showing a detail of the lifting/locking device for compartmented trays containing suture packages.
Figure 52:
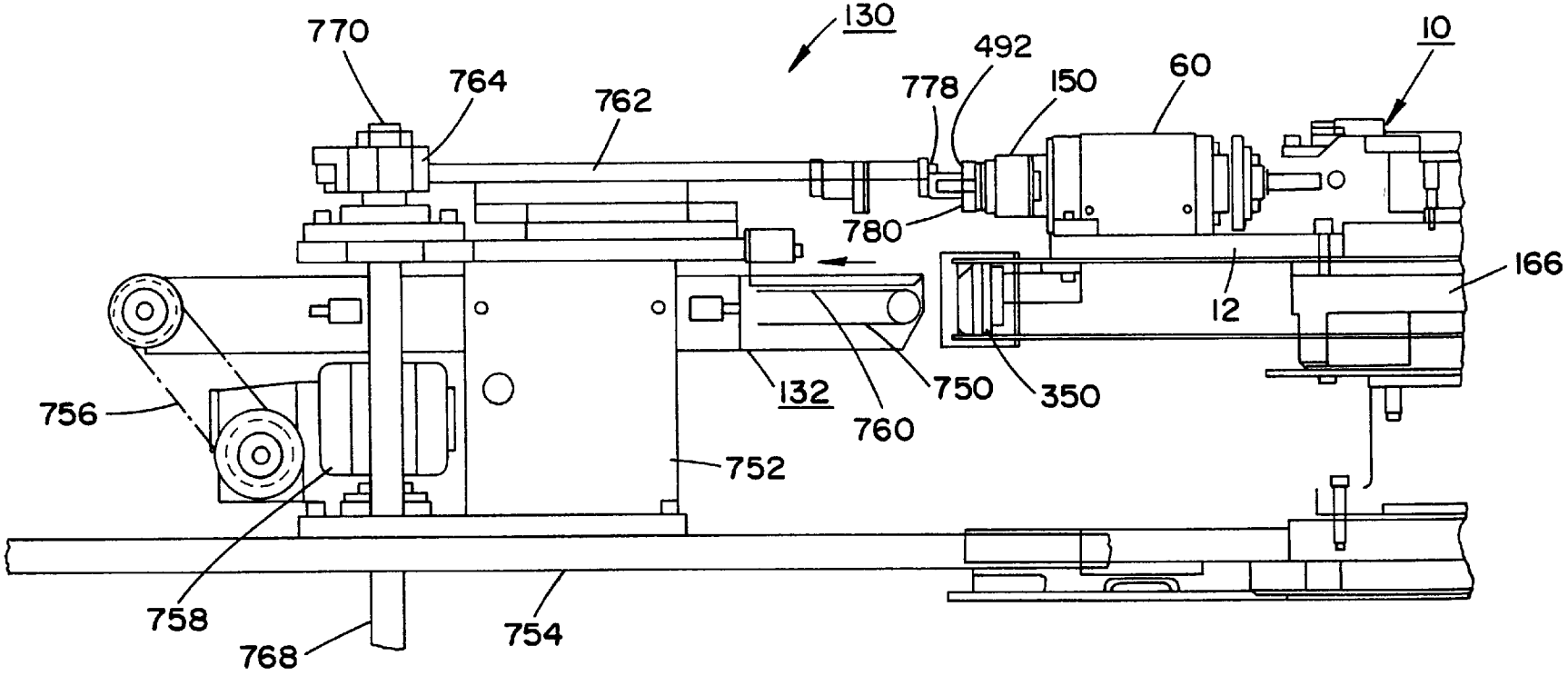
FIG. 52 illustrates, diagrammatically, a side view of an arrangement for removing rejected suture packages from the packaging machine.
Figure 55:
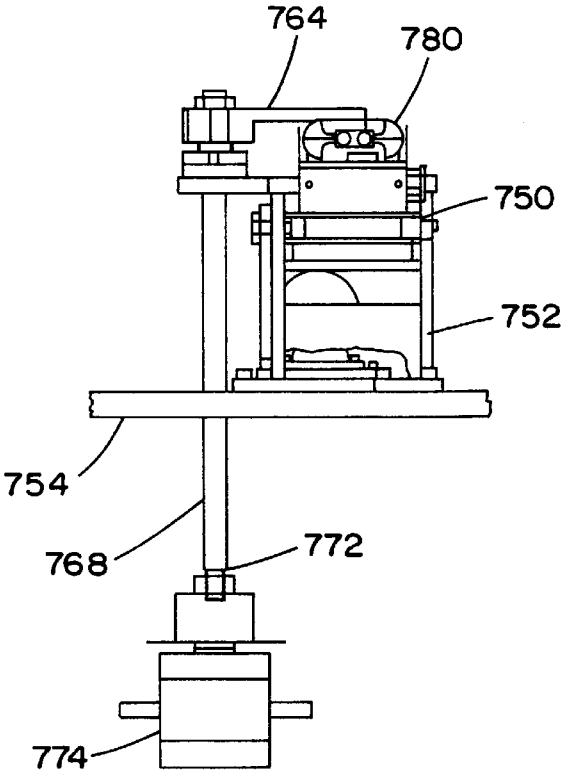
FIGS. 53, 54 and 55 illustrate, respectively, side, top plan and front end views of the arrangement shown in FIG. 52.
Figure 54:
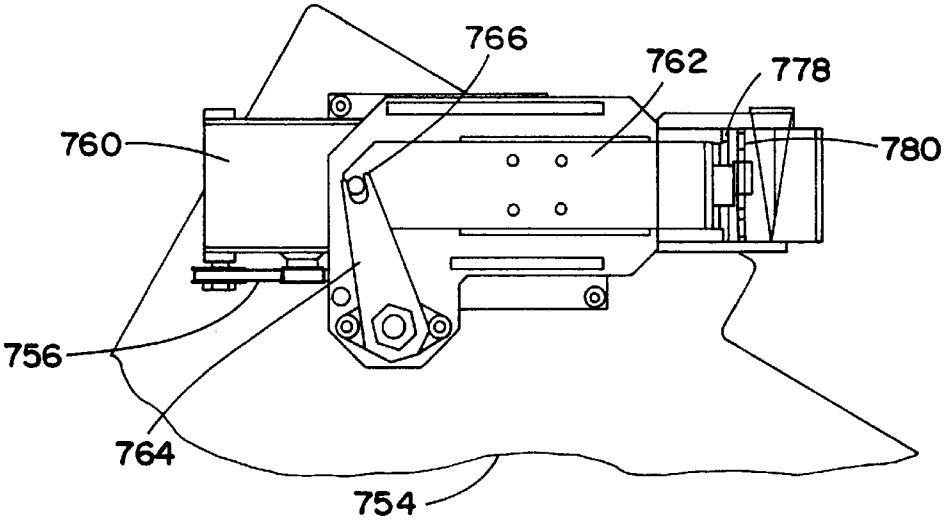
Figure 53:
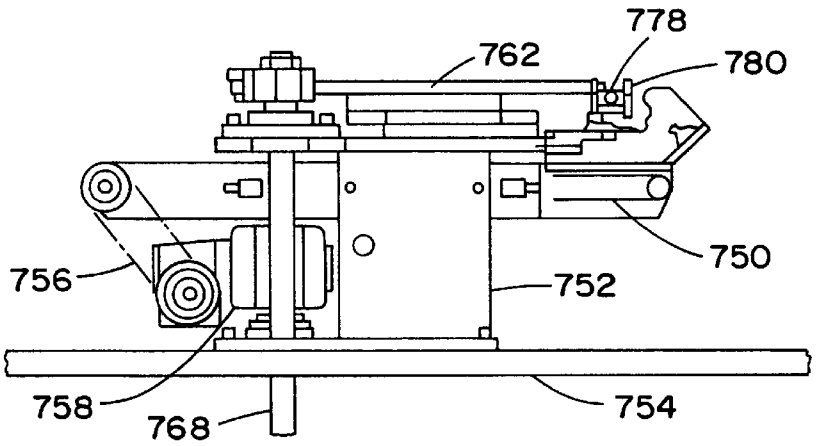

Referring more specifically to FIGS. 47 through 49, the robotic arm arrangement 602 is located above the slidable support 610 and includes a housing 640 straddling the support 610, with the housing being arranged intermediate the compartmented tray storage 620 and the turntable 12 of the packaging machine 10, in effect, along the path of axial movement or travel of the compartmented trays 604 which are being filled with suture packages 492 and transported to the storage 620.

In essence, a continuous sequence of empty compartmented trays 604 are adapted to be advanced forwardly along a path of travel towards turntable 12 (not shown) as shown by arrow A in FIG. 45 so that a forwardmost compartmented tray 604 is in position adjacent a pusher plate 644 of a drive mechanism 646 for displacing the forwardmost compartmented tray 604 laterally in the direction of arrow B. When a compartmented tray 604 has its most rearward compartment 606 located in alignment with the robotic pivot arm arrangement 602, the compartment is successively supplied with a predetermined quantity of suture packages 492; i.e. such as ten (10) stacked packages. At that point, the compartmented tray 604 is indexed in the direction of arrow C by a distance of one compartment 606 so as to enable the following compartment to be filled with suture packages 492. This sequence is repeated until all of the compartments 606 have been filled with suture packages, whereupon the filled compartmented tray 604 is advanced towards the storage 620, as described hereinbelow. At that time, the forwardmost empty compartmented tray 604 on the slidable support 608 is laterally displaced by the pusher plate 644 which slides along support rods 648, 650 adjacent a piston unit 652 of the drive mechanism 646, so as to locate the rearwardmost compartment 606 thereof below the robotic pivot arm arrangement 602. Thereupon, the filling cycle for the compartmented tray 604 is repeated as heretofore, while a successive empty compartmented tray 604 is advanced forwardly along arrow A on support 608 so as to be positioned in readiness adjacent the retracted pusher plate 644.

Reverting to the construction of the robotic pivot arm arrangement 602, the housing 640 incorporates driving mechanism (not shown) located in housing portion 660, having a depending arm 662 with a pivotable arm device 664 for conveying suture packages 492 from therewith aligned tool nests 60 (not shown) into the compartments 606 of the compartmented trays 604.

The robotic pivot arm arrangement 602 has the pivot arm device 664 articulated for swinging and axial movements at hinge point 666 so as to be oriented downwardly, as shown in FIGS. 45 and 46 for depositing suture packages 492 into the compartments 606 of the compartmented trays 604, or extended horizontally for reciprocation, as shown in FIG. 47. During that horizontally oriented axial reciprocatory movement, the pivot arm device 664 is adapted to remove suture trays 492 from the plate element 150 on a therewith aligned tool nest 60. The free or distal end 668 of the pivot arm device 664 includes a gripper attachment 670, upon a suture package 492 being arranged on the tool nest 60 which is located at this workstation of the turntable 12, the arm 662 is horizontally oriented and extended towards the tool nest 60 so as to have the gripper attachment 670 contact and grasp the suture package 492 while the vacuum retaining the suture package 492 on the tool nest 60 is concurrently released, the suture package 492 is withdrawn from the tool nest 60 by the pivot arm 662.

The pivot arm 662, with the suture package 492 grasped by the gripper attachment 670 is then retracted and pivoted downwardly, as shown in FIGS. 46 and 47, whereupon the gripper attachment 670 releases the suture package 492 so as to enable the suture package 492 to drop into a compartment 606 located therebeneath. The turntable 12 is concurrently indexed forwardly, as shown in FIG. 1, so as to permit a successive tool nest 60 mounting a completed suture package 492 to be positioned at the package unloading workstation 122(10), and the pivot arm 662, which has already released the previous suture package 492 is swung upwardly into its horizontal position and extended forwardly so as to contact the suture package 492 located on that successive tool nest 60, and the gripper arrangement 670 grasps the suture package 492 while the vacuum in tool nest 60 is released as heretofore. Then, as previously, the pivot arm 662 is retracted, swung downwardly and the suture package 492 released so as to enable it to drop into the compartment 606 therebelow in superposition on the previous suture package or, alternatively, if the compartment is full and the compartmented tray 604 has been indexed by one compartment in the direction B, to cause the suture package 492 to drop into an adjacent empty compartment 606.

Referring more specifically to FIGS. 45 through 51, the filled compartmented trays 604, each of which; for example, may have a series of eight compartments 606 each adapted to have ten suture packages 492 stacked therein, are conveyed by slidable support 610 to a position below the storage 620. The storage 620 consists of an open housing structure 680 having two adjacently arranged vertically-extending chutes 682, 684, one of which is adapted to have empty compartmented trays 604 stacked therein, and the other to receive filled compartmented trays 604. The housing structure 620 has a lifting arrangement 686 connected therewith, which may be a belt drive 688, as shown in FIG. 46, which raises the compartmented trays 492 in sequence, as diagrammatically illustrated in FIGS. 50 and 51. In that instance, pivotable fingers 690 which pivot about pivot points 692 under the biasing action of tension springs 694, and which are connected to slidable frame elements 696 operated by a lift or hoisting drive 698, raise the filled compartmented trays 604 so as to facilitate further filled trays to be positioned therebelow. The stacks of filled compartmented trays 604 may then be manually removed from the open side 700 of housing structure 620; in effect, from chute 684, and empty trays 604 inserted into an adjacent chute 682 so as to be lowered onto slidable support 608.

In the event that it has been previously ascertained; for example, through suitable sensor means or the like, that a suture package 492 located on a tool nest 60 is either incomplete or defective; rather than the suture package being removed at the unloading workstation 122 (10), the defective suture package 492 is allowed to be advanced on its tool nest 60 by the turntable 12 to a subsequent reject workstation 130 (11), at which a reject arrangement 132 is adapted to remove the defective or incomplete suture package 492 from the packaging machine 10.

The arrangement 132 for removing defective suture packages 492 comprises a conveyor belt 750 supported on a stationary frame structure 752 having a base plate 754. The conveyor belt 750 is connected to a belt drive 756 operated by a driving motor 758 which imparts a continuous motion to the conveyor belt so that the upper run 760 thereof travels in the direction of the arrow; in effect, radially outwardly away from turntable 12 and tool nest 60 mounting a rejected suture package 492 on plate element 150.

Located above the conveyor belt 750 is an axially slidable member 762 which is reciprocable towards and away from the suture package 492 responsive to the swinging action of a pivot arm 764 pivotably connected thereto at pivot point 766. A vertical shaft 768 has the upper end 770 connected to the pivot arm 764, and at its lower end 772 is connected to a drive unit 774 for imparting oscillatory rotational movement thereto.

At the forward end 776 of slidable member 762, there is connected a head portion 778 having elements 780 adapted to engage the suture package 492 in the forwardly advanced position of slidable member 762. Upon engaging the suture package 492, the vacuum in the tool nest 60 is released, thereby enabling the elements 780 to grasp the package 492, and the slidable member 762 to retract by means of the pivoting of shaft 768 so as to swing pivot arm 764 backwards. The elements 780 on head portion 778 then release the suture package 492 so that the latter drops onto the upper run 760 of the conveyor belt 750 so as to be conveyed towards a waste disposal location. The foregoing operation is continually repeated for each tool nest 60 coming into alignment with reject workstation 130, even if no suture package 492 is located at that workstation, so as to ensure that every suture package will be prevented from passing this workstation, and thereby the packaging machine 10 will always be ready to continue in successive complete packaging sequences or cycles for producing suture packages.

(12) A sensor 77 at the final workstation on the packaging machine 10 checks for the presence of a package that may not have been removed at stations (10) and (11). This is a further safegard built into the packaging machine to ensure that the tool nest at station (1) is empty and ready to accept an empty package tray.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A machine for the automated packaging of a single needle having an attached suture to produce a suture package, wherein said machine includes automatically winding said suture within peripheral dimensions of a tray and attaching a cover to said tray so as to constitute said suture package, said machine having at least one tool nest for supporting said tray, and means for imparting a forwarding motion to said tool nest and said tray supported thereon for indexed advance to a plurality of workstations arranged in stations proximate a path of advancing movement of said at least one tool nest; said machine comprising:

(a) a first workstation including means for mounting an empty said tray on a support surface located on said at least one tool nest, said means comprising means for stacking a supply of said empty trays; a rotary plate arranged beneath said tray stacking means, said rotary plate being adapted to receive an individual one of said trays from the bottom of said stacking means; means for indexing said rotary plate forwardly at predetermined angular increments; and motion means for engaging said tray on said rotary plate and transferring said tray to the support surface on said one tool nest;

(b) a second workstation including means for imparting a predetermined angular displacement to said tray and support surface on said at least one tool nest mounting said tray to facilitate subsequent insertion of a surgical needle into said tray;

(c) a third workstation having needle transfer means positionable in operative relationship opposite said support surface at a predetermined angular displacement relative thereto, said needle transfer means including gripper structure for engaging a surgical needle having a suture attached thereto; means for advancing said gripper structure and surgical needle towards said tray for positioning said needle on retaining structure formed in said tray; and means for releasing and retracting said gripper structure subsequent to positioning said needle in said tray;

(d) a fourth workstation including means for imparting a predetermined rotational movement to the tray which has a surgical needle retained therein with an attached suture having a portion extending outwardly and downwardly from said tray;

(e) a fifth workstation including means for imparting rapid rotational movement to said previously rotated tray so as to completely wind said depending suture portion into the peripheral dimensions of said tray;

(f) a sixth workstation including means for applying a cover to a tray containing a surgical needle and attached suture, said tray being positioned on a support surface located on said at least one tool nest, said cover-applying means comprising means for stacking a supply of said covers; a rotary plate arranged beneath said tray stacking means, said rotary plate being adapted to receive an individual one of said covers from the bottom of said cover stacking means; means for indexing said rotary plate forwardly at predetermined angular increments; and motive means for engaging said cover on said rotary plate and transferring said cover for application to the tray which is mounted on the support surface of said at least one tool nest; and (g) a seventh workstation including motive means for engaging said suture package located on the support surface of said at least one tool nest; compartmented tray means having a plurality of compartments being positionable at said workstation below said motive means, said motive means being actuateable to disengage said suture package from said support surface and convey said suture package into a respective said compartment.

2. An arrangement as claimed in claim 1, wherein said tray stacking means in (a) comprises an open-bottomed chute having a vertical stack of said trays arranged therein, said rotary plate being horizontal and extending closely below the bottom of said chute so as to receive the bottommost tray therefrom on an upper surface of said rotary plate.

3. An arrangement as claimed in claim 2, wherein said rotary plate is in communication with a vacuum-generating source for imparting a vacuum to the upper surface of said rotary plate to retain said tray thereon during at least the indexing advance of said rotary plate.

4. An arrangement as claimed in claim 1, wherein said motion means in (a) comprises pivotable arm structure having tray-engaging means for lifting said tray from said rotary plate and transferring said tray to the support surface on said at least one tool nest.

5. An arrangement as claimed in claim 4, wherein said rotary plate communicates with a vacuum-generating source for imparting a vacuum thereto for retaining said tray on said plate, said vacuum being released upon said tray-engaging means contacting said tray, and a vacuum in said tray-engaging means retaining said tray thereon to facilitate transporting said tray to the support surface on said at least one tool nest.

6. An arrangement as claimed in claim 5, wherein upon said tray-engaging means mounting said tray on the support surface of said at least one tool nest, said vacuum in said tray-engaging means is released and a vacuum concurrently applied to the support surface of said at least one tool nest so as to retain said tray thereon.

7. An arrangement as claimed in claim 2, wherein a carousel comprises a plurality of said chutes in a circular rotatable arrangement whereby upon a chute being emptied of said trays, an adjacent tray-filled chute is rotated into position above said rotary plate to facilitate the supplying of trays to said rotary plate.

8. An arrangement as claimed in claim 1, wherein said motion means in (a) comprises a cam-controlled robotic pivot arm adapted to swing between a vertical orientation to a horizontal and forward motion for transferring said tray from said rotary plate to said support surface on said at least one tool nest.

9. An arrangement as claimed in claim 1, wherein said means for imparting said angular displacement in (b) comprises structure for engageable contact with said support surface.

10. An arrangement as claimed in claim 9, wherein said structure comprises a slidable element having contact means for engaging said support surface, and pivot arm means for imparting movement to said contact means towards said support surface to impart said angular displacement thereto.

11. An arrangement as claimed in claim 9, wherein said support surface on said at least one tool nest is fastened to a rotatable shaft extending through said at least one tool nest; means normally securing said shaft from relative rotation, said means releasing said shaft for axial movement and rotation in said at least one tool nest to facilitate said angular displacement means to impart said angular displacement to said tray and support surface.

12. An arrangement as claimed in claim 11, wherein cam structure is contacted by an opposite end of said shaft to limit the axial movement of said shaft.

13. An arrangement as claimed in claim 9, wherein said at least one tool nest includes locking pin means for locking said tray and support surface in said angularly displaced position.

14. An arrangement as claimed in claim 9, wherein said angular displacement of said tray and support surface on said at least one tool nest subtends an angle of about 16.5° with a horizontal axis of said tray.

15. An arrangement as claimed in claim 1, wherein said means in (c) for releasing said gripper structure after positioning said surgical needle in said tray comprises piston and ram structure for actuating said gripper structure.

16. An arrangement as claimed in claim 1, wherein said needle transfer means in (c) comprises a component of a swaging mechanism for attaching sutures to surgical needles.

17. An arrangement as claimed in claim 1, wherein said machine comprises means for adjusting the elevation of said at least one tool nest relative to the needle transfer means in (c) so as to accommodate the transferring of differently sized surgical needles into said tray without substantially modifying any components of the machine.

18. An arrangement as claimed in claim 17, wherein said elevation adjusting means comprise hydraulic lifting means for adjusting the elevational positions of said at least one tool nest relative to said needle transfer means.

19. An arrangement as claimed in claim 18, wherein a turntable mounts a plurality of said tool nests in peripherally spaced relationship for indexed advance to successive of said workstations, said hydraulic lifting means being connected to said turntable for adjusting the elevation thereof.

20. An arrangement as claimed in claim 19, wherein said workstations about said turntable are mounted on a stationary frame of said machine, said turntable being supported on a movable frame located within said stationary frame of said machine.

21. An arrangement as claimed in claim 1, wherein suture clamping means are located proximate said at least one tool nest, said suture clamping means being activated to clampingly engage a portion of a suture attached to a surgical needle retained in a tray mounted on said support surface and depending therefrom at the workstation (c) for transferring said needle to said tray; including first vacuum-generating means for imparting a tension to said depending suture portion; and second vacuum-generating means for imparting tension to the trailing end of said depending suture portion.

22. An arrangement as claimed in claim 21, wherein said clamping means is activated at workstation (c) of said machine at which said surgical needle is transferred into said tray on the support surface of said tool nest so as to clampingly engage said depending suture portion, and is deactivated to release said suture portion upon said tool nest having advanced towards a subsequent winding workstation (d).

23. An arrangement as claimed in claim 21, wherein said first and second vacuum-generating means maintain tension on said depending suture portion during advance of said tool nest mounting said needle-containing tray towards a subsequent workstation.

24. An arrangement as claimed in claim 23, wherein said subsequent workstation comprises at least one further workstation (e) for winding said depending suture portion into the confines of said tray.

25. An arrangement as claimed in claim 24, wherein said second vacuum-generating means continually imparts tension to the trailing end of said depending suture portion until the latter is wound into said tray.

26. An arrangement as claimed in claim 23, wherein said first and second vacuum-generating means are positioned proximate the needle transferring (c) and suture winding workstations (d and e) of said machine.

27. An arrangement as claimed in claim 21, wherein said suture clamping means is fixedly connected with said at least one tool nest so as to be forwardly movable in conjunction therewith.

28. An arrangement as claimed in claim 21, wherein said clamping means is activated by a vacuum.

29. An arrangement as claimed in claim 21, wherein a plurality of said tool nests are mounted peripherally spaced about a rotatably indexed turntable, each said tool nest having respectively one said clamping means fixedly connected therewith.

30. An arrangement as claimed in claim 29, wherein each said clamping means is fastened to said turntable beneath a therewith associated tool nest.

31. An arrangement as claimed in claim 1, wherein rotation-imparting means at said winding workstation (d) rotates said tray so as to assume an orientation which is 180° inverted relative to the initial orientation of said tray on said at least one tool nest.

32. An arrangement as claimed in claim 31, wherein said rotation-imparting means comprises a winder head reciprocable towards and away from said tray on the support surface of said at least one tool nest, said winder head being engageable with said support surface in the forwardly extended position of the winder head; and drive means for imparting rotation to said winder head for rotating said tray.

33. An arrangement as claimed in claim 32, wherein the support surface on said at least one tool nest is fastened to a rotatable shaft extending through said at least one tool nest; means normally securing said shaft against relative rotation, said means releasing said shaft for axial movement and rotation to facilitate said winder head imparting the rotational movement to said tray and support surface.

34. An arrangement as claimed in claim 33, wherein cam structure is contacted by an opposite end of said shaft to limit the axial movement of said shaft.

35. An arrangement as claimed in claim 34, wherein said at least one tool nest includes locking pin means for locking said shaft in a predetermined rotational position responsive to deactivation of said release means so as to maintain said tray in said rotationally inverted position on said support surface.

36. An arrangement as claimed in claim 33, wherein said shaft releasing means comprises an air motor.

37. An arrangement as claimed in claim 1, wherein said rapid rotation imparting means at said winding workstation (e) comprises a winder head structure engageable with said tray and support surface for winding the extending portion of the suture into said tray.

38. An arrangement as claimed in claim 37, wherein said winder head structure at said second workstation comprises protruding means which are engageable with surface structure on said tray so as to facilitate winding of said depending suture portion into a peripheral channel formed in said tray.

39. An arrangement as claimed in claim 37, wherein said winder head structure at said second winding workstation (e) is rotated at a high rotational speed.

40. An arrangement as claimed in claim 37, wherein the support surface on said at least one tool nest is fastened to a rotatable shaft extending through said at least one tool nest; means normally securing said shaft against relative rotation, said means releasing said shaft for axial movement and rotation to facilitate said winder head imparting the rotational movement to said tray and support surface.

41. An arrangement as claimed in claim 40, wherein cam structure is contacted by an opposite end of said structure to limit the axial movement of said shaft.

42. An arrangement as claimed in claim 41, wherein said at least one tool nest includes locking pin means for locking said shaft in a predetermined rotational position responsive to deactivation of said release means so as to maintain said tray in said rotationally inverted position on said surface upon completing the of winding of the suture into said tray.

43. An arrangement as claimed in claim 40, wherein said shaft releasing means comprises an air motor.

44. An arrangement as claimed in claim 1, wherein suture tensioning means imparts tension to the depending suture portion prior to and during the winding of the suture into said tray at workstations (d and e).

45. An arrangement as claimed in claim 44, wherein said suture tensioning means comprises a plurality of vacuum nozzles.

46. An arrangement as claimed in claim 44, wherein further vacuum tensioning means impart tension to a trailing end of said depending suture portion until said suture is completely wound into said tray.

47. An arrangement as claimed in claim 1, wherein said cover stacking means in (f) comprises an open-bottomed chute having a vertical stack of said covers arranged therein, said rotary plate being horizontally oriented and extending closely below the bottom of said chute so as to receive the bottommost cover therefrom on an upper surface of said rotary plate.

48. An arrangement as claimed in claim 47, wherein said rotary plate is in communication with a vacuum-generating source for imparting a vacuum to the upper surface of said rotary plate so as to retain said cover thereon during at least the indexing advance of said rotary plate.

49. An arrangement as claimed in claim 47, wherein said motive means comprises pivotable arm structure having cover-engaging means for lifting said cover from said rotary plate and transferring said cover for application onto the tray on the support surface of said at least one tool nest.

50. An arrangement as claimed in claim 49, wherein said rotary plate communicates with a vacuum-generating source for imparting a vacuum thereto for retaining said cover on said plate, said vacuum being released upon said cover-engaging means contacting said cover, and a vacuum in said cover-engaging means retaining said cover thereon to facilitate transporting said cover for application to the tray on the support surface of said at least one tool nest.

51. An arrangement as claimed in claim 50, wherein upon said cover-engaging means applying said cover to said tray on the support surface of said at least one tool nest, said vacuum in said cover-engaging means is released and a vacuum concurrently applied to the support surface of said at least one tool nest so as to retain said formed suture package thereon.

52. An arrangement as claimed in claim 47, wherein said motive means comprises a cam-controlled robotic pivot arm adapted to swing between a vertical orientation to a horizontal and forward motion for transporting said cover from said rotary plate to said tray on the support surface of said at least one tool nest.

53. An arrangement as claimed in claim 1, wherein said plurality of compartments in (g) are located in a linear array on said compartmented tray means, said motive means introducing a predetermined quantity of said suture packages into each said compartment; and means for indexing said compartmented tray means responsive to a compartment being filled with said predetermined quantity of suture packages so as to align an adjacent said compartment of said compartmented tray means for the conveyance thereto of suture packages by said motive means.

54. An arrangement as claimed in claim 53, wherein drive means replaces the compartmented tray means having the compartments thereof filled with said suture packages with a second empty compartmented tray means.

55. An arrangement as claimed in claim 54, wherein said drive means shifts said second compartmented tray means laterally perpendicularly to a longitudinal indexing axis for said compartmented tray means.

56. An arrangement as claimed in claim 53, wherein said motive means comprise a cam-controlled pivot arm.

57. An arrangement as claimed in claim 56, wherein drive means activate said pivot arm between an elevated horizontal orientation for movement towards and away from said suture package to a downwardly pivoted position above a respective one of the compartments of said compartmented tray means.

58. An arrangement as claimed in claim 57, wherein an outer end of said pivot arm includes suction elements communicating with a source of a controllable vacuum.

59. An arrangement as claimed in claim 58, wherein a vacuum is applied to said suction elements upon contact thereof with the suture package on the support surface on said at least one tool nest, said vacuum being maintained to transfer the suture package to said pivot arm from said support surface while releasing a vacuum in said tool nest, pivoting said pivot arm downwardly over one said compartment and releasing the vacuum in said suction elements to permit the suture package to drop into the compartment located therebelow.

60. An arrangement as claimed in claim 1, wherein a rejected suture package is retained on the support surface of said at least one tool nest for conveyance to a further workstation, and means at said further workstation being provided for withdrawing said rejected suture package from the support surface of said tool nest.

61. An arrangement as claimed in claim 60, wherein said withdrawing means includes a reciprocating member for movement towards and away from said at least one tool nest; and gripper means on the leading and of said reciprocating member for graspingly engaging and withdrawing a rejected suture package from said tool nest.

62. An arrangement as claimed in claim 61, wherein a conveyor belt is located below said reciprocating member, said gripper means releasing said rejected suture package onto said conveyor belt for transport to a disposal site.

63. A method for the automated packaging of a single needle having an attached suture to produce a suture package, which includes automatically winding said suture within peripheral dimensions of a tray and attaching a cover to said tray so as to constitute said suture package, at least one tool nest for supporting said tray, and imparting a forwarding motion to said tool nest and said tray supported thereon for indexed advance to a plurality of workstations arranged in stations proximate a path of advancing movement of said at least one tool nest; said method comprising:

(a) at a first workstation mounting an empty said tray on a support surface located on said at least one tool nest, stacking a supply of said empty trays; arranging a rotary plate beneath said tray stack, said rotary plate being adapted to receive an individual one of said trays from the bottom of said stack; indexing said rotary plate forwardly at predetermined angular increments; and engaging said tray on said rotary plate and transferring said tray to the support surface on said one tool nest;

(b) at a second workstation imparting a predetermined angular displacement to said tray and support surface on said at least one tool nest mounting said tray to facilitate subsequent insertion of a surgical needle into said tray;

(c) at a third workstation positioning needle transfer means in operative relationship opposite said support surface at a predetermined angular displacement relative thereto, said needle transfer means including gripper structure for engaging a surgical needle having a suture attached thereto; advancing said gripper structure and surgical needle towards said tray for positioning said needle on retaining structure formed in said tray; and releasing and retracting said gripper structure subsequent to positioning said needle in said tray;

(d) at a fourth workstation imparting a predetermined rotational movement to the tray which has a surgical needle retained therein with an attached suture having a portion extending outwardly and downwardly from said tray;

(e) at a fifth workstation imparting rapid rotational movement to said previously rotated tray so as to completely wind said depending suture portion into the peripheral dimensions of said tray;

(f) at a sixth workstation applying a cover to a tray containing a surgical needle and attached suture, said tray being positioned on a support surface located on said at least one tool nest, said cover-applying step comprising stacking a supply of said covers; arranging a rotary plate beneath said tray stack, said rotary plate being adapted to receive an individual one of said covers from the bottom of said cover stack, indexing said rotary plate forwardly at predetermined angular increments; and engaging said cover on said rotary plate and transferring said cover for application to the tray which is mounted on the support surface of said at least one tool nest; and (g) at a seventh workstation having motive means engage said suture package located on the support surface of said at least one tool nest; a compartmented tray having a plurality of compartments being positionable at said workstation below said motive means, said motive means being actuateable to disengage said suture package from said support surface and convey said suture package into a respective said compartment.

64. A method as claimed in claim 63, wherein said tray stack in (a) is located in an open-bottomed chute having a vertical stack of said trays arranged therein, said rotary plate being horizontal and extending closely below the bottom of said chute so as to receive the bottommost tray therefrom on an upper surface of said rotary plate.

65. A method as claimed in claim 64, wherein said rotary plate is in communication with a vacuum-generating source for imparting a vacuum to the upper surface of said rotary plate to retain said tray thereon during at least the indexing advance of said rotary plate.

66. A method as claimed in claim 63, wherein said motion means in (a) comprises pivotable arm structure having tray-engaging means for lifting said tray from said rotary plate and transferring said tray to the support surface on said at least one tool nest.

67. A method as claimed in claim 66, wherein said rotary plate communicates with a vacuum-generating source for imparting a vacuum thereto for retaining said tray on said plate, said vacuum being released upon said tray-engaging means contacting said tray, and a vacuum in said tray-engaging means retaining said tray thereon to facilitate transporting said tray to the support surface on said at least one tool nest.

68. A method as claimed in claim 67, wherein upon said tray-engaging means mounting said tray on the support surface of said at least one tool nest, said vacuum in said tray-engaging means is released and a vacuum concurrently applied to the support surface of said at least one tool nest so as to retain said tray thereon.

69. A method as claimed in claim 64, wherein a carousel comprises a plurality of said chutes in a circular rotatable arrangement whereby upon a chute being emptied of said trays, an adjacent tray-filled chute is rotated into position above said rotary plate to facilitate the supplying of trays to said rotary plate.

70. A method as claimed in claim 63, wherein said motion means in (a) comprises a cam-controlled robotic pivot arm adapted to swing between a vertical orientation to a horizontal and forward motion for transferring said tray from said rotary plate to said support surface on said at least one tool nest.

* * * * *